US012405053B2

(12) United States Patent
Choi

(10) Patent No.: US 12,405,053 B2
(45) **Date of Patent: *Sep. 2, 2025**

(54) REFRIGERATOR AND ELEVATION DEVICE FOR REFRIGERATOR

(71) Applicant: LG Electronics Inc., Seoul (KR)

(72) Inventor: Kwanghyun Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/742,220

(22) Filed: Jun. 13, 2024

(65) Prior Publication Data

US 2024/0328707 A1 Oct. 3, 2024

Related U.S. Application Data

(63) Continuation of application No. 18/140,238, filed on Apr. 27, 2023, now Pat. No. 12,050,050, which is a continuation of application No. 17/673,526, filed on Feb. 16, 2022, now Pat. No. 11,668,517, which is a continuation of application No. 17/126,468, filed on Dec. 18, 2020, now Pat. No. 11,287,178, which is a continuation of application No. 16/230,474, filed on Dec. 21, 2018, now Pat. No. 10,921,052.

(30) Foreign Application Priority Data

Jun. 22, 2018 (KR) ..... 10-2018-0071898

(51) Int. Cl.
*F25D 25/02* (2006.01)
*F25D 23/02* (2006.01)

(52) U.S. Cl.
CPC ..... *F25D 25/022* (2013.01); *F25D 25/025* (2013.01); *F25D 23/021* (2013.01)

(58) Field of Classification Search
CPC ..... A47B 9/16; F25D 25/025; F25D 25/04; F25D 23/021; F25D 25/022
See application file for complete search history.

(56) References Cited

U.S. PATENT DOCUMENTS

2006/0043848 A1* 3/2006 Jeong ..... A47B 67/04 312/310
2008/0018215 A1* 1/2008 Carden ..... F25D 25/04 312/404
2014/0265797 A1* 9/2014 Scheuring ..... F25D 25/025 312/405
2014/0265806 A1* 9/2014 Hall ..... F25D 25/025 312/408
2018/0128540 A1* 5/2018 Yasaka ..... B66F 7/02

* cited by examiner

*Primary Examiner* — Matthew W Ing
(74) *Attorney, Agent, or Firm* — Fish & Richardson P.C.

(57) ABSTRACT

An elevation device for a refrigerator drawer includes a lower frame, an upper frame, and a lifting assembly. The lifting assembly includes: a pair of first rods having a first end rotatably coupled to the lower frame and a second end that translates along the upper frame; and a pair of second rods having a first end rotatably coupled to the upper frame and a second end that translates along the lower frame. The second rod is rotatably coupled to and crosses the first rod. The first or second rod is connected to a driving device via the first end of the first or second rod, with the driving device disposed outside the upper frame and the lower frame. The first and second rods are configured to, based on power from the driving device, rotate about their respective first ends to elevate the upper frame relative to the lower frame.

23 Claims, 50 Drawing Sheets

REFRIGERATOR AND ELEVATION DEVICE FOR REFRIGERATOR

CROSS-REFERENCE TO RELATED APPLICATIONS

The present application is a continuation of U.S. application Ser. No. 18/140,238, filed on Apr. 27, 2023, which is a continuation of U.S. application Ser. No. 17/673,526, filed on Feb. 16, 2022, now U.S. Pat. No. 11,668,517, which is a continuation of U.S. application Ser. No. 17/126,468, filed on Dec. 18, 2020, now U.S. Pat. No. 11,287,178, which is a continuation of U.S. application Ser. No. 16/230,474, filed on Dec. 21, 2018, now U.S. Pat. No. 10,921,052, which claims priority under 35 U.S.C. 119 and 35 U.S.C. 365 to Korean Patent Application No. 10-2018-0071898, filed on Jun. 22, 2018. The disclosures of the prior applications are incorporated by reference in their entirety.

BACKGROUND

The present invention relates to a refrigerator and an elevation for a refrigerator.

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door for opening and closing the storage space.

The refrigerator door may be classified into a rotation-type door that opens and closes a storage space through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to turn its back to take out a basket or foods in the drawer-type door. If the basket or the foods are heavy, the user may feel inconvenient to use the basket or may be injured.

In order to solve such a limitation, various structures are being developed in which the drawer-type door is capable of being elevated.

Representatively, a refrigerator in which a lifting mechanism for elevation a bin provided in a refrigerating compartment is disclosed in U.S. Pat. No. 9,377,238.

However, this technique according to related art may have a structure in which the lifting mechanism for the elevation is disposed and exposed outside the bin to cause a serious safety problem. Also, there is a limitation that an outer appearance is poor due to the structure of the lifting mechanism exposed to the outside.

Also, since a driving part is exposed to the outside, noise during operation of the driving part may be transmitted to the outside as it is, which may cause the user's dissatisfaction.

Also, since the lifting mechanism is disposed inside the refrigerator, storage capacity within the refrigerator may be significantly reduced. This may cause a limitation that storage efficiency of the refrigerator is greatly reduced due to the loss in storage capacity of the whole refrigerator.

Also, the lifting mechanism is provided inside the refrigerator. Thus, separation of the door and separation of the lifting mechanism are required for service of the lifting mechanism to deteriorate serviceability.

Also, a driving part of the lifting mechanism has a structure for elevating the bin by pushing one end of the support assembly. Therefore, when a large heavy structure or a heavy object is disposed inside the bin, sufficient force for the elevation may not be provided. Of course, although a motor of the driving part increases in size to solve this limitation, there are limitations that an internal volume loss and noise become larger, and the manufacturing cost increases.

Also, the lifting mechanism supports one side of the entire bottom surface of the bin due to the arrangement position of the driving part. Therefore, in the state where the bin is filled with a stored product, an eccentric load may occur. Here, a serious problem may arise in stability due to the eccentric load acting in a state in which the door is withdrawn, there is a limitation that the elevation operation is not performed smoothly.

Also, the lifting mechanism has a structure in which the entire bin is elevated. In order to elevate the bin, the bin has to be completely withdrawn from the storage space of the refrigerator. Also, when the bin is elevated, the bin has to be withdrawn up to a position at which the bin does not interfere with the upper door and the refrigerator body. However, in this structure, when the door is completely withdrawn, a loss of cold air within the refrigerator may cause a limitation in stability, and there is a possibility that stability is deteriorated by an occurrence of deflection due to the load of the lifting mechanism. Thus, it is necessary to supplement the draw-out structure, and there is a limitation in that it is difficult to be applied to the structure of the bin or door which is substantially large in size.

SUMMARY

Embodiments provide a refrigerator in which an electric device for elevation is provided inside a door part, and a mechanical device for the elevating the drawer part is provided in a drawer outside the door and an elevation for a refrigerator.

Embodiments also provide a refrigerator which is capable of preventing deflection from occurring by an eccentric load when the drawer part is elevated to ensure a stable elevation operation and an elevation for a refrigerator.

Embodiments also provide a refrigerator in which an elevation device having a mechanism structure, which is provided in a drawer part to elevate at least a portion of the drawer part, and a driving device that is an electrical device, which is provided in a door part to generate power, are separated together with each other when the door part and the drawer part are separated and an elevation device for a refrigerator.

Embodiments also provide a refrigerator which is improved in assembly workability, cleanability, and serviceability of a drawer door that is capable of being inserted and withdrawn and an elevation for a refrigerator.

Embodiments also provide a refrigerator which is capable of providing a withdrawable structure in a state in which a loss of storage capacity is minimized and an elevation for a refrigerator.

Embodiments also provide a refrigerator, which is smoothly elevated by a lifting assembly and an elevation device for a refrigerator.

Embodiments also provide a refrigerator which has a structure in which a lifting assembly is not exposed to the outside when an elevation device is elevated to improve an outer appearance and safety in use and an elevation device for a refrigerator.

According to one aspect of the subject matter described in this application, an elevation device for a refrigerator includes: a lower frame configured to be fixed to a bottom of a drawer, the drawer being configured to insert into and withdraw from the refrigerator; an upper frame disposed vertically above the lower frame and configured to support an object stored in the drawer; and a lifting assembly. The lifting assembly includes: a pair of first rods includes a first rod, the pair of first rods having a first end rotatably coupled to the lower frame and a second end configured to translate along the upper frame; and a pair of second rods including a second rod, the pair of second rods having a first end rotatably coupled to the upper frame and a second end configured to translate along the lower frame. The second rod is rotatably coupled to the first rod, and crosses the first rod. The first rod or the second rod is connected to a driving device via the first end of the first rod or the second rod, with the driving device disposed outside the upper frame and outside the lower frame and configured to transmit power. The pair of first rods and the pair of second rods are configured to, based on the power transmitted from the driving device, rotate about their respective first ends to elevate the upper frame relative to the lower frame.

Implementations according to this aspect may include one or more of the following features. For example, the lifting assembly is a first lifting assembly configured to support a first side of the upper frame, and the elevation device further includes a second lifting assembly configured to support a second side of the upper frame. The second lifting assembly may include a pair of third rods and a pair of fourth rods, and the first lifting assembly and the second lifting assembly are connected to the driving device and configured to be simultaneously operated by the driving device.

In some implementations, the upper frame includes an upper frame edge that extends from a circumference of the upper frame toward the lower frame, and the lower frame includes a lower frame edge that extends from a circumference of the lower frame toward the upper frame. The upper frame may be configured to: move downward to the lower frame; based on moving downward to a lowest position, contact the lower frame; and based on contacting the lower frame, define an accommodation space configured to accommodate the pair of first rods and the pair of second rods.

In some implementations, one of the upper frame edge or the lower frame edge includes a coupling protrusion, where the other of the upper frame edge or the lower frame edge defines a coupling groove configured to receive the coupling protrusion, the coupling groove having a shape corresponding to the coupling protrusion. The coupling groove and the coupling protrusion are configured to couple to each other in a state in which the upper frame contacts the lower frame. In some examples, the pair of first rods and the pair of second rods are configured to overlap each other, where, in a state in which the pair of first rods and the pair of second rods overlap each other, a height of the accommodation space is greater than a sum of a thickness of the pair of first rods and a thickness of the pair of second rods.

In some implementations, each of the upper frame and the lower frame has a rectangular frame shape with an opened central portion, where the elevation device further includes a support plate that is located on the upper frame, that covers the upper frame, and that is configured to support the object stored in the drawer. In some examples, the support plate includes: an edge part located at a perimeter of the support plate and configured to accommodate the upper frame; and a support part that is surrounded by the edge part, that is recessed toward the lower frame to store a food item or a container therein, and that is configured to insert into the opened central portion of each of the upper frame and the lower frame.

In some implementations, the elevation device further includes a rotation shaft that passes through the lower frame, that protrudes from the lower frame to an outside of the lower frame, and that is configured to be connected to the driving device at the outside of the lower frame, where the first rod is configured to rotate about the rotation shaft at the first end of the first rod. In some examples, the first rod includes a rod protrusion that protrudes from a side of the first rod and that is spaced apart from the rotation shaft, and the first rod is configured to rotate about the rotation shaft in a state in which both of the rotation shaft and the rod protrusion are coupled to the driving device.

In some implementations, the elevation device further includes: a first sliding shaft that connects the second ends of the pair of first rods to each other, the pair of first rods being spaced apart from each other; and a second sliding shaft that connects the second ends of the pair of second rods to each other. The pair of second rods may be spaced apart from each other. The upper frame may define a first slide guide at an inner surface of the upper frame in which the first slide guide is configured to receive the first sliding shaft and to guide a movement of the first sliding shaft. The lower frame may define a second slide guide at an inner surface of the lower frame in which the second slide guide is configured to receive the second sliding shaft and to guide a movement of the second sliding shaft.

In some examples, the elevation device further includes an elastic member that connects the first sliding shaft to a side of the upper frame facing the first sliding shaft, where the elastic member is configured to be tensioned based on the upper frame moving toward the lower frame. In some examples, each of the upper frame and the lower frame defines an opening, where the elevation device further includes: an upper partition part that crosses the opening of the upper frame; and a lower partition part that crosses the opening of the lower frame. The upper partition part and the lower partition part may be configured to face each other and to divide each of the opening of the upper frame and the opening of the lower frame into a left opening and a right opening. The pair of first rods and the pair of second rods may be disposed at the left opening, and the elevation device may further include a pair of third rods and a pair of fourth rods disposed at the right opening.

In some implementations, the elevation device may further include a roller disposed at the second end of each of the first rod and the second rod, where the roller at the second end of the first rod is configured to contact and roll along the upper frame based on rotation of the first rod about the first end of the first rod. The roller at the second end of the second rod may be configured to contact and roll along the lower frame based on rotation of the second rod about the first end of the second rod.

According to another aspect, a refrigerator includes: a cabinet that defines an upper storage space and a lower storage space; a front panel door part configured to open and close the lower storage space; a drawer part configured to insert into and withdraw from the lower storage space; a driving device disposed at the front panel door part; and an elevation device disposed at the drawer part and configured to elevate an object stored in the drawer part. The elevation device includes: a lower frame disposed inside the drawer part; an upper frame disposed vertically above the lower frame and configured to support the object; and a lifting assembly including a plurality of rods that are rotatably coupled to each other, that cross each other, and that connect the lower frame to the upper frame. The driving device is configured to drive a rotation of at least one rod among the plurality of rods, through an end of the at least one rod that is rotatably coupled to the lower frame or to the upper frame, to elevate the upper frame relative to the lower frame.

Implementations according to this aspect may include one or more of the following features or the features described above. For example, the drawer part may define a drawer space having an opening at a top of the drawer space, where the drawer space includes: a front space at which the elevation device is arranged, the front space being configured to be positioned at an outside of the lower storage space based on the drawer part being withdrawn from the lower storage space; and a rear space defined rearward of the front space. Each of the upper frame and the lower frame may have a size corresponding to a size of the front space.

In some implementations, the refrigerator further includes a drawer cover located in the drawer part and configured to partition the drawer space into the front space and the rear space. In some implementations, the elevation device further includes a connection assembly that is located at the front panel door part, that is configured to couple to the elevation device exposed at a front surface of the drawer part, and that is configured to transmit power from the driving device to the elevation device. The connection assembly may be configured to selectably separate the driving device at the front panel door part from the elevation device at the drawer part.

In some implementations, each of the upper frame and the lower frame has a rectangular frame shape with an opened central portion, where the upper frame is configured to: move downward to the lower frame; based on moving downward to the lower frame, contact the lower frame; and based on contacting the lower frame, define an accommodation space configured to accommodate the plurality of rods.

According to another aspect, a refrigerator includes: a cabinet that defines an upper storage space and a lower storage space; a door assembly that is configured to open and close the lower storage space and that is configured to insert into and withdraw from the lower storage space; a driving device disposed at a portion of the door assembly; an elevation device support part that extends from a rear surface of the door assembly toward the lower storage space; an elevation device disposed on the elevation device support part and configured to be elevated by the driving device; and a basket disposed on the elevation device and configured to be elevated by the elevation device. The elevation device includes: a lower frame fixed to the elevation device support part; an upper frame disposed vertically above the lower frame and configured to support the basket; and a lifting assembly including a plurality of rods that are rotatably coupled to each other, that cross each other, and that connect the lower frame to the upper frame. The driving device is configured to drive a rotation of at least one rod among the plurality of rods, through an end of the at least one rod that is rotatably coupled to the lower frame or to the upper frame, to elevate the upper frame relative to the lower frame.

Implementations according to this aspect may include one or more of the features described above or the following features. For example, the elevation device support part may include a surface configured to support a bottom surface of the elevation device.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
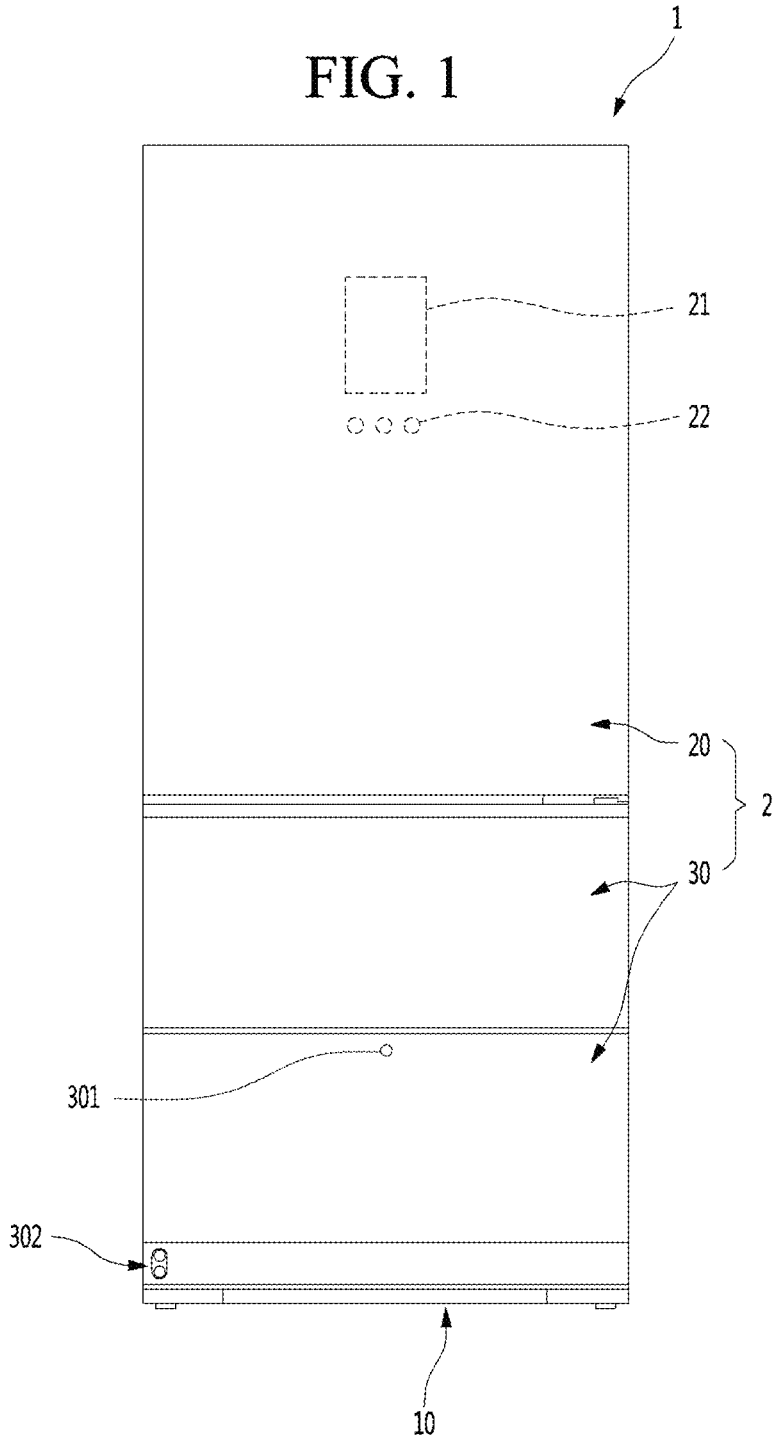
FIG. 1 is a front view of a refrigerator according to a first embodiment.
Figure 2:
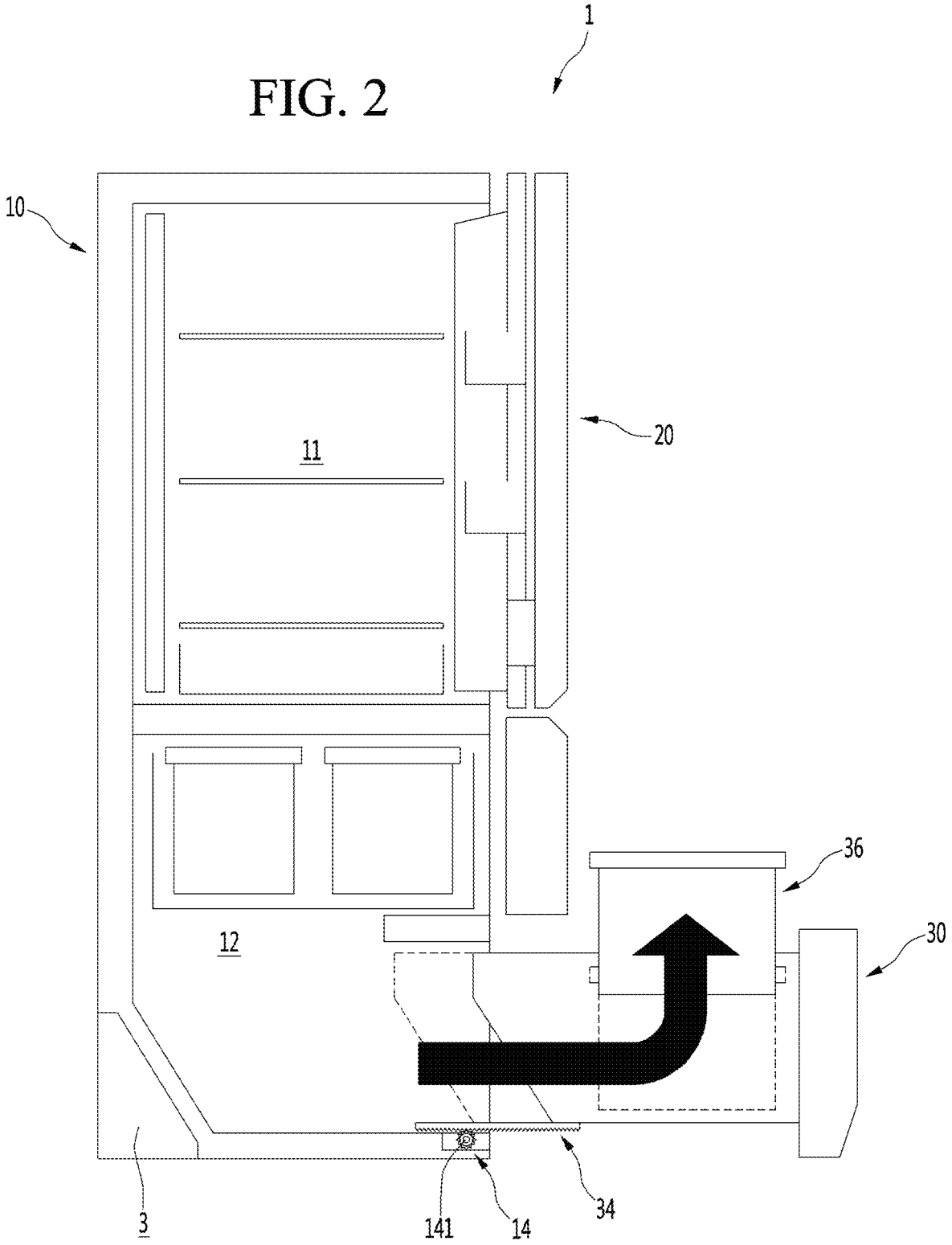
FIG. 2 is a schematic view illustrating a state in which a drawer door of the refrigerator is elevated.

FIG. 1 is a front view of a refrigerator according to a first embodiment. Also, FIG. 2 is a schematic view illustrating a state in which a drawer door of the refrigerator is elevated.

As illustrated in the drawing, the refrigerator 1 may have an outer appearance that is defined by a cabinet 10 defining a storage space and a door 2 covering an opened front surface of the cabinet 10.

The storage space of the cabinet 10 may be divided into a plurality of spaces. For example, an upper space 11 of the cabinet 10 may be provided as a refrigerating compartment, and a lower space 12 may be provided as a freezing compartment. Each of the upper space and the lower space may be provided as an independent space that is maintained at a different temperature, except for the refrigerating compartment and the freezing compartment. The upper space and the lower space may be called an upper space and a lower space.

The door 2 may be constituted by a rotation door 20 opening and closing the upper space through rotation thereof and a drawer door 30 opening and closing the lower space by being inserted or withdrawn in a drawer type. The lower space may be vertically divided again. The drawer door 30 may be constituted by an upper drawer door 30 and a lower drawer door 30. Also, an outer appearance of each of the rotation door 20 and the drawer door 30 may be made of a metal material and be exposed to the front side.

Although the refrigerator in which all of the rotation door 20 and the drawer door 30 are provided is described, the present disclosure is not limited thereto. For example, the present disclosure may be applied to all refrigerators including a door that is inserted and withdrawn in the drawer type. Also, the rotation door 20 may be provided at an upper portion and thus called an upper door, and the drawer door 30 may be provided at a lower portion and thus called a lower door.

A display 21 may be disposed on one side of a front surface of the rotation door 20. The display 21 may have a liquid crystal display structure or a 88 segment structure. Also, when the outer appearance of the door 2 is made of the metal material, a plurality of fine holes are punched in the display 21 to display information by using light passing therethrough.

Also, a manipulation part 22 that is capable of manipulating automatic rotation or withdrawal of the upper door 2 or the lower door 2 may be provided on one side of the rotation door 20. The manipulation part 22 may be integrated with the display 21 and may operate in a touch manner or a button manner. The manipulation part 22 may input an overall operation of the refrigerator 1 and manipulate an insertion and withdrawal of the drawer door 30 or an elevation within the drawer door.

A manipulation part 301 may also be provided on the drawer door 30. The manipulation part 301 may be disposed on one side of the drawer door 30 that is disposed at the lowermost portion of the drawer door 30. The manipulation part 301 may operate in a touch or button manner.

The manipulation part 22,301 may be provided as a sensor detecting proximity or movement of a user or provided as an input unit that operates by a user's motion or voice.

Also, as illustrated in the drawings, an inclined part 311*a* may be disposed on a lower portion of a front surface of the lower drawer door 30, and a manipulation device 302 may be mounted on the inclined part 311*a*. The manipulation device 302 may include a projector light capable of outputting an image and a proximity sensor and may project a virtual switch on the floor in the form of an image to detect the image by the proximity sensor. Of course, the manipulation device 302 may be constituted simply by only a proximity sensor. An automatic insertion and withdrawal and/or elevation of the lower drawer door 30 may be manipulated by the manipulation device.

The lower drawer door 30 may be automatically inserted and withdrawn according to the manipulation of the manipulation part 301. Also, a food or container 36 within the lower drawer door 30 may be elevated in a state in which the drawer door 30 is withdrawn by the manipulation of the manipulation part 301.

That is, the automatic insertion and withdrawal and/or automatic elevation of the lower drawer door 30 may be performed by at least one of a plurality of manipulation devices 22, 301, 302, and 303. As necessary, only one of the plurality of manipulation devices 22, 301, 302, and 303 may be provided.

Also, a manipulation device (see reference numeral 303 of FIG. 3) may be provided on a top surface of the lower drawer door 30. When the manipulation device 303 is provided on the upper surface of the lower drawer door 30, the lower drawer door 30 may not be manipulated because the lower drawer door 30 is not exposed in the closed state. Thus, the manipulation device 303 may be used for elevating the lower drawer door 30.

The manipulation devices 22, 301, 302, and 303 may be used to insert/withdraw and elevate the lower drawer door 30. Also, the insertion/withdrawal and the elevation may be performed by a combination or sequential operation of the plurality of manipulation devices 22, 301, 302, and 303.

The lower drawer door 30 may be a storage space defined in a lower side of the refrigerator 1 and may withdraw the lower drawer door 30 forward to accommodate a food stored in the lower drawer door 30, and then, the container 36 inside the drawer door 30 may be manipulated to be elevated.

The container 36 may have a predetermined height. Since the container 36 is seated on the elevation device 80, the height of the container 36 may increase by the height of the elevation device 80 when the elevation device 80 is elevated. Thus, when the elevation device 80 ascends, the user may easily accessible to the container 36 and very easily lift the container 36.

The container 326 may be completely accommodated in the accommodation part 32 when the door 30 is inserted and withdrawn. When the elevation device 80 ascends, the elevation device may be disposed at a position that is higher than that of an upper end of the drawer door 30.

The lower drawer door 30 may be automatically inserted and withdrawn forward and backward by the draw-out motor 14, the pinion 141 provided in the cabinet 10, and the draw-out rack 34 provided on the bottom surface of the lower drawer door 30.

Also, the container inside the lower drawer door 30 may be elevated by the driving device 40 and the elevation device 80 provided in the lower drawer door 30.

Hereinafter, the lower drawer door 30 and an operation of the lower drawer door 30 will be described in more detail, and also, the lower drawer door 30 will be called a drawer door or a door unless otherwise specified.

The embodiments are not limited to the number and shape of the drawer doors 30 and may be applied to all refrigerators having a door that is inserted and withdrawn in a drawer type into/from the lower storage space.

Figure 3:
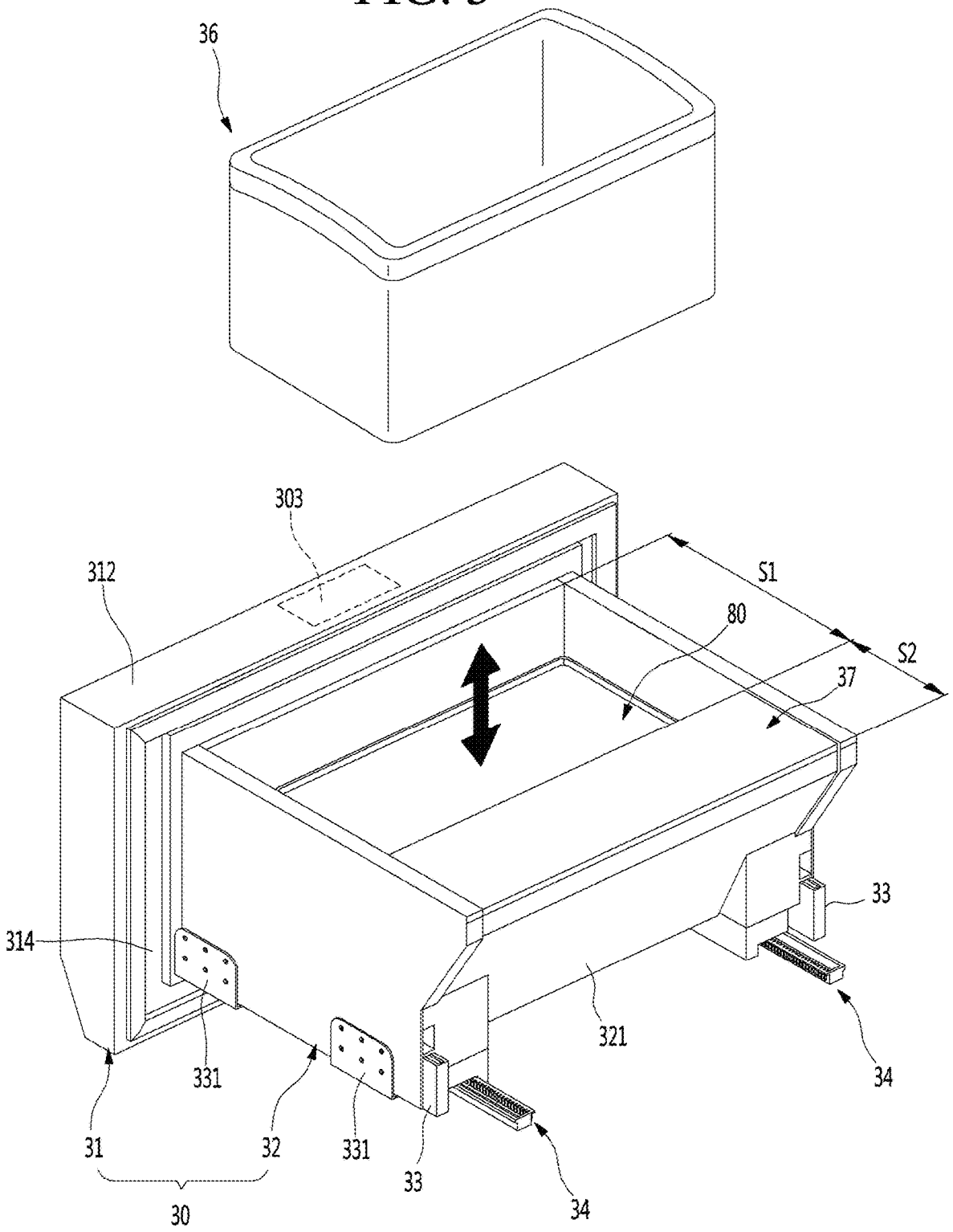
FIG. 3 is a perspective view illustrating a state in which a container of the drawer door is separated.
Figure 4:
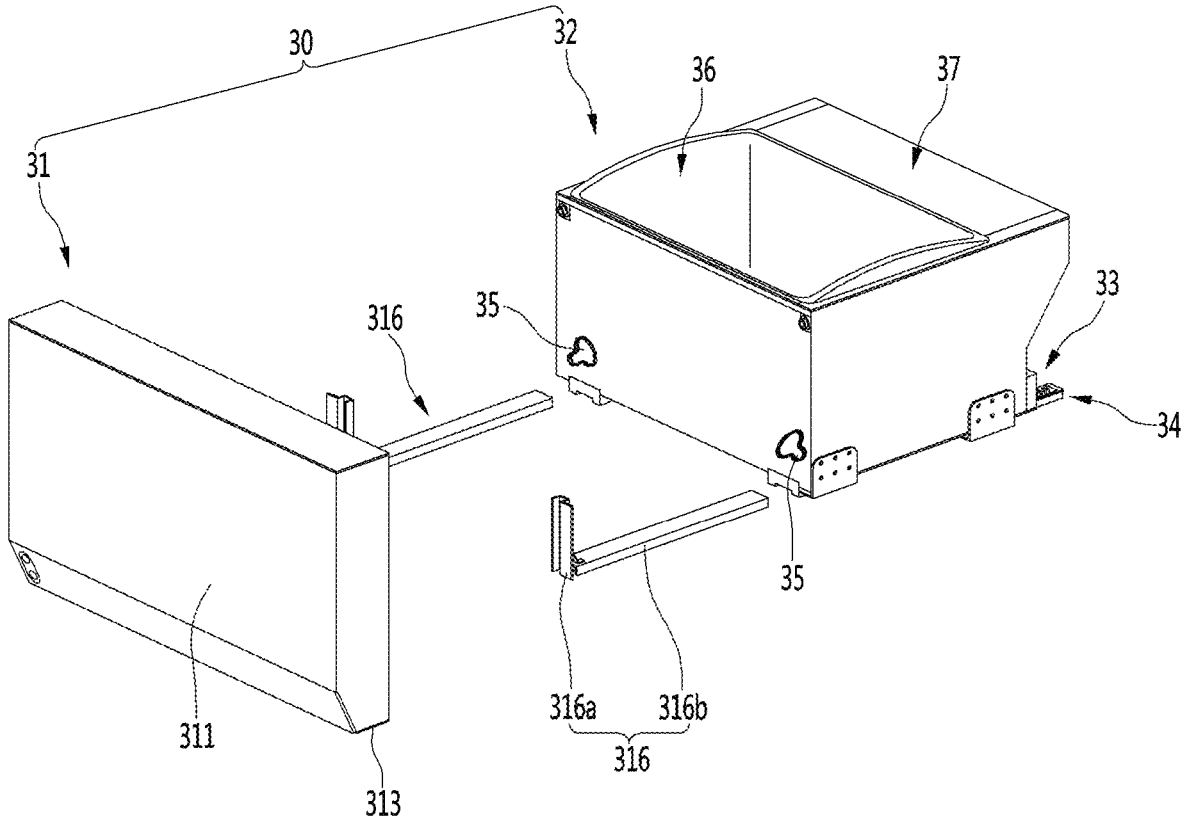
FIG. 4 is an exploded perspective view illustrating a state in which the drawer part of the drawer door and the front panel door part are separated from each other when viewed from a front side.

FIG. 3 is a perspective view illustrating a state in which a container of the drawer door is separated. FIG. 4 is an exploded perspective view illustrating a state in which the drawer part of the drawer door and the front panel door part are separated from each other when viewed from a front side.

As illustrated in the drawings, the door 30 may include a front panel door part 31 opening and closing the storage space and a drawer part 32 coupled to a rear surface of the front panel door part 31 and inserted and withdrawn together with the front panel door part 31.

The front panel door part 31 may be exposed to the outside of the cabinet 10 to define an outer appearance of the refrigerator 1, and the drawer part 32 may be disposed inside the cabinet 10 to define an storage space. Also, the front panel door part 31 and the drawer part 32 may be coupled to each other and inserted and withdrawn forward and backward together with each other.

The drawer part 32 may be disposed on the rear surface of the front panel door part 31 to define a space in which the food or container to be stored is accommodated. The inside of the drawer part 32 may provide an upwardly opened storage space, and an outer appearance of the drawer part 32 may be defined by a plurality of plates (see reference numerals 391, 392, and 395 in FIG. 19). Each of the plurality of plates 391, 392, and 395 may be made of a metal material and provided inside and outside the drawer part 32 so that the entire drawer part 32 is made of stainless steel or a material having a texture such as stainless steel.

In the state in which the door 30 is inserted, a machine room 3 in which a compressor and a condenser constituting a refrigeration cycle are provided may be disposed behind the door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the door 30 may be provided on each of both side surfaces of the drawer part 32. The door 30 may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multistage.

A rail bracket 331 may be provided in the draw-out rail 33, and the rail bracket 331 may extend from one side of the draw-out rail 33 to both sides of the drawer part 32. Also, the rail bracket 331 may be fixedly coupled to a sidewall surface inside the refrigerator. Thus, the drawer part 32, that is, the door 30, may be mounted to the cabinet 10 by the draw-out rails 33.

Also, the draw-out rail 33 may be provided on a lower end of each of both the side surfaces of the drawer part 32. Thus, it may be understood that the draw-out rail 33 is disposed on the bottom surface of the drawer part 32. Thus, the draw-out rail 33 may be provided at a lower ends of each of both sides of the drawer part 32 and may be called an under rail.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the door 30. That is, when an operation is inputted into the manipulation parts 22 and 301, the draw-out motor 14 may be driven to insert and withdraw the door 30 according to movement of the draw-out rack 34. Here, the door 30 may be stably inserted and withdrawn by the draw-out rail 33.

The draw-out rack 34 may not be provided on the drawer part 32. Here, the user may hold a side of the front panel door part 31 to push and pull the front panel door part 31 so that the door 30 is directly inserted and withdrawn.

The inside of the drawer part 32 may be divided into a front space S1 and a rear space S2. The elevation device 80 that is vertically elevated and a container seated on the elevation device 80 to be elevated together with the elevation device 80 may be disposed in the front space S1. Although the container 36 is illustrated in the form of a basket having an opened upper portion, the container 36 may have a closed box structure such as a kimchi box. Also, a plurality of containers 36 may be stacked or arranged in parallel to each other.

Also, when the door 30 is withdrawn, the entire drawer part 32 may not be withdrawn to the outside of the storage space due to a limitation in draw-out distance of the door 30. That is, at least the front space S1 is withdrawn to the outside of the storage space, and the whole or a portion of the rear space S2 is disposed inside the storage space within the cabinet 10.

As described above, a distance of the door 30 may be limited by the draw-out rack 34 or the draw-out rail 33. As the draw-out distance of the door 30 increases, the door 30 may have large moment applied to the door 30 in a draw-out state, which makes it difficult to maintain a stable state, and the draw-out rail 33 or the draw-out rack 34 may be deformed or damaged, or the refrigerator may be fell or unstable.

The elevation device 80 and the container 36 may be accommodated in the front space S1. While the elevation device is elevated, the food or container 36 seated on the elevation device 80 may be elevated together. Also, the elevation device 80 may be provided below the container 36, and the elevation device 80 may be covered by the container 36 when the container 36 is mounted. Thus, any constituent of the elevation device 80 will not be exposed to the outside.

A separate drawer cover 37 may be provided in the rear space S2. The front space S1 and the rear space S2 may be partitioned by the drawer cover 37. In a state in which the drawer cover 37 is mounted, a space in which front and top surfaces of the rear space S2 are covered and not be used may be not be exposed to the outside.

However, when the drawer cover 37 is separated, the user may be accessible to the rear space S2, and thus, foods may be easily accommodated in the rear space S2. To utilize the rear space S2, a separate pocket or a container corresponding to the shape of the rear space may be disposed in the rear space S2.

Also, the elevation device 80 inside the drawer part 32 may be simply separated and mounted to utilize the entire space inside the drawer part 32, and the elevation device 80 and the drawer cover 37 may be separated from each other to utilize the entire space of the drawer part 32.

Here, the elevation device 80 may be separated from the driving device 40. Thus, the elevation device may be simply separated to the side of the drawer part 32 without separating the driving device 40. Separation and mounting structures of the elevation device 80 will be described below in more detail.

The outer appearance of each of the inner and outer surfaces of the drawer part 32 may be defined by the separate plates 391, 392 and 395, which cover the components mounted on the drawer part 32, and thus, the outer and inner appearances may be seen to be neat. The plates 391, 392, and 395 may be constituted by a plurality of plates and may be made of stainless steel to provide a more luxurious and clean appearance.

As illustrated in the drawings, the front panel door part 31 and the drawer part 32 constituting the door 30 may be coupled to be separated from each other. Thus, assembling workability and serviceability may be improved through the separable structure of the front panel door part 31 and the drawer part 32.

A rear surface of the front panel door part 31 and a front surface of the drawer part 32 may be coupled to each other. When the front panel door part 31 and the drawer part 32 are coupled to each other, power for the elevation of the elevation device 80 may be provided. The driving device 40 for elevating the elevating device 80 may be disposed on the front panel door part 31, and the front panel door part 31 and the drawer part 32 may be selectively connected to each other.

Particularly, the driving part 40 provided in the front panel door part 31 may be configured to receive power from the power source and to transmit the power to the elevation part 80. Thus, it is possible to remove the front panel door part 31 when the service of the driving part 40 is necessary and to take measures simply by replacing only the front panel door part 31.

The front panel door part 31 and the drawer part 32 may be coupled by a pair of door frames 316 provided on both sides. The door frame 316 includes a door coupling part 316*a* extending upward and downward to be coupled to the front panel door part 31 and a drawer coupling part 316*b* extending backward from a lower end of the door coupling part 316*a*. The door coupling part 316*a* may be coupled to the front panel door part 31 by a separate coupling member and may be coupled to one side of the front panel door part 31 by a simple coupling structure. Also, the drawer coupling part 316*b* may be disposed on both sides of the drawer part 32 and adjacent to the draw-out rail 33.

The drawer coupling part 316*b* may be inserted into the drawer part 32 to support the drawer part 32 in a state in which the door coupling part 316*a* is coupled to the front panel door part 31. Also, the drawer coupling part 316*b* may be coupled to the drawer part 32 by a separate coupling member or may be coupled by a structure that mutually match the drawer coupling part 316*b*.

Also, a connection assembly 70 may be provided on the rear surface of the door 30 so that the driving part 40 and the elevation are 80 are connected to each other when the front panel door part 31 and the drawer part 32 are coupled. A drawer opening 35 through which a part of the elevation device 80 is exposed may be defined in a position corresponding to the connection assembly 70 on the front surface of the drawer part 32.

The front panel door part 31 may be configured to substantially open and close the storage space of the cabinet 10 and to define the front surface of the refrigerator 1.

The front panel door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, an insulating material 300 may be filled in the inside of the front panel door part 31 between an outer case 311 and a door liner 314.

Hereinafter, the front panel door part 31 and the driving assembly constituting the door 30 will be described in more detail with reference to the drawings.

Figure 5:
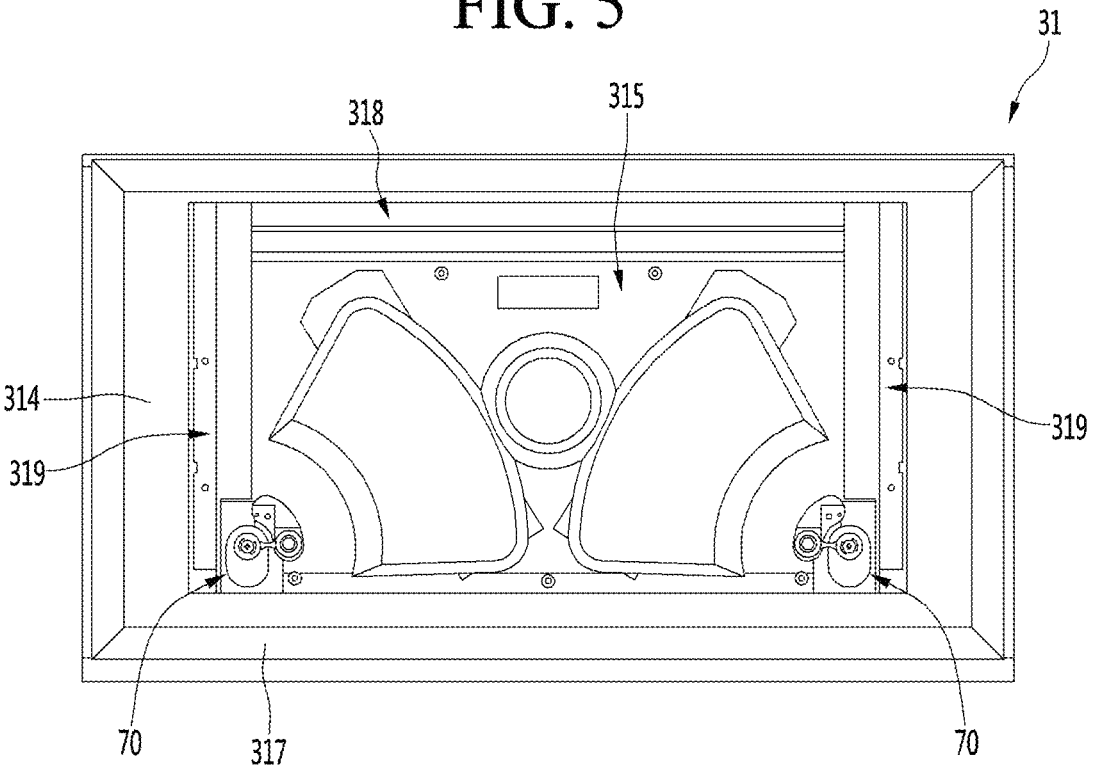
FIG. 5 is a rear view of the front panel door part.
Figure 6:
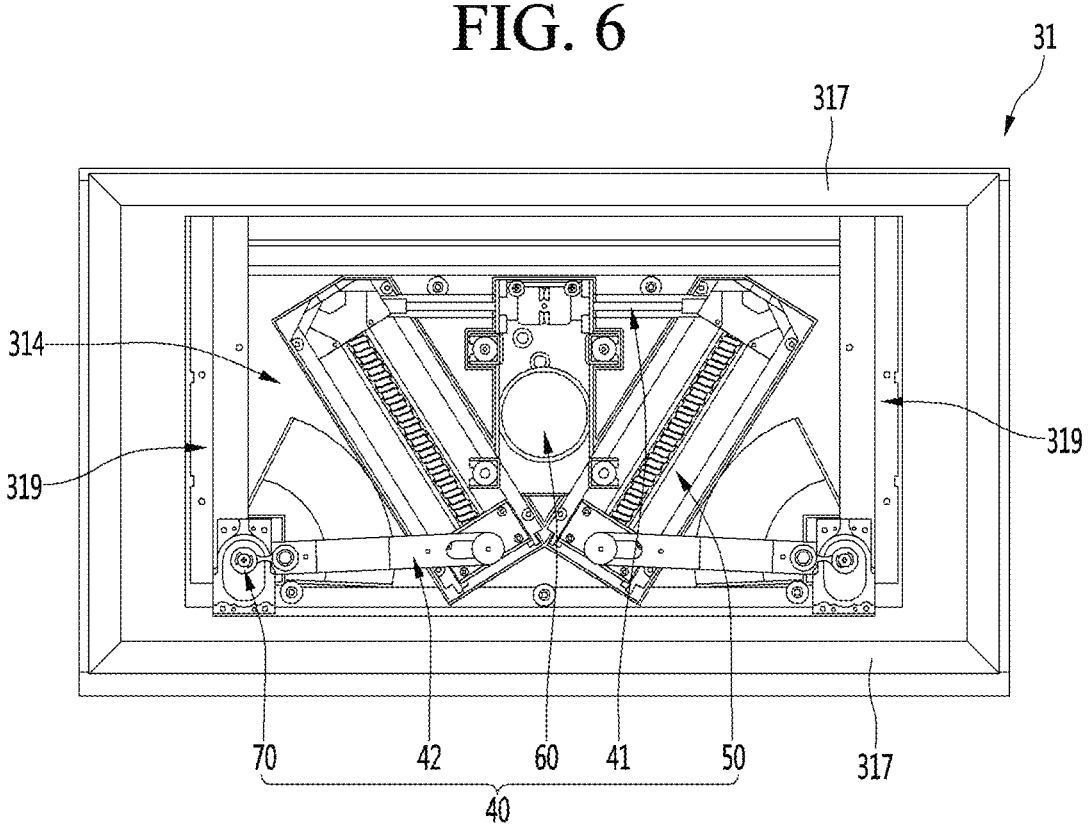
FIG. 6 is a rear view illustrating a state in which a door cover of the front panel door part is removed.
Figure 7:
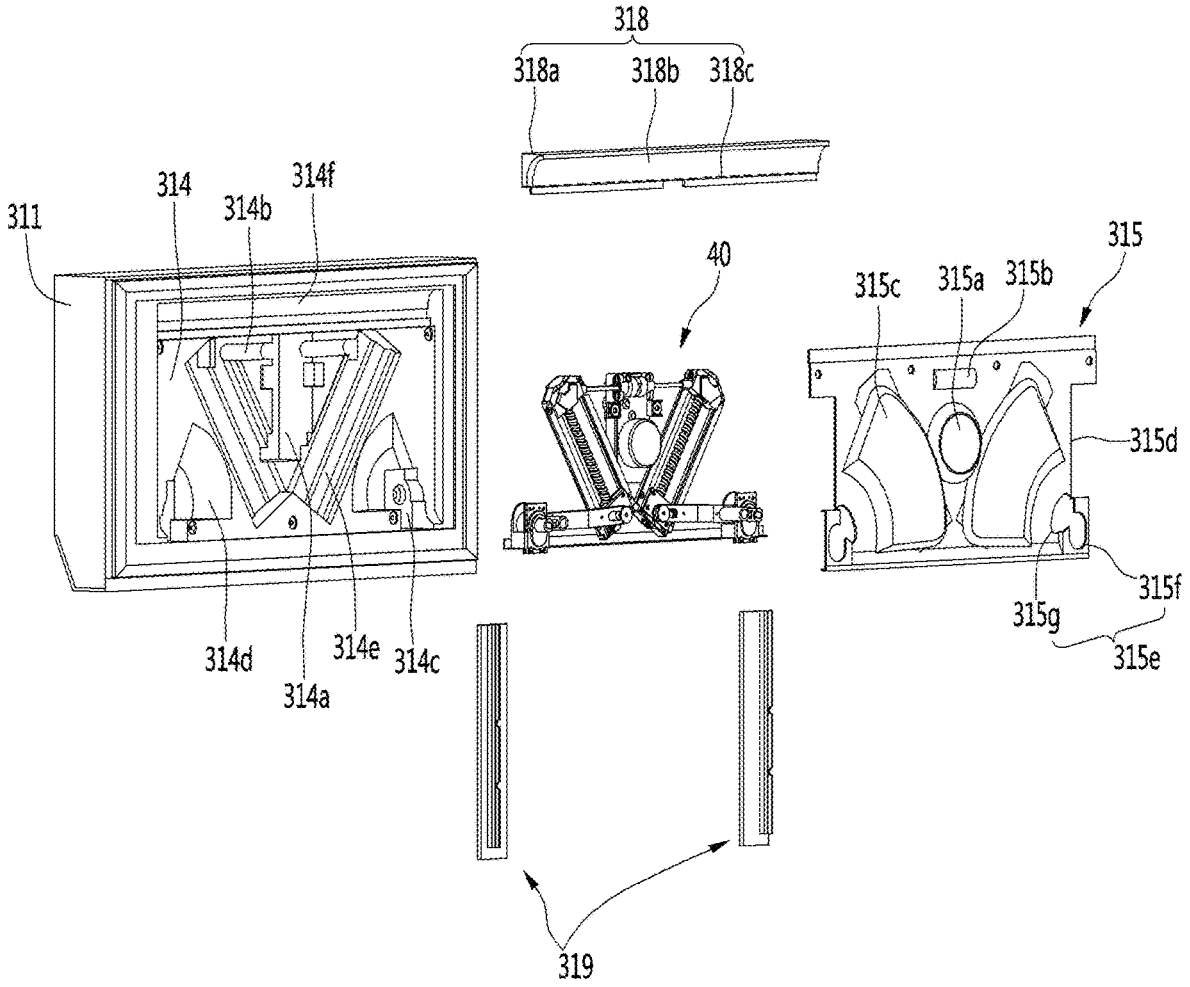
FIG. 7 is an exploded perspective view of the front panel door part.

FIG. 5 is a rear view of the front panel door part. Also, FIG. 6 is a rear view illustrating a state in which a door cover of the front panel door part is removed. Also, FIG. 7 is an exploded perspective view of the front panel door part.

A front surface of the front panel door part 31 may be defined by the outer plate 311, and a rear surface may be defined by the door liner 314. Also, a driving device 40 for operating the elevation device 80 may be provided inside the front panel door part 31. Although the driving device 40 may be disposed inside the front panel door part 31, the driving device 40 but is not embedded in the insulating material 300 but is disposed inside the space defined by the door liner 314. Then, the driving device 40 may be covered by the door cover 315 and thus may not be exposed to the outside.

In detail, the insulating material 300 may be filled between the outer plate 311 and the door liner 314 to insulate the inside of the storage space 12. Also, the door liner 314 may have a plurality of door recess parts that are recessed inward. The door recess parts may be defined in a shape corresponding to the shape of the elevation device 80 and may be recessed inside the door 30.

The door recess parts may include a motor recess part 314*a*, a shaft recess part 314*b*, a connector recess part 314*c*, a lever recess part 314*d*, and a screw recess part 314*c*. Thus, the door recess parts may have shapes respectively corresponding to the constituents of the elevation device 80 so that the entire elevation device 80 is inserted into the inner space of the door 30. Particularly, the lever recess part 314*d* may include a rotation region of the lever 42 so that the lever 42 smoothly rotates during the operation of the driving device 40.

Also, the door recess part may include a light recess part 314*f*. The light recess part 314*f* may be recessed in an upper end of the rear surface of the door 30. A door light 318 may be provided in the light recess part 314*f*, and the inside of the door 30 may be illuminated by the door light 318.

In detail, the door light 318 may be defined to be long in the lateral direction from the left side to the right side of the rear surface of the door 30 and may be disposed at the uppermost position of the inner side regions of a gaskets 317 disposed along the rear surface of the door 30.

The door light 318 may include a plurality of LEDs 138*c* and a light guide 318*a* for guiding light emitted from the LEDs 138*c* to the inside of the door 30, i.e., the inside of the drawer part 32.

A plurality of the LEDs 138*c* are disposed along the lower ends of the light guide 318*a* and may be arranged to face the upper surface of the door 30 so that light is irradiated to the inner surfaces of the light guide 318*a*.

The light guide 318*a* may have a shape corresponding to the light recess part 314*f* and may have a curved surface. The light irradiated from the lower LEDs 138*c* may be irradiated backward and downward to illuminate the inside of the drawer part 32. The curved surface may be coated or surface-treated to reflect light and may be called a reflection surface.

A light cover 318*b* spaced apart from the front of the light guide 318*a* may be disposed on the door light 318. The light cover 318*b* may also have a curved shape. Also, the light cover 318*b* may be made of a transparent material capable of transmitting light. Thus, the light reflected from the light guide 318*a* may be directed toward the inside of the drawer part 32. Also, the light guide 318*a* may guide an inflow of cool air to the inside of a space in which the driving device 40 is disposed to cool the driving device 40.

For this, the light cover 318*b* may be exposed to the rear surface of the door 30, and the lower surface of the curved surface of the light cover 318*b* may be separated from the door cover 315 to define a space through which the cool air flows. Also, the air that cools the driving device 40 may be discharged through a door opening 315*e* at a lower end of the door cover 315. Thus, the cooling device may circulates the cool air circulating on the rear surface of the front panel door part 31 to cool the driving device 40 and assist the cooling circulation in the area around the drawer part 32. Thus, the lower storage space 12 may be uniformly cooled.

The door cover 315 may be configured to define an outer appearance of the rear surface of the front panel door part 31 and may be configured to cover the driving device 40 mounted on the front panel door part 31. The door cover 315 may have a plate shape to cover the driving device 40 so that the door cover 315 is not exposed in the driving device 40 is mounted.

The door cover 315 may have the cover recess part at a corresponding position to cover the driving device 40 from the rear side. The cover recess part may be recessed from the front surface of the door cover 315, i.e., the driving device 40, and the rear surface of the door cover 315 may protrude toward the inside of the storage space. The cover recess part may include a motor recess part 315*a*, a shaft recess part 315*b*, and a lever recess part 315*c*. Particularly, the lever recess part 315*c* may include a rotation region of the lever 42 so that the lever 42 smoothly rotates during the operation of the driving device 40.

An upper end of the door cover 315 may be spaced apart from an upper end of the rear surface of the front panel door part 31, and thus, the door light 318 may be exposed. Thus, a space for irradiating light to the inside of the drawer part 32 may be secured, and a space for supplying the cold air to the driving unit 40 may be provided.

Also, a side cutout part 315*d* may be defined in the left and right ends of the door cover 315. The side cutout part 315*d* may be a portion that exposes the supporter 319 to be coupled with the door frame 316 and may be defined inward in a shape corresponding to the supporter 319.

Also, a door opening 315*e* may be defined in each of lower left and right sides of the door cover 315. The door opening 315*e* may be defined so that a portion of the connection assembly 70 passes through the door opening 315*e* to protrude from the rear surface of the front panel door part 31. Also, the door opening 315*e* may have a corresponding shape at a position facing the drawer opening 35. Thus, a portion of the connection assembly 70 exposed through the door opening 315*e* when the front panel door part 31 and the drawer part 32 are coupled may be coupled to the elevation device 80 to transmit the power.

The supporter 319 may be made of a metal material and fixedly mounted on the rear surface of the front panel door part 31. Also, the supporter 319 may be exposed to both sides of the rear surface of the front panel door part 31 and may be firmly coupled to the door coupling part 316*a* of the door frame 316 to maintain the state in which the front panel door part 31 is fixed and mounted on the drawer part 32.

The door opening 315*e* may include a through-part 315*g* and a guide part 315*f*, and the through-part 315*g* may be opened to allow the connection assembly 70 to be manipulated. The guide part 315*f* may be opened along an operation path of the connection assembly 70 operating when the driving device 40 operates. Also, the door opening 315*e* may be defined in a position facing the drawer opening 35 and may have the same shape as that of the drawer opening 35.

In detail, the through-part 315*g* may be defined in a shape corresponding to the push part 741 of at least the connection assembly 70. Thus, the user may manipulate the push part 741 exposed through the through-portion 315*g* to selectively separate the connection assembly 70 and the elevation device 80 from each other.

Also, the guide part 315*f* may be opened to correspond to the rotation path of the connection member 73 rotating together with the rotation of the lever 42 rotated when the driving device 40 is driven. Thus, when the lever 42 and the connection member 73 rotate, the lever 42 and the connection member 73 may rotate without interfering with the door cover 315.

The door opening 315*e* may pass through the rear portion of the front panel door part 31 to expose the connection assembly 70. However, when the door opening 315*e* is engaged with the drawer part 32, the exposed portion may be covered.

However, the door opening 315*e* may be defined in a position farther forward than the cover recess part. Thus, when the push part 741 and the drawer part 32 are coupled to each other, the push part 741 and the front surface of the drawer part 32 may be slightly spaced apart from each other. Thus, the user may manipulate the push part 741 by inserting the hand into the space between the front panel door part 31 and the drawer part 32 in a state in which the front panel door part 31 and the drawer part 32 are coupled to each other.

The door gasket 317 may be provided along the rear surface of the front panel door part 31. When the door 30 is closed, the door gasket 317 may airtightly contact the front surface of the cabinet 10 in the state in which the door 30 is closed.

The driving part 40 may be disposed inside the front panel door part 31 by being covered by the door cover 315. The driving device 40 may transmit the power to the elevation device 80 by the connection assembly 70 and also transmit the power to both sides of the elevation device 80 through the connection assemblies 70 disposed on both sides at the same time. Thus, the elevation device 80 may ascend and descend in the horizontal state at both left and right sides without being tilted or biased to one side under any situation.

Hereinafter, the constituents of the driving device 40 will now be described in more detail with reference to the accompanying drawings.

Figure 8:
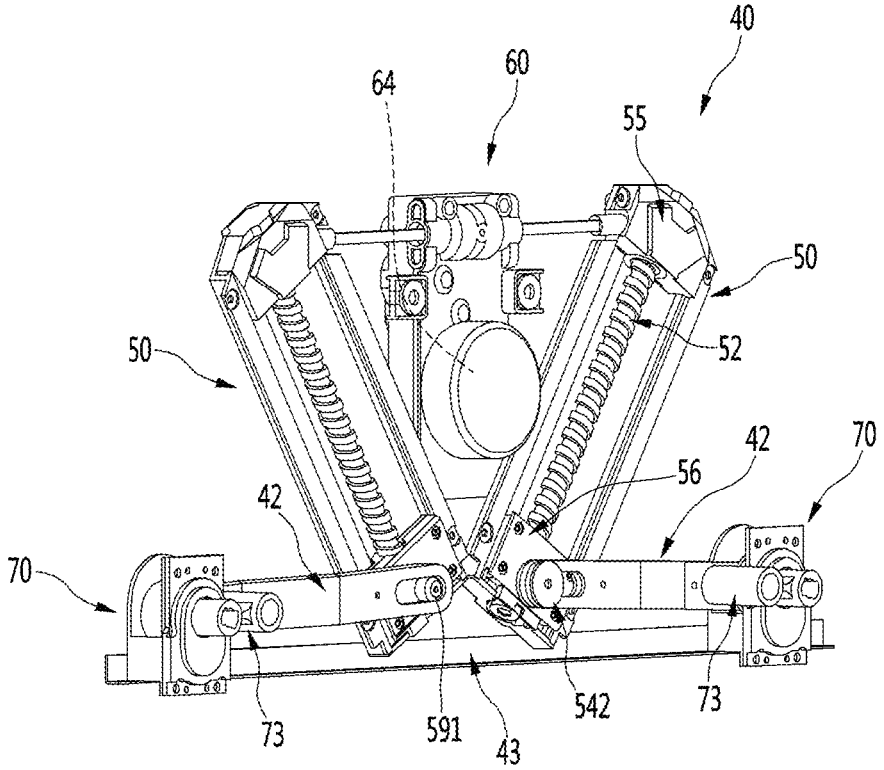
FIG. 8 is a perspective view of a door device according to a first embodiment.
Figure 9:
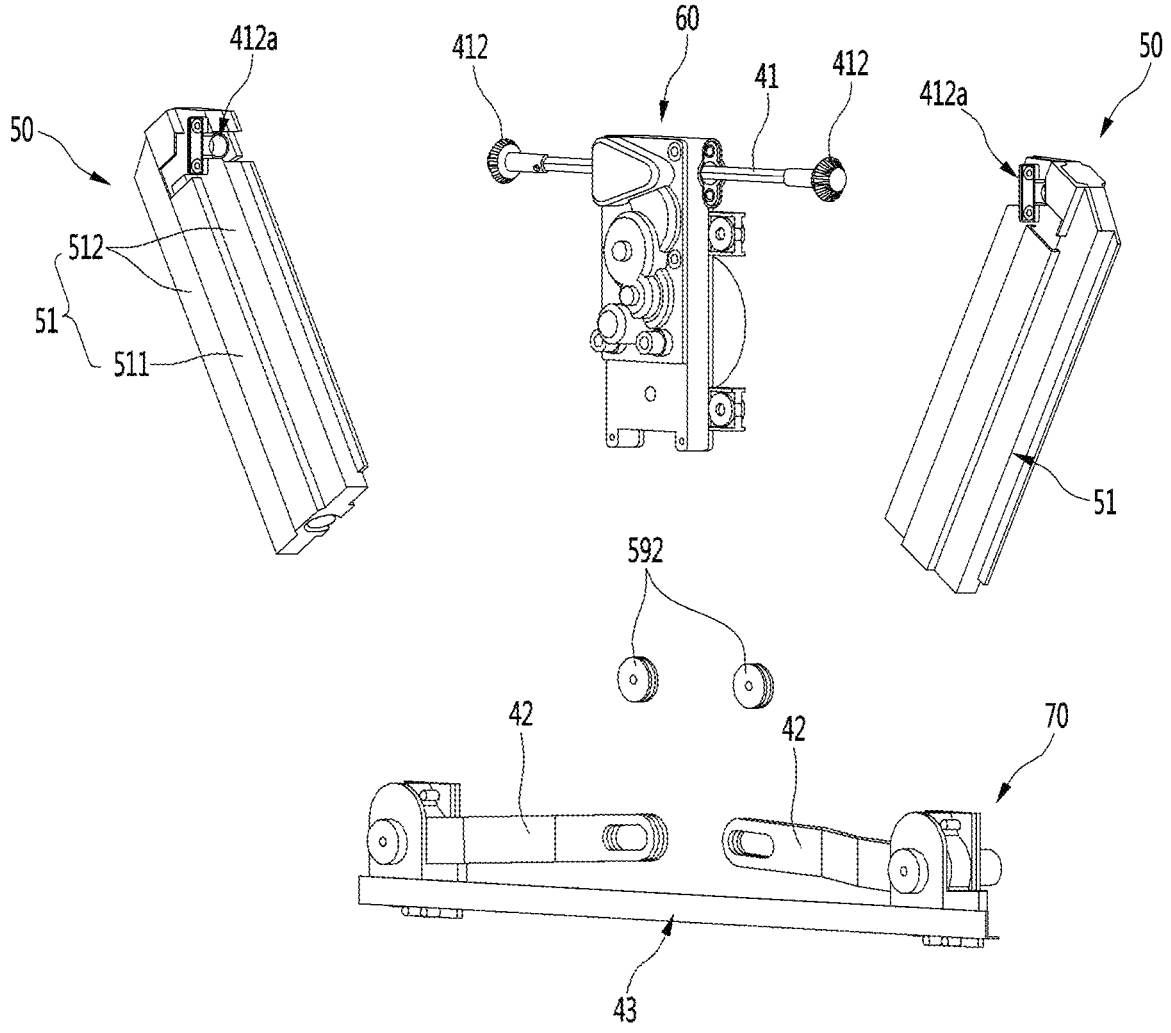
FIG. 9 is an exploded perspective view of the driving device.

FIG. 8 is a perspective view of a door device according to a first embodiment. Also, FIG. 9 is an exploded perspective view of the driving device.

As illustrated in the drawings, the driving device 40 may include a motor assembly 60, a screw assembly 50 disposed on each of both sides of the motor assembly 60 and connected by a shaft 41, a lever 42 connected to the screw assembly 50, and the connection assembly 70.

In detail, the motor assembly 60 may be disposed at a center of both left and right sides of the front panel door part 31 and provide power for elevating the elevation device 80. Also, the driving device 40 may allow both the screw assemblies 50 and the lever 42 to operate by the motor assembly including one driving motor 64.

Particularly, the motor assembly 60 may adjust magnitude of the decelerated and transmitted force through a combination of the plurality of gears. Also, a shaft 41 passing through the motor assembly 60 from the left to the right, i.e., in a horizontal direction may be disposed on an upper end of the motor assembly 60, and the plurality of gears may be combined in the motor assembly 60 for rotation of the shaft 41.

Also, the motor assembly 60 may have a structure in which the driving motor 64 and the gears are arranged vertically to minimize a space recessed when the motor assembly 60 is mounted on the front panel door part 31, in particular, a width in the left and right direction is widened, and a thickness in the front and rear direction is minimized. Also, the driving motor 64 constituting the motor assembly 60 may protrude toward the drawer part 32 to minimize a depth of the front panel door part 31 to secure insulation performance.

The shaft 41 may pass through the motor assembly 60 in the transverse direction and be coupled to the screw assembly 50 disposed at both sides of the motor assembly 60 so that the power of the motor assembly 60 is simultaneously to the screw assembly (50). Thus, the shaft 41 may be called a power transmission member.

For this, the shaft 41 may have a length such that both ends of the shaft 41 pass through the motor assembly 60 and are inserted into the screw assembly 50. Also, a shaft driving gear 411 may be provided at a center of the shaft 41. The shaft driving gear 411 may be coupled to the gears in the motor assembly 60 to rotate. Also, a shaft gear 412 may be disposed on each of both ends of the shaft 41. The shaft gear 412 may have a structure that is coupled to the screw assembly 50. The shaft gears 412 may have the same structure so that the same rotation force is applied to the shaft gears 412. The screw assembly 50 may be transferred to the screw assembly 50 so that the screw assembly 50 operates simultaneously.

The screw assemblies 50 may be disposed on both sides of the motor assembly 60. The upper end of the screw assembly 50 may be connected to the shaft 41. The shaft gear 412 is gear-coupled to transmit the power so that the screw 52 rotates, and a screw holder 56 moves along the screw 52. Also, the lever 42 may be coupled to the screw holder 56 to allow the lever 42 to rotate according to the movement of the screw holder 56.

For this, the upper end of the screw assembly 50 may be oriented outward, and the lower end of the screw assembly 50 may be inclined inward. Here, the screw assemblies 50 on both sides may be symmetrical to each other with respect to the motor assembly 60. Thus, the motor assembly 60 may be disposed between the screw assemblies 50 located on both sides of the screw assembly 50. The screw assembly 50 disposed on both sides of the motor assembly 60 may be provided so that a distance between the screw assemblies 50 gradually increases from the upper end to the lower end.

The screws 52 provided in the screw assembly 50 may be arranged in the same direction as the screw assembly 50, and extension lines of the screws 52 on both the left and right sides may cross each other. Also, the screw holder 56 may move along the screw 52 according to the rotation of the screw 52, and the lever 42 connected to the screw holder 56 may rotate along the connection assembly 70. The screw assembly 50, the lever 42, and the connection assembly 70 may be symmetrical to each other so that the lever 42 simultaneously rotates at the same angle as the screw assembly 50 is driven.

The lever 42 may connect the screw holder 56 to the connection assembly 70. Thus, both ends of the lever 42 may be rotatably coupled to the screw holder 56 and the connection assembly 70, respectively. Thus, when the screw holder 56 linearly moves, the lever 42 may be rotatable about the connection assembly 70.

The connection assemblies 70 disposed on both the left and right sides may be connected to each other by a connector bracket 43, and the connection assembly 70 may be firmly supported on the front panel door part 31 to effectively transmit the rotation force to the elevation device 80.

Hereinafter, each constituent provided in the driving device 40 having the above-described structure will be described in more detail with reference to the drawings.

Figure 10:
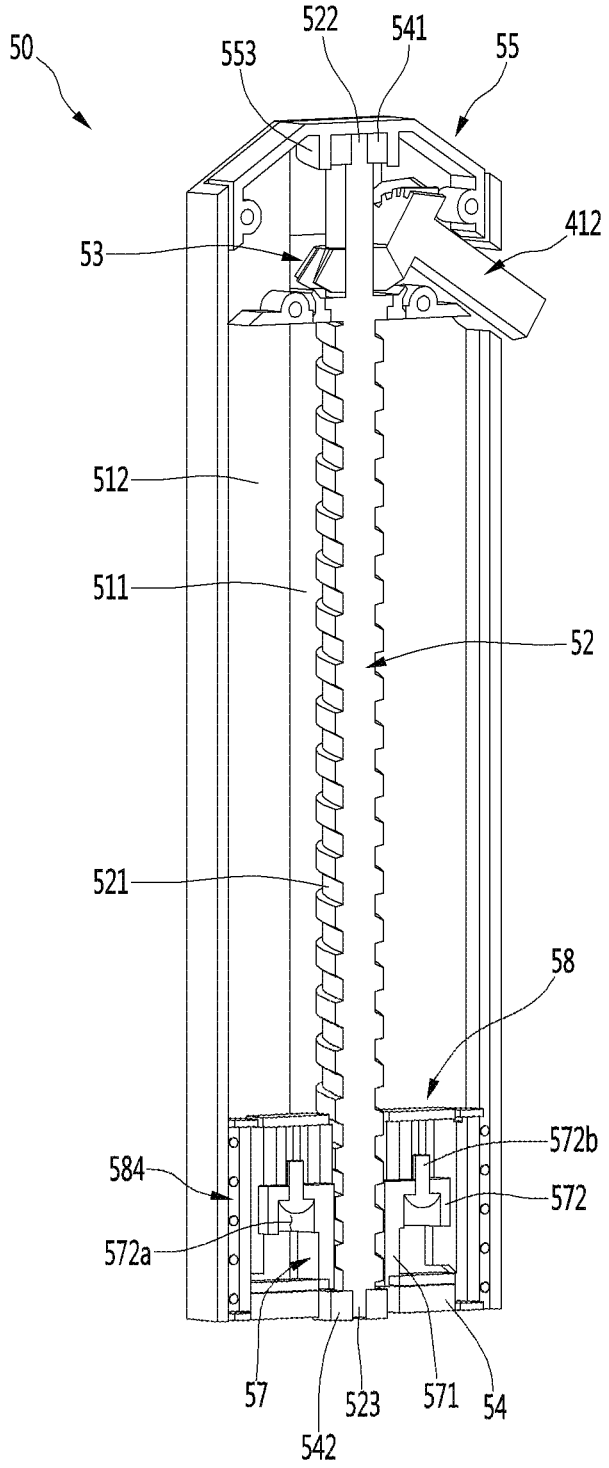
FIG. 10 is a cross-sectional view of the screw assembly that is one component of the driving device.
Figure 11:
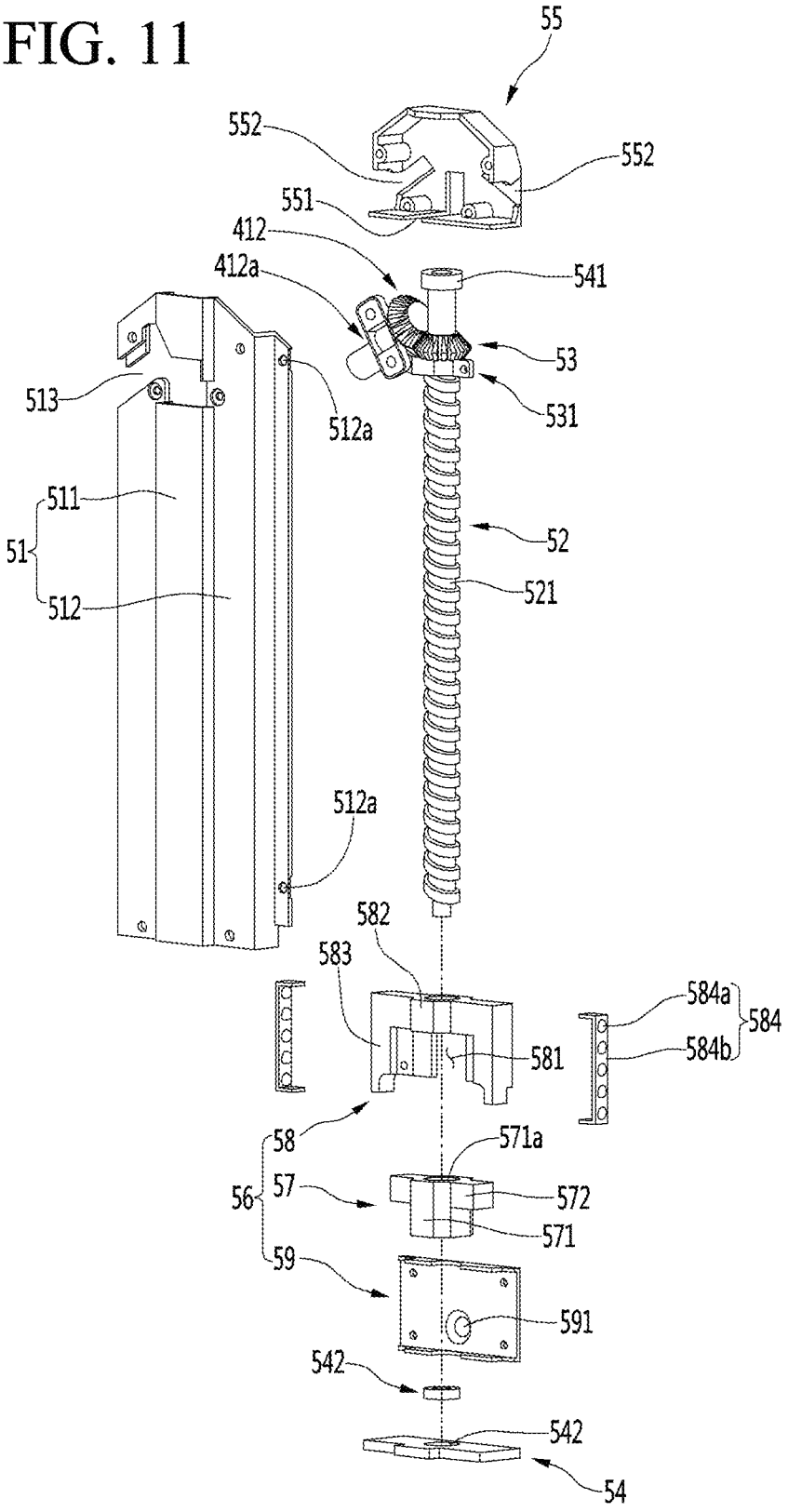
FIG. 11 is an exploded perspective view of the screw assembly.

FIG. 10 is a cross-sectional view of the screw assembly that is one component of the driving device. Also, FIG. 11 is an exploded perspective view of the screw assembly.

The screw assembly 50 may be disposed on each of both left and right sides of the inside of the front panel door part 31. Since the structure and the shape of the screw assembly 50 are different from each other only in the mounted position, only the screw assembly 50 will now be described.

As illustrated in the drawings, the screw assembly 50 may include a housing 51, a housing cover 55 for covering an opened upper surface of the housing 51, a screw 52 provided inside the housing 51, and a screw holder 56 which moves along the screw holder 56.

The housing 51 may define an outer appearance of the screw assembly 50 and provide a space in which a screw 52 and a screw holder 56 are accommodated. The opened upper surface of the housing cover 55 may be covered by the housing cover 55.

The housing 51 may be made of by bending a plate-shaped metal material, or may be made of a plastic material. The housing 51 may include the central portion 511 and the side part 512. Also, a central portion 511 may be disposed at a position corresponding to the screw 52, and at least a portion of the screw 52 may be accommodated in the central portion 511. The central portion 51 may have a space in which the screw holder 56 coupled to the screw 52 moves vertically.

The side part 512 may extend to be stepped at both sides of the central portion 511 and also extend from both side ends to both sides of the central portion 511 and be vertically bent to define both the side surfaces of the housing 51 and then be bent again inward from an end of both the side surfaces of the housing 51.

Thus, a space in which the screw 52 and the screw holder 56 are accommodated may be defined in the housing 51 by the side part 512. Also, both side ends of the side part 512 may be bent outward, and a hole 512*a* into which the coupling member is coupled may be defined in a state of being seated in the door recess part so that the housing 51 is fixed and mounted on the door liner 314.

The shape of the screw recess part 314*e* disposed in the door liner 314 may have a stepped structure like the shape of the outer surface of the housing 51. Thus, the door recess part and the outer surface of the housing 51 may be mutually coupled to each other so that the screw assembly 50 is firmly fixed without moving or being separated during the operation.

A housing cutout part 513 may be disposed on the upper portion of the housing 51. The housing cutout part 513 may be defined in a position corresponding to the position of the shaft gear 412 and the screw gear 53 disposed inside the housing 51. The housing cutout part 513 may be defined by cutting the shaft gear 412. That is, the housing cutout part 513 may be cut so that the shaft gear 412 and the screw gear 53 do not interfere with each other when the shaft gear 412 and the screw gear 53 are coupled to each other.

The screw 52 may be accommodated in the housing 51 and disposed at the central portion 511. Also, the screw 52 may be disposed on an outer circumferential surface of the screw 52. Thus, the screw holder 56 may move vertically along the screw 52 when the screw 52 rotates.

A lower spacer 542 on which the screw 52 is rotatably supported may be disposed at a lower end the screw 52. A lower protrusion 523 protruding downward may be inserted into the screw 52. The lower spacer may have the same structure as the bearing. Thus, the screw 52 may rotate in the state of being supported on the lower spacer 542.

The lower spacer 542 may be fixed and mounted on the lower cap 54. The lower cap 54 may be mounted to cover the opened bottom surface of the housing 51 and define the bottom surface of the screw assembly 50.

The screw 52 may extend up to the upper end of the housing 51, and the screw gear 53 and an upper spacer 541 may be mounted on the screw 52.

The screw gear 53 may be disposed on an upper end of the screw thread 521 and be integrally coupled to the screw 52 to rotate together with the screw 52. Also, the screw gear 53 may be gear-coupled to the shaft 41 in the state of crossing the gear 412 mounted on the shaft 41. Thus, the screw gear 53 and the shaft gear 412 may have the same shape as a bevel gear and provide a structure capable of transmitting the power in a crossing state.

An upper protrusion 522 extending upward may be disposed on the upper end of the screw 52. Also, the upper spacer 541 may be mounted to pass through the upper protrusion 522. Also, the upper spacer 541 may be fixed to the inside of the housing cover 55 to rotatably support the upper end of the screw 52.

As described above, the upper and lower ends of the screw 52 may be rotatably supported by the upper spacer 541 and the lower spacer 542. Also, the screw 52 may rotate by the power transmitted to the screw gear 53 by the shaft gear 412, and the screw holder 56 may be elevated by the power.

The screw holder 56 may include an elevation block 57, a holder body 58, and a holder cover 59.

The elevation block 57 may include a block body 571 having a block through-hole 571*a* through which the screw 52 passes and a body coupling part 572 extending from the block body 571 in both lateral directions. The block body 571 may have a cylindrical shape, and the block through-hole 567*a* may vertically pass through a center of the block body 571. A screw corresponding to the screw thread 521 may be disposed on an inner circumferential surface of the block through-hole 571*a*. Thus, when the screw 52 rotates, the screw 52 may move along the screw thread 521 to allow the elevation block 57 to vertically move.

Also, a coupling hole 572*a* may be defined in the body coupling part 572. The coupling hole 572*a* is defined in each of both sides of the block through-hole 571*a*, and the screw may be coupled to allow the elevation block 57 to be coupled to the holder body 58 so that the elevation block 57 move together with the holder body 58.

The holder body 58 may be coupled to the elevation block 57 so as to be elevated together inside the housing 51. The holder cover 59 may be coupled to one surface of the housing 51 exposed to the outside of the housing 51.

The holder body 58 may be hollow to provide a space. In particular, a block accommodation part 581 into the elevation block 57 is accommodated may be provided in a lower portion of the holder body 58. The block accommodation part 581 may be opened backward and downward to communicate with the hollow. Thus, the elevation block 57 may be inserted and mounted from a lower side to an upper side of the holder body 58 and be disposed inside the block accommodation part 581.

A through-part 582 penetrated in the vertical direction may be defined above the block accommodation part 581. The screw 52 may pass through the through-part 582 and may not contact a screw thread 521 of the screw 52.

A holder coupling part 583 to which the coupling member 572*b* is coupled to couple the elevation block 57 to the holder body 58 may be disposed on each of both sides of an outer surface of the through-part 582. The holder coupling part 583 may be disposed at a position corresponding to the body coupling part 572 and be integrally coupled to the coupling member 572 such as a screw at a position corresponding to each other when the elevation block 57 and the holder body 58 are coupled to each other.

A side surface part of the holder body 58 may extend to both sides of the housing 51. Also, a bearing unit 584 may be provided between each of both side surfaces of the holder body 58 and the inner surface of the housing 51. The bearing unit 584 may include a bearing 584*a*, which are vertically provided in plurality, and a retainer 584*b* to which the bearing 584*a* is rotatably mounted.

Thus, the plurality of bearings 584*a* may be mounted rotatably by the retainer 584*b* and contact the side surface part of the holder body 58 and the inner surface of the housing 51 so as to be rolled. Of course, the bearing unit 584 is not limited to the above-described structure, and another structure capable of being rolled between the holder body 58 and the housing 51 may be also possible.

The bearing unit 584 may be provided on each of both sides of the holder body 58. Thus, the holder body 58 may smoothly ascend inside the housing 51. Particularly, since the bearing units 584 on both sides are maintained in contact with the inner surface of the housing 51 during the elevation processes, the holder body 58 may be stably and smoothly elevated without moving. Also, the inner surface of the side part 512 contacting the bearing 584*a* and both side surfaces of the holder body 58 may be recessed at positions corresponding to the bearing unit 584 to realize more stable rolling of the bearing 584*a*.

Although not shown, the screw assembly 50 may be provided with a shaft (not shown) for guiding the screws 52 on each of both sides of the screw 52 without the bearing unit 584, and the screw holder 56 may move along the screw 52 without moving of the screw holder 56 through a structure in which the shaft extends from an upper end to a lower end of the housing 51 to pass through both sides of the screw holder 56.

The holder cover 59 may be coupled to one surface of the holder body 58. The holder cover 59 may be coupled to the rear surface of the holder body 58 and be exposed to the outside through the opening of the housing 51. Also, a holder protrusion 591 may protrude backward from the holder cover 59. The holder protrusion 591 may pass through one end of the lever 42 and may have a circular cross-section so that the lever 42 rotate while passing through the lever 42.

Also, a protrusion restriction member 592 may be coupled to the end of the holder protrusion 591 passing through the lever. The protrusion restriction member 592 may be larger than the opening of the lever 42 through which the holder protrusion 591 passes. Also, the holder protrusion 591 may be inserted to pass through the lever 42, and then, the protrusion restriction member 592 may be coupled to the end of the holder protrusion 591 by using a separate coupling member.

In this embodiment, the screw holder 56 may have a structure in which the elevation block 57, the holder body 58, and the holder cover 59 are molded and coupled to each other. Here, the holder body 58 to which a load is directly applied may be made of a metal material. The elevation block 57 having a relatively complicated internal structure and the holder cover 59 to which the load is not applied may be formed by injection molding a plastic material.

That is, since the elevation block 57 has to have a screw to move along the screw 52, the structure may be complicated, and also, it may be difficult to mold the elevation block 567 having abrasion resistance and lubrication performance through engineering plastic injection molding. Also, the elevation block 57 to which a load is applied substantially when the elevation device 80 moves may have to have high strength. Thus, the holder body 58 may have a structure that is capable of being molded by using a metal material through the extrusion. Also, the holder cover 59, which is coupled to the lever 42 to generate friction during rotation of the lever 42, may also be injection-molded using a plastic material. As described above, the elevation block 57, the holder body 58, and the holder cover 59, which are made of different materials, may be coupled to each other and may be integrally elevated inside the housing 51 to match the respective structure and environment.

Of course, the screw holder 56 may have a single structure, and a portion of the elevation block 57, the holder body 58, and the holder cover 59 may be integrally formed with each other.

A housing cover 55 may be disposed on the upper end of the housing 51. The housing cover 55 may have a structure that covers the top surface of the housing 51 and covers the screw gear 53 and the shaft gear 412 in the housing 51.

A bottom opening 551 through which the screw 52 passes may be defined in a bottom surface of the housing cover 55. The upper portion of the screw 52 may be inserted into the housing cover 55 through the bottom opening 551, and at least the screw gear 53 may be disposed inside the housing cover 55. Also, the screw 52 may be fixed to the housing 51 and the housing cover 55 by the screw fixing member 531, and the screw gear 53 may be fixed to always maintain the correct position.

Also, an upper spacer mounting part 553 may be disposed on an inner top surface of the housing cover 55 to have a corresponding shape so that the upper spacer 541 is mounted. Thus, the housing cover 55 may be capable of rotatably supporting the upper end of the screw 52.

Also, a side opening 552 through which the shaft 41 is inserted may be defined in a side surface of the housing cover 55. The side opening 552 may be opened so that the shaft gear 412 is disposed inside the housing cover 55. Also, the shaft 41 may be fixed to the inside of the housing cover 55 by the shaft fixing member 612, and the shaft gear 412 may be maintained in the state of being coupled to the screw gear 53 while being maintained at the correct position.

Thus, the end of the shaft 41 and the screw 52 may be covered, and the shaft gear 412 and the shaft gear 412 may be covered when the housing cover 55 is mounted. Also, each of the shaft gear 412 and the screw gear 53 may be always disposed in a proper position to secure the power transmission through the shaft 41.

Figure 12:
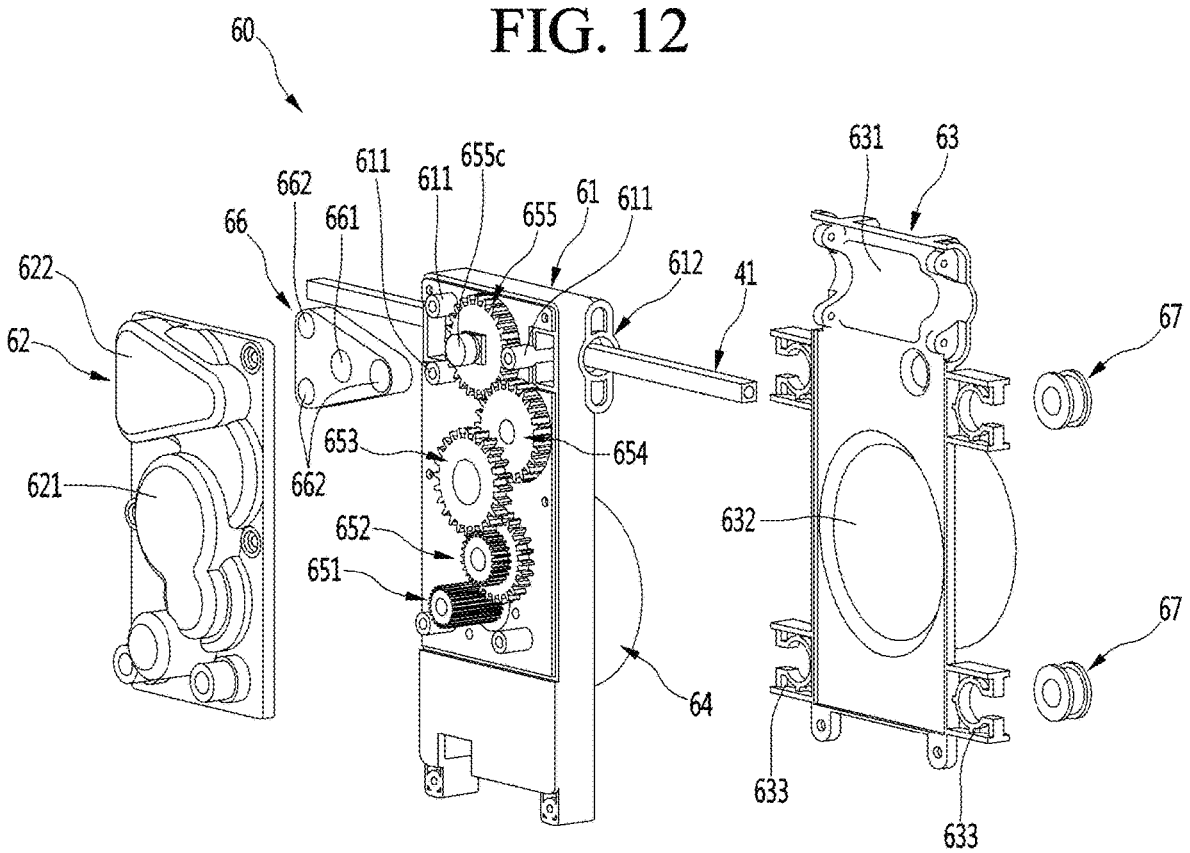
FIG. 12 is an exploded perspective view of the motor assembly that is one component of the driving part.
Figure 13:
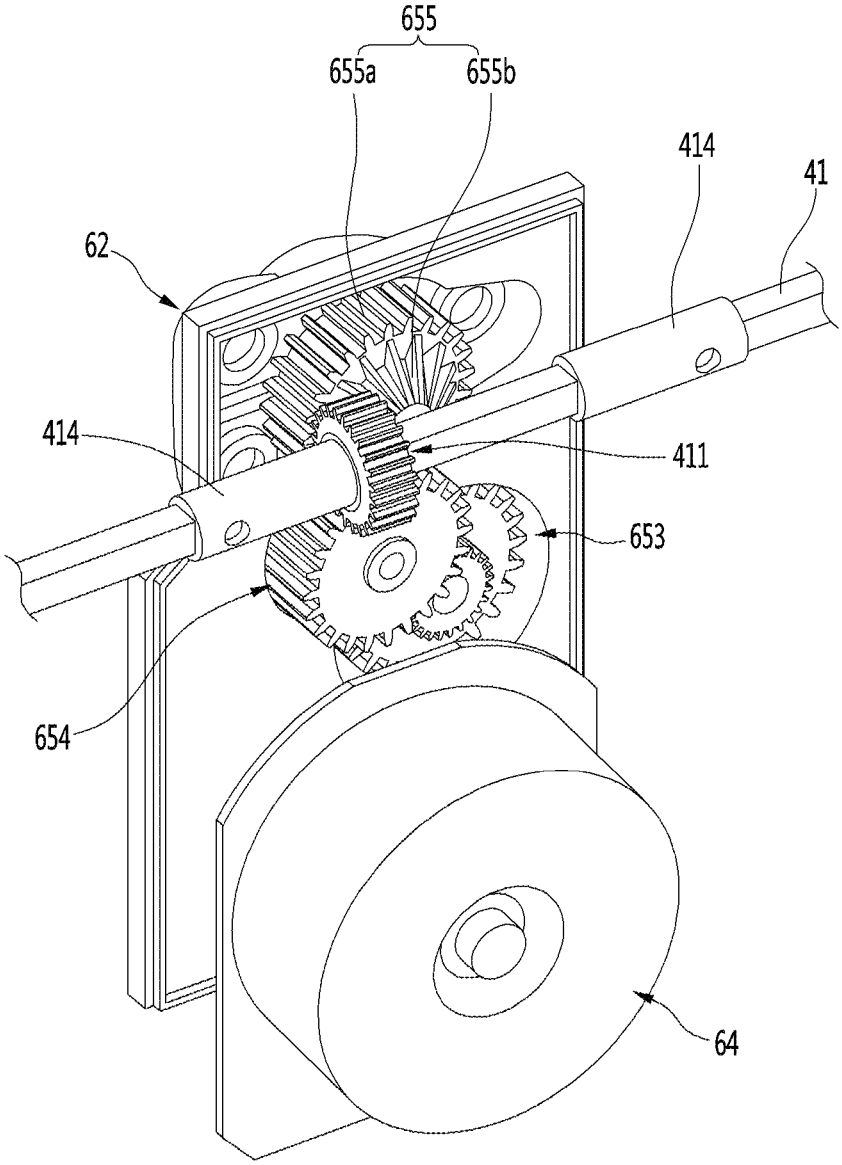
FIG. 13 is a view illustrating a coupling structure of the motor assembly and a driving shaft.

FIG. 12 is an exploded perspective view of the motor assembly that is one component of the driving part. Also, FIG. 13 is a view illustrating a coupling structure of the motor assembly and the driving shaft.

As illustrated in the drawings, the motor assembly 60 may include a plurality of gears, a motor case 61, and motor covers 62 and 63.

In detail, the driving motor 64 may provide power for elevating the elevation device 80 and may rotate forwardly and reversely. Thus, when an elevation signal of the elevation device 80 is inputted, the elevation device 80 may rotate forwardly and reversely to provide the power for elevating the elevating device 51. Also, an input of a stop signal due to the load of the driving motor or the detection of the sensor may be stopped.

The driving motor 64 may be fixed and mounted on a lower portion of the motor case 61, and the rotation shaft of the driving motor 64 may pass through the motor case 61 to protrude to an opposite side. Also, the rotation shaft of the driving motor 64 may be provided with a first gear 651 to rotate when the driving motor 64 is driven.

The driving motor 64 and the shaft 41 may be disposed on one side of the motor case 61. A plurality of gears 651, 652, 653, 654, and 655 may be disposed on the opposite side of the motor case 61. A second gear 652 engaged with the first gear 651 for transmitting and decelerating the power of the driving motor 64, a third gear 653 engaged with the second gear 652, a fourth gear engaged with third gear 653, and a fifth gear 655 engaged with the fourth gear 654 may be disposed on one surface of the motor case 61. Of course, the plurality of gears 651, 652, 653, 654, and 655 may be variously combined according to the reduction ratio and the magnitude of the transmitted force. The plurality of gears 651, 652, 653, 654, and 655 may include at least a first gear coupled to the rotation shaft of the driving motor 64 and a fifth gear coupled to the shaft 41.

The fifth gear 655 may include a power transmission part 655*a* and a power conversion part 655*b*. The power transmission part 655*a* is configured so as to be engaged with the fourth gear 654 in the form of a spur gear. Also, the power conversion part 655*b* may be configured to be gear-coupled to the shaft driving gear 411 mounted on the shaft 41.

The shaft 41 may pass through the motor assembly 60 in a lateral direction and may extend in a direction perpendicular to the rotation axis of the driving motor 64 and the rotation axis of the fifth gear 655. Also, the shaft driving gear 411 is disposed inside the motor assembly 60 and may be gear-coupled perpendicularly to the power conversion part 655*b*. Thus, the power conversion part 655*b* may have the same shape as a bevel gear so that power transmission to the shaft 41 is performed. The power conversion part 655*b* and the shaft driving gear 411 may have other gear structures capable of transmitting the power.

The motor case 61 may be provided with shaft fixing members 612 through which the shaft 41 passes. The shaft 41 passing through the shaft fixing member 612 may be provided with a shaft sleeve 414. The shaft sleeve 414 may pass through the shaft fixing member 612, and the shaft fixing member 612 may support the shaft sleeve 414. Thus, the power conversion part 655*b* and the shaft driving gear 411 may operate stably while being maintained in the engaged state therebetween without the movement of the shaft 41.

A rotation shaft 655*c* may protrude from the rotation center of the fifth gear 655. A plurality of guide protrusions 611 may protrude from the motor case 61 adjacent to the fifth gear 655. Also, a gear restriction member 66 into which the rotation shaft 655*c* and the guide protrusion 611 are inserted may be provided. The gear restriction member 66 may allow the fifth gear 655 to be maintained in the restricted state and include a rotation shaft hole 661 through which the rotation shaft 655*c* passes. A guide hole 662 may be defined in a position corresponding to the guide protrusion 611. Thus, in the state in which the gear restriction member 66 is mounted, separation and movement of the fifth gear 655 may be completely prevented to maintain the engaged and rotating state of the fifth gear 655 and the shaft gear 412, thereby securing the power transmission to the shaft 41.

The motor covers 62 and 63 may include a front cover 62 and a rear cover 63 that respectively cover the front and rear surfaces of the motor case 61. The front surface of the motor case 61 may face the door liner 314, and the rear surface of the motor case 61 may face the door cover 315.

The front cover 62 may be coupled to the front surface of the motor case 61 and may cover the plurality of gears 651, 652, 653, 654, and 655 mounted on the front surface of the motor case 61. The front cover 62 may be provided with a gear recess part 621. Thus, the plurality of gears 651, 652, 653, 654, and 655 may be accommodated inside the gear recess part 621, and the rotation axis may be fixed to realize the stable rotation. Also, the front cover 62 may further include a restriction member recess part 622 in which the gear restriction member 66 is accommodated.

The rear cover 63 may be coupled to a rear surface of the motor case 61 and be configured to cover the driving motor 64 and a portion of the shaft 41 mounted on the rear surface of the motor case 61.

Thus, a shaft accommodation part 631 for covering the shaft driving gear 411 and the power conversion part 655*b* of the fifth gear 655, which are coupled to each other, may be provided in the rear surface of the motor case 61. Also, a motor accommodation part 632 in which the driving motor 64 is accommodated may be provided. Also, the shaft fixing member 612 may be fixedly mounted on both left and right ends.

A plurality of fixing parts 633 may protrude from both sides of the rear cover 63. A plurality of vibration prevention members 67 may be press-fitted into the fixing part 633, and the coupling member passing through the vibration prevention member 67 may be coupled to the door liner 314 to fix and mount the motor assembly 60. The vibration prevention member 67 may be made of rubber or urethane to reduce vibration noise that is generated when the motor assembly 60 is driven.

Figure 14:
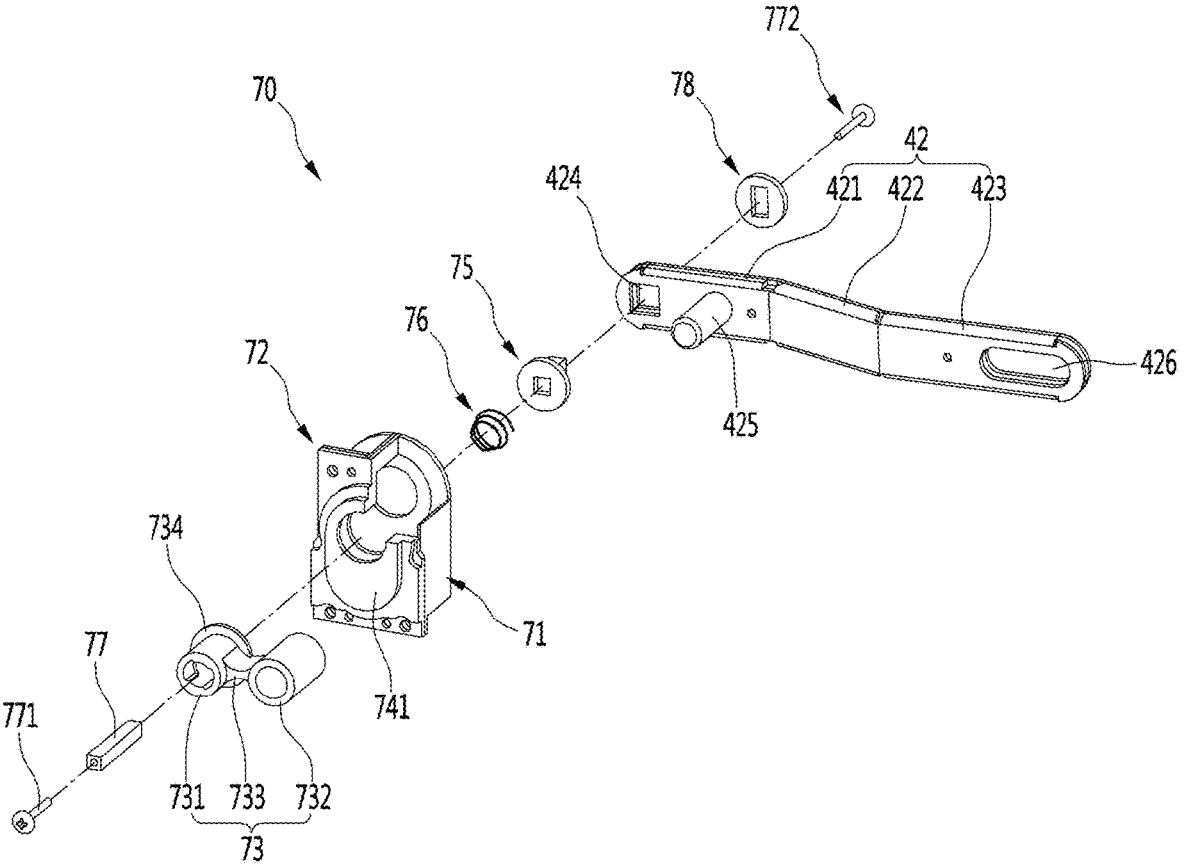
FIG. 14 is an exploded perspective illustrating a coupling structure of a connection assembly, which is one component of the driving device, and a lever.

FIG. 14 is an exploded perspective illustrating a coupling structure of a connection assembly, which is one component of the driving device, and a lever.

As illustrated in the drawing, the lever 42 may be configured to connect the screw assembly 50 to the connection assembly 70.

In details of the structure of the lever 42, the lever 42 may be provided in a rod or bar shape having a predetermined width and may extend from the rotation axis of the connection assembly 70 to the holder protrusion 591 of the screw assembly 50.

In detail, the lever 42 may include a first extension part 421 connected to the connection assembly, a second extension part 423 connected to the screw holder 56, and an intermediate portion 422 connecting the first extension part 421 to the second extension part 423.

The first extension part 421 and the second extension part 423 may be disposed parallel to each other, and the intermediate portion 422 may have an inclination. Also, the first extension part 421 may be further backward than the second extension part 423 by the inclination of the intermediate part 422.

The lever 42 may not be deformed or damaged even if a large amount of force is applied to the lever 42 due to the structure and shape of the bent lever 42. Also, the lever 42 may be made of a metal material to realize the stable power transmission even when the elevation device 80 on which a heavy food is seated is elevated.

Also, the inclination of the intermediate portion 422 may allow the lever 42 to be connected between the connection assembly 70 disposed relatively backward and the screw holder 56 disposed relatively forward.

A first lever hole 424 may be defined in the first extension part 421 to be connected to the lever fixing member 75 of the connection assembly 70. The first lever hole 424 may be formed in a polygonal shape corresponding to one side of the lever fixing member 75 and may be opened in a rectangular shape as illustrated in the drawing. The lever fixing member 75 may also rotate together when the lever 42 rotates.

Also, the lever protrusion 425 may be disposed on the first extension part 421. The lever protrusion 425 may be spaced apart from the first lever hole 424 and disposed toward the intermediate part 422. The lever protrusion 425 may be configured to be coupled to the connection member 73 of the connection assembly 70. That is, the rotation force of the lever 42 may be transmitted to the connection assembly 70 by the lever protrusion 425 together with the first lever hole 424. Furthermore, the rotation force may be transmitted to the elevation device 80 to elevate the elevation device 80.

Also, a second lever hole 426 through which the holder protrusion 591 of the screw holder 56 is inserted may be defined in the second extension part 423. The second lever hole 426 may have a size corresponding to the holder protrusion 591 and also may have a long hole shape in the extension direction of the second extension part 423 so that the holder protrusion 591 move as the screw holder 56 move vertically. Thus, the holder protrusion 591 may be disposed on the left end of the second lever hole 426 in a state in which the screw holder 56 is disposed at the lowest position, and as the screw holder 56 move upward, the protrusion 591 moves to the right side of the second lever hole 426 so that the lever 42 rotates.

The connection assembly 70 may be provided at one end of the lever 42, i.e., at a position corresponding to the first extension part 421. A connection member 73 for connecting the lever 42 to the elevation device 80 may be rotatably mounted on the inside of the connection assembly 70.

The connection member 73 may be coupled to the lever fixing member 75 by the fixing shaft 77 and thus may rotate together with the rotation of the lever 42. Also, the connection member 73 may be connected to the lever protrusion 425 and the scissors protrusion 841*b* to transmit greater force to the elevation device 80, and thus, the elevation device 80 may be more effectively lifted. Thus, the elevation device 80 in the state in which the food is seated sufficiently while using only one of the driving motors 64 may be elevated, and a compact configuration may be realized.

The connection assembly 70 may have an outer appearance defined by the connecting case 71 and the connecting cover 72, and the lever fixing member 75 and the connection member 73 may be mounted on the connecting case 71.

Hereinafter a structure of the connection assembly 70 will be described in more detail.

Figure 15:
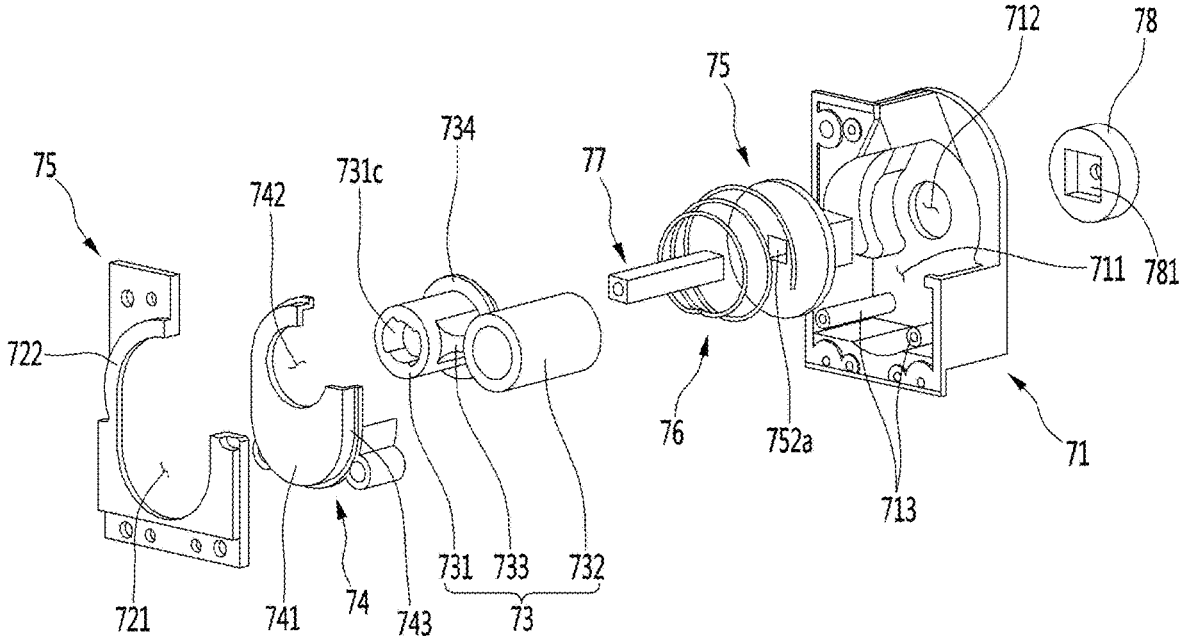
FIG. 15 is an exploded perspective view of the connection assembly when viewed in one direction.
Figure 16:
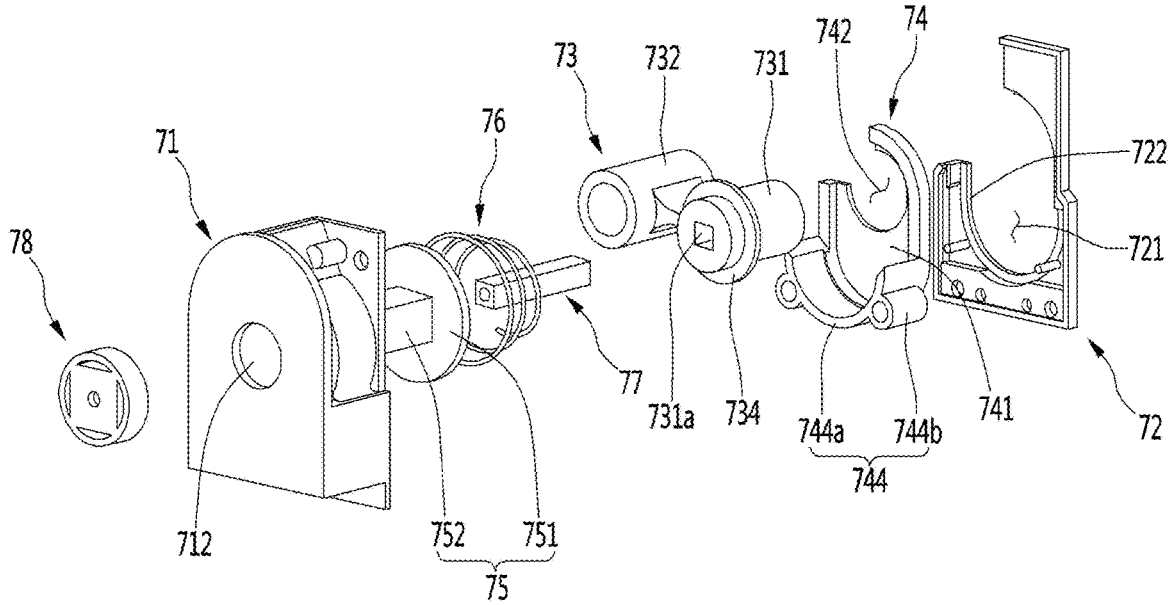
FIG. 16 is an exploded perspective view of the connection assembly when viewed in the other direction.
Figure 17:
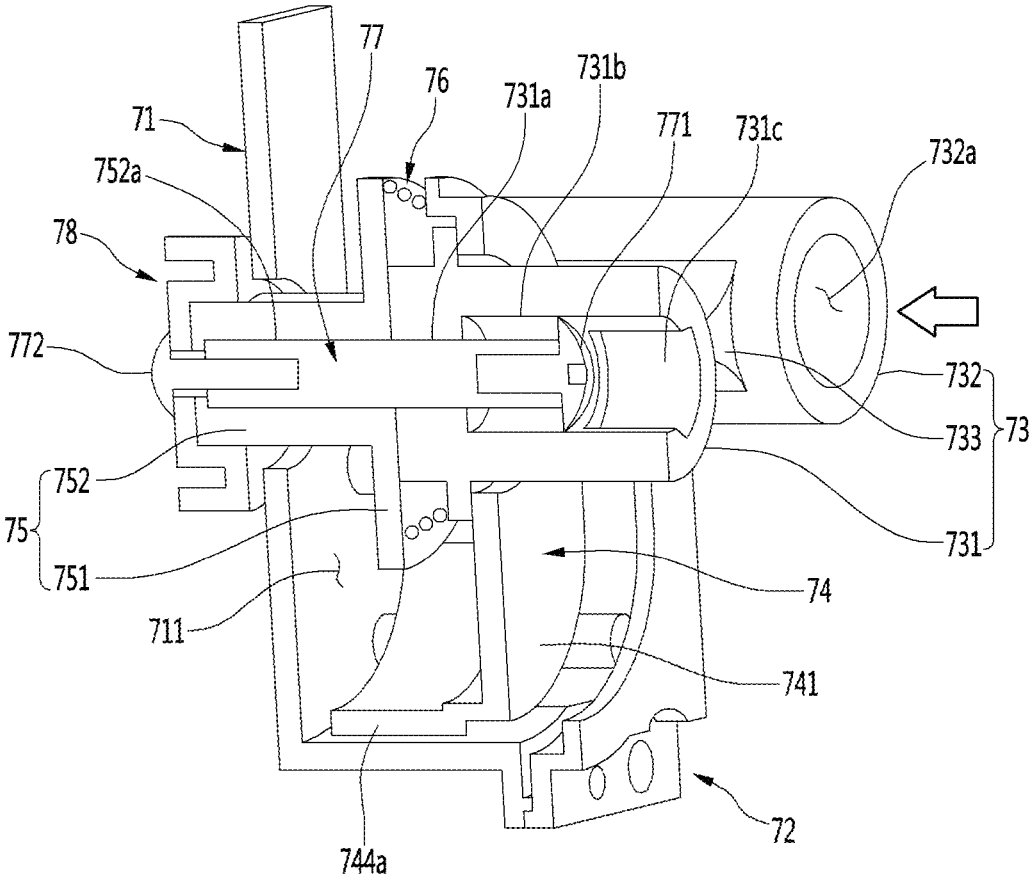
FIGS. 17 and 18 are views illustrating an operation state of the connection assembly.
Figure 18:
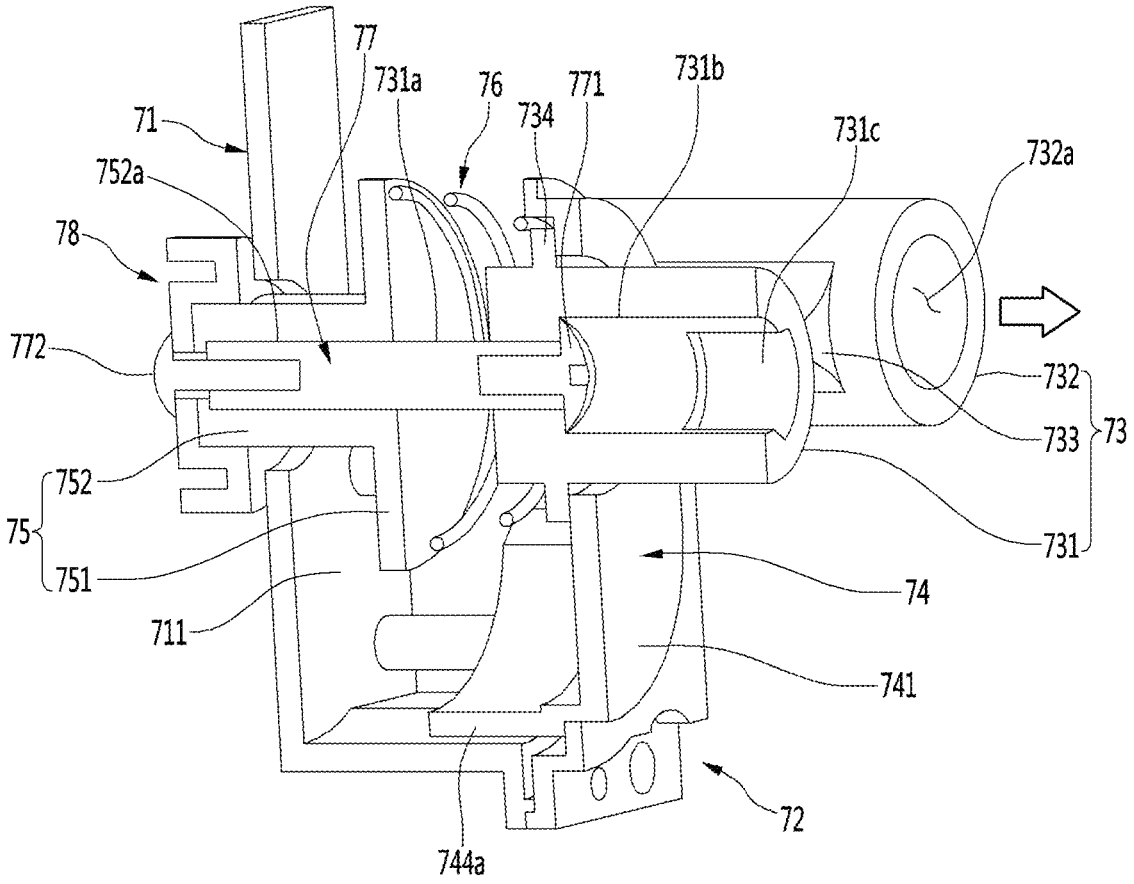

FIG. 15 is an exploded perspective view of the connection assembly when viewed in one direction. Also, FIG. 16 is an exploded perspective view of the connection assembly when viewed in the other direction. Also, FIGS. 17 and 18 are views illustrating an operation state of the connection assembly.

Referring to the drawings, the connection assembly 70 may include the connecting case 71, the connecting cover 72, and the connection member 73, the push member 74, the lever fixing member 75, and the clastic member 76.

In detail, the connecting case 71 may be opened on one side and includes a space 711 for accommodating the lever fixing member 75, the connection member 73, the push member 74, and a portion of the lever 42. Also, a through-hole 712 may be defined in the space 711. An external fixing member 78 may be provided on the outer surface of the connecting case 71 corresponding to the through-hole 712.

The lever fixing member 75 may include an elastic support part 751 and a through-protrusion 752. The elastic support part 751 may be accommodated in the space inside the connecting case 71 and define a surface capable of supporting one end of the elastic member 76. Also, the through-protrusion 752 may be disposed on a center of the clastic support part 751 and extend to sequentially pass through the first lever hole 424 and the through-hole 712 of the lever. The through-protrusion 752 may have a rectangular cross-sectional shape. The through-protrusion 752 may be inserted into a fixing groove defined in the external fixing member 78.

A shaft insertion part 752*a* into which the fixing shaft 77 is inserted may be provided inside the through-protrusion 752. The fixing shaft 77 and the shaft insertion part 752*a* may have corresponding shapes and may have a rectangular cross-section like the through-protrusions 752. Thus, slippage may not occur during the rotation of the lever 42, stable rotation force may be transmitted to the lever fixing member 75.

The fixing shaft 77 may be inserted into the shaft insertion part 752*a* of the through-protrusion 752 after passing through the first connection part 731 of the connection member 73. Also, the fixing shaft 77 may be inserted into the shaft insertion part 752*a*. Also, the coupling member 771 and 772 may be coupled to both ends of the fixing shaft 77. The lever fixing member 75, the external fixing member 78, and the connection member 73 may be coupled to the fixing shaft 77 through the coupling of the coupling members 771 and 772. Thus, when the lever fixing member 75 rotates by the rotation of the lever 42, the connection member 73 connected by the fixing shaft 77 may also rotate together.

The elastic member 76 may be provided between the connection member 73 and the lever fixing member 75. The elastic member 76 may be compressed when the connection member 73 moves. In detail, the elastic member 76 may have a coil spring structure and have one end supported by the elastic support part 751 and the other end supported by the connection support part 734 of the connection member 73.

The connection member 73 may move in the front-rear direction within the space of the connecting case 71. Here, the connection member 73 may have a structure that is inserted into or protrudes to the space by the guide of the fixing shaft 77.

In details of the structure of the connection member 73, the connection member 73 may include a first connection part 731 which passes through the fixing shaft 77 and is concentric with the rotation axis of the lever 42, a second connection part 732 which is spaced from the first connection part 731 and into which the lever protrusion 425 is inserted, and a connection member 73 connecting the first connection part 731 to the second connection part 732.

The first connection part 731 may have a hollow cylindrical shape. The first connection part 731 may have a first hollow part 731*a* into which the fixing shaft 77 is inserted, a second hollow part 71*b* which has a diameter greater than that of the first hollow part 731*a* and to which the coupling member 771 coupled to the fixing shaft 77 is disposed, and a third hollow part 731*c* which has a diameter greater than that of the second hollow part 731*b* and into which the rod protrusion 841*a* of the elevation device 80 is inserted.

Figure 21:
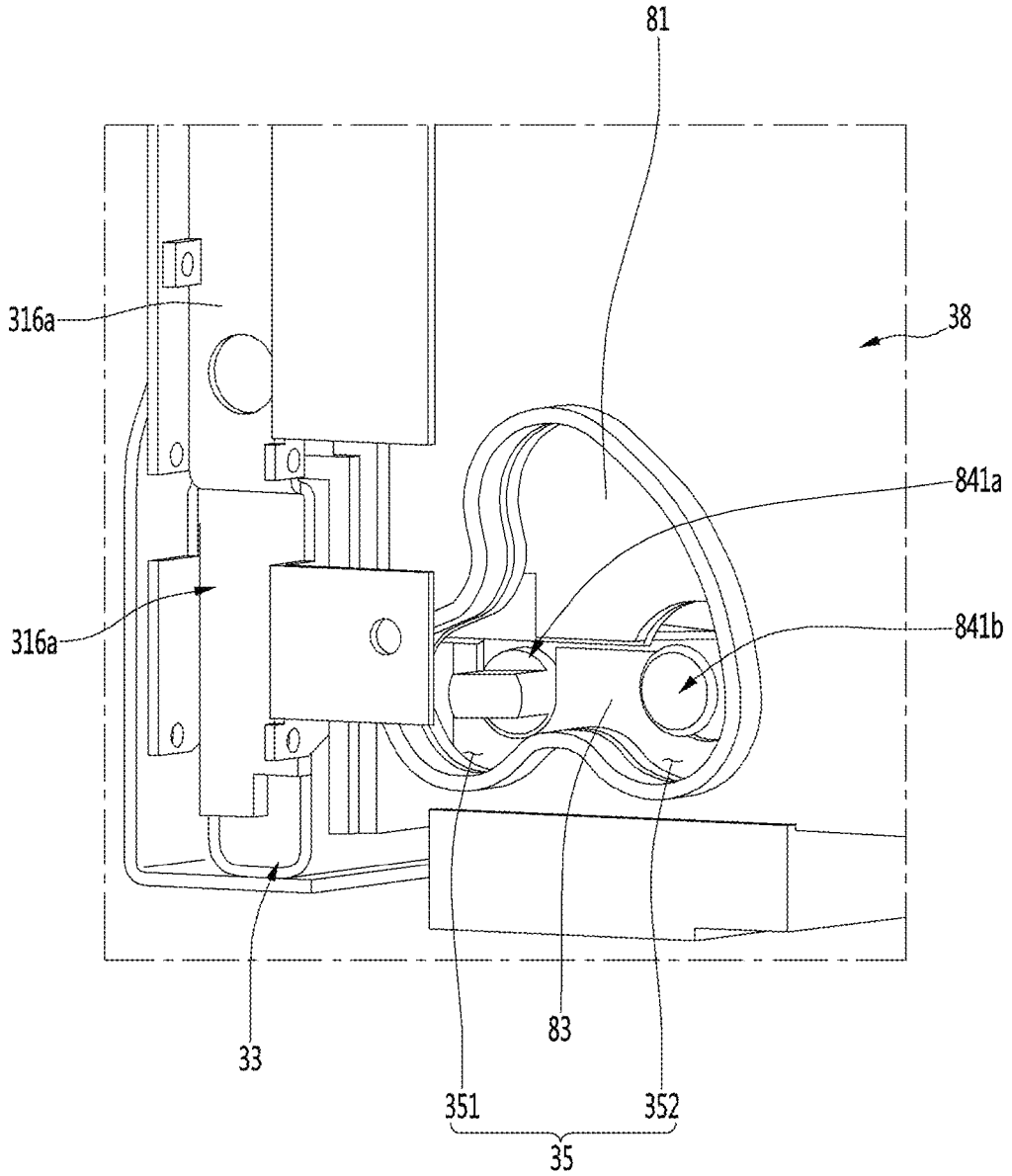
FIG. 21 is an enlarged view illustrating a portion A of FIG. 20.

The first hollow part 731*a* may have a rectangular cross-section like the fixing shaft 77, and the second hollow part 731*b* may have a circular cross-section. Also, at least a portion of the third hollow part 731*c* may have a groove shape corresponding to a rotation trajectory of an end of the rod protrusion 841*a* so that the rod protrusion 841*a* of the elevation device 80 is inserted, and when the elevation device 80 rotates, the rod protrusion 841*a* is hooked after rotating at a predetermined angle. As illustrated in FIG. 21, the rod protrusion 841*a* may have a planar shape on both sides thereof and be hooked with an stepped inner portion of the third hollow part 731*c* so that the rod protrusion 841*a* is hooked inside the third hollow part 731*c*.

Also, a connection support part 734 protruding outward by a predetermined width may be disposed on one side of the first connection part 731. The end of the elastic member 76 may contact the connection support part 734, and the end of the first connection part 731 may contact the connection support part 734. The connection support part 734 may protrude outward to support one end of the clastic member 76, and one end of the first connection part 731 may be inserted into the clastic member 76 to prevent the elastic member 76 from being separated.

The connection support part 734 may be larger than the size of the through-hole 742 defined in the push member 74 to maintain the state in which the connection support part 734 is in close contact with the rear surface of the push member 74. Thus, the connection support part 734 and the push member 74 may move together when the push member 74 is pressed or when the clastic member 76 returns to the initial position.

The second connection part 732 may be disposed at a position spaced apart from the first connection part 731 by the connection member 73. The second connection part 732 may have a cylindrical shape having a hollow 732*a* penetrated in the front and rear direction. The lever protrusion 425 may be inserted into one side of the second connection part 732, and the scissors protrusion 841*b* may be inserted into the other side of the second connection part 732. Here, the lever protrusion 425 and the scissors protrusion 841*b* may have the same outer diameter and correspond to the inner diameter of the second connection part 732.

The connection member 73 may be disposed so that the rod protrusion 841*a* and the scissors protrusion 841*b* of the elevation device 80 are respectively inserted into the first connection part 731 and the second connection part 732. As the second connection part 732 move farther away from the first connection part 731, the elevation device 80 may be easily elevated. However, when the first connection part 731 and the second connection part 732 are spaced a set distance or more from each other, the moving trajectory of the lever protrusion 425 and the scissors protrusion 841*b*, which are inserted into the second connection part 732, may extend up to a high height on the rear surface of the front panel door part 31 and the front surface of the drawer part. Thus, the opened trajectory may be exposed to deteriorate the outer appearance. Thus, the position of the second connection part 732 may be determined by the length of the connection member 73. Also, the second connection part 732 may be disposed at a height at which the rotation trajectory is not exposed, i.e., a position higher than the upper end of the elevation device 80.

The push member 74 may be provided inside the connecting case 71 and may be exposed through the opening 721 of the connecting cover 72 so that the push member 68 is pressed by the user. The push member 74 may include a push part 741 exposed through an opening 721 of the connecting cover 72 and a push guide part 744 extending along a portion of the circumference of the push part 741.

A through-hole 742 through which the first connection part 731 passes may be defined in the push part 741. The through-hole 742 may be larger than the outer diameter of the first connection part 731 and slightly smaller than the outer diameter of the connection support part 734. Thus, when the push part 741 may be pushed to move the push member 74, the first connection member 73 contacting the push member 74 may also move together to selectively connect the connection member 73 to the elevation device 80.

Also, the circumference of the push part 741 may extend toward the connecting case 71 and then be bent outward to provide a push flange 743. Thus, the push flange 743 may interfere with the opening 721 of the connecting cover 72 so that the push member 74 is restricted by the connecting cover 72 without being separated. For this, the opening of the connecting cover 72 may have a stepped part 722, and the push flange 743 may be accommodated into the rear surface of the stepped part 722.

The push guide part 744 may be disposed on one side of a circumference of the push part 741. The push guide part 744 includes a guide surface 744*a* extending along the circumference of the push part 741 and contacting an inner surface of the connecting case 71 and a guide boss disposed on each of both sides of a guide surface 744*a*. Also, the guide boss 744*b* may be penetrated by a guide post 713 extending from the recessed bottom surface of the connecting case 71.

Thus, when the push member 74 move forward and backward, the guide surface 744*a* may maintains the contact with the inner surface of the connecting case 71, and the guide boss 744*b* may move along the guide post 713 on each of both sides. Thus, the push member 74 may move forward and backward in the stable state without moving.

The connecting cover 72 may be mounted on the opened front side of the connecting case 71, and an opening 721 may be defined to expose the push part 741. The connecting cover 72 may be firmly fixed to the connecting case 71 by the coupling member. Thus, the configuration of the connecting case 71 may be maintained in the mounted state.

The connecting case 71, the push member 74, and a portion of the connecting cover 72 may be opened by cutting the connection member 73 by a rotational trajectory. Thus, the connection member 73 may be prevented from interfering with the connecting case 71, the push member 74, and the connecting cover 72 when the connection member 73 rotates.

In this structure, the user may manipulate the push member 74 of the connection assembly 70 to selectively couple and separate the connection assembly 70 to and from the elevation device 80.

Hereinafter, a structure of the drawer part 32 coupled to the front panel door part 31 will now be described in more detail with reference to the accompanying drawings.

Figure 19:
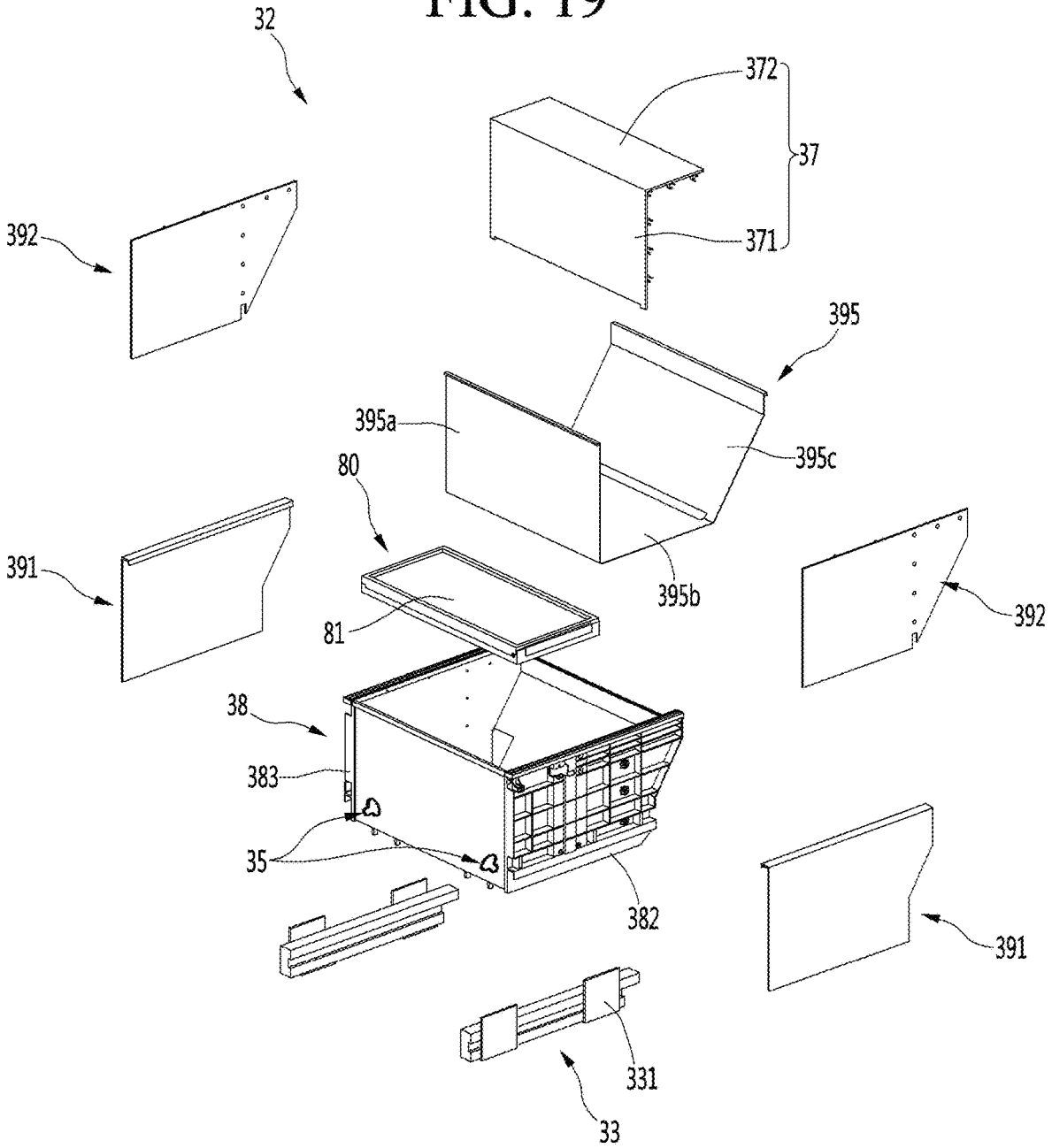
FIG. 19 is an exploded perspective view of the drawer part.

FIG. 19 is an exploded perspective view of the drawer part.

As illustrated in the drawings, the drawer part 32 may include a drawer body 38 defining an entire shape of the drawer part 32, an elevation device 80 provided in the drawer body 38 to elevate the container and food, and a plurality of plates 391, 392, and 393 defining an outer appearance of the drawer part 32.

In more detail, the drawer body 38 may be injection-molded by using a plastic material and define an entire shape of the drawer part 32. The drawer body 38 may have a basket shape having an opened top surface to define a food storage space therein. An inclined surface 321 may be disposed on a rear surface of the drawer body 38. Thus, an interference with the machine room 3 may not occur.

The door frames 316 may be mounted on both sides of the drawer part 32. The door frame 316 may be coupled to the lower frame of each of both sides of the bottom surface or both left and right surfaces of the drawer part 32. In the state in which the door frame 316 and the drawer part 32 are coupled to each other, the drawer part 32 and the front panel door part 31 may be integrally coupled to be inserted and withdrawn.

The door frame 316 may be separated from the drawer part 32, and then the connection assembly 70 may operate to separate the front panel door part 31 from the drawer part 32 in order to separate the front panel door part 31 from the drawer part 32. The door frame 316 and the drawer part 32 may be coupled to each other by a separate coupling member or a coupling structure between the door frame 316 and the drawer part 32.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion is disposed in the storage space. Also, the draw-out rack 34 may be coupled to a pinion gear 141 disposed on the bottom surface of the storage space. Thus, when the draw-out motor 14 is driven, the pinion gear 141 may rotate to allow the draw-out rack 34 to move, and the door 30 may be inserted and withdrawn.

The door 30 may not be automatically inserted and withdrawn. That is, the user may push or pull the door 30 to be inserted and withdrawn. Here, the draw-out rack 34 may be omitted, and thus, the insertion and withdrawal may be performed through only the draw-out rail 33.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated. The draw-out rail 33 may be a rail that extends in multistage. The draw-out rail 33 may have one end fixed to the storage space inside the cabinet 10 and the other end fixed to the rail mounting part 382 to more stably realize insertion and the withdrawal of the door 30.

Also, the plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, the constituents such as the door frame 316 and the draw-out rail 33, which are mounted on both the sides of the drawer body 38 may not be exposed to the outside.

A plurality of reinforcement ribs 384 may cross each other in vertical and horizontal directions on both outer surfaces of the drawer body 38. The reinforcement ribs 384 may reinforce the strength of the drawer body 38 itself so that the drawer body 38 is more rigidly shaped relative to the weight of the door, which increases by providing the driving device and the elevation. Also, the reinforcement ribs 384 may support the outer side plates 391 mounted on both side surfaces, and thus the outer appearance of the drawer part 32 may be firmly maintained.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

The inner plate 395 may be constituted by a front part 395*a*, a bottom surface part 395*b*, and a rear surface part 395*c*, which have sizes correspond to the front surface, the bottom surface, and the rear surface of the inside of the drawer body 38. The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front part 395*a*, the bottom surface part 395*b*, and the rear surface part 395*c* constituting the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal. Thus, the storage space within the drawer part 32 may have a metal texture on the whole, and the foods accommodated in the drawer part 32 may be more uniformly cooled and thus stored at a low temperature in the more uniform region. In addition, visually excellent cooling performance and storage performance may be provided to the user.

The drawer cover 37 may include a cover front part 371 that partitions the inside of the drawer body 38 into a front space S1 and a rear space S2 and a cover top surface part 372 bent from an upper end of the cover front part 371 to cover a top surface of the rear space S2.

That is, when the drawer cover 37 is mounted, only the front space S1, in which the elevation device 80 is disposed, may be exposed in the drawer body 39, and the rear space S2 may be covered by drawer cover 37.

The elevation 80 may be disposed in the drawer body 38. The elevation device 80 may be connected to the connection assembly 70 and may be vertically movable. The left and right sides of the elevation device 80 may be elevated uniformly.

A drawer opening 35 may be defined in the lower part of the front surface of the drawer part 32 for coupling the elevation device 80 to the connection assembly 70. The drawer opening 35 may provide a passage through which the connection member 73 is inserted to be coupled to the elevation device. Also, the drawer opening 35 may have an opening shape along the rotation path of the connection member 73 when the connection member 73 rotates to allow the connection member 73 to rotate, and thus, the stable rotation may be achieved without the interference.

The elevation device 80 may be provided as a scissors type so that the elevation device is folded in a descending state and unfolded in an ascending state. Thus, the container or food seated on the upper surface may be elevated.

The elevation device 80 may be provided with a support plate 81, and the support plate 81 may provide a seating surface on which the container 36 or food is seated.

Hereinafter, a connection structure between the connection assembly 70 and the elevation device will be described.

Figure 20:
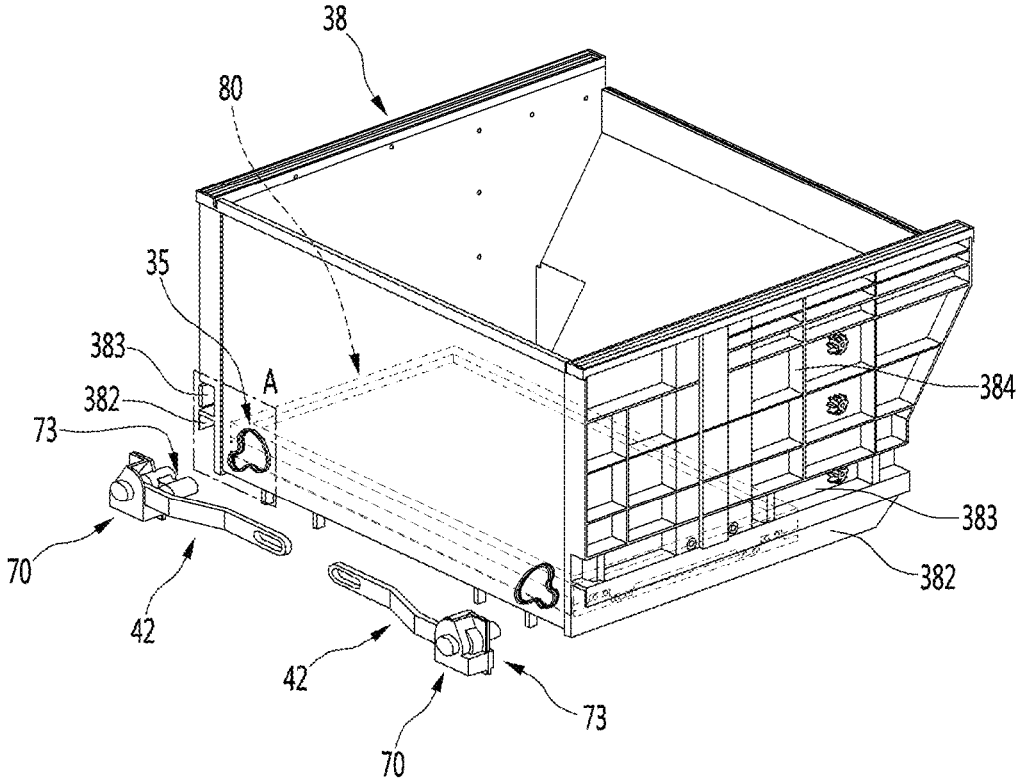
FIG. 20 is an exploded perspective view illustrating a coupling relationship between the drawer part and the connection assembly.

FIG. 20 is an exploded perspective view illustrating a coupling relationship between the drawer part and the connection assembly. Also, FIG. 21 is an enlarged view illustrating a portion A of FIG. 20.

As illustrated in the drawings, the drawer opening 35 may be defined in the right and left sides of the lower front of the drawer part 32. The shape of the drawer opening 35 on each of both sides of the right and left sides may be symmetrical to each other, and the rod protrusion 841*a* of the elevation device 80 and the scissors protrusion 841*b* may be exposed through the drawer opening 35. That is, the drawer opening 35 may be opened at a position corresponding to the rod protrusion 841*a* of the elevation device 80 and the scissors protrusion 841*b*.

The drawer opening 35 may include a central portion 351 and a trajectory portion 352. The central portion 351 may be disposed at a position corresponding to the rod protrusion 841*a* of the elevation device 80 and may have a size such that the first connection part 731 of the connection member 73 is inserted. Also, the trajectory portion 352 may be connected to the central portion 351 and may be opened in a shape corresponding to the trajectory in which the second connection part 732 of the connection member 73 move to rotate. Thus, the rod protrusion 841*a* of the elevation device 80 may rotate on the central portion 351 while the scissors protrusion 841*b* of the elevation device 80 rotates along the trajectory portion 352. That is, the scissors protrusion 841*b* and the second connection part 732 may be disposed inside the central portion 351 and the trajectory portion 352 when the elevation device 80 moves vertically.

The height of the drawer opening 35 may be lower than the upper end of the elevation device 80, i.e., the upper surface of the support plate 81. Thus, the drawer opening 35 may be prevented from being seen from the inside of the drawer part 32 in any state in the state in which the elevation device 80 is mounted.

The rod protrusion 841*a* and the scissors protrusion 841*b* of the elevation device 80 may be exposed through the drawer opening 35 while the elevation device 80 is mounted inside the drawer part 32. Also, in the state in which the sub door 30 is coupled, the connection member 73 of the connection assembly 70 may be inserted through the inside of the drawer opening 35 so as to be coupled to the rod protrusion 841*a* of the elevation device 80 and the scissors protrusion 841*b*.

The connection assembly 70 may be provided on each of both right and left sides of the drawer part 32 and may have a shape symmetrical to each other. The selective separation of the elevation device 80 and the connection assembly 70 may be enabled through the manipulation of the push member 74.

The circumference of the support plate 81 may protrude upward so that the container 36 or food is stably mounted. Also, the circumference of the support plate 81 may extend downward. Thus, the remaining constituents of the elevation device 80 may be accommodated below the support plate 81, and the covered and clean outer appearance may be realized by the circumference of the support plate 81.

In addition, the support plate 81 may have a size and a shape corresponding to the front space to prevent foreign matters from being introduced into the elevation device 80 provided below the front space S1, and also, to fundamentally prevent safety accidents from occurring by blocking the access to the elevation device 80.

Hereinafter, constituents of the elevation device 80 will be described in more detail.

Figure 22:
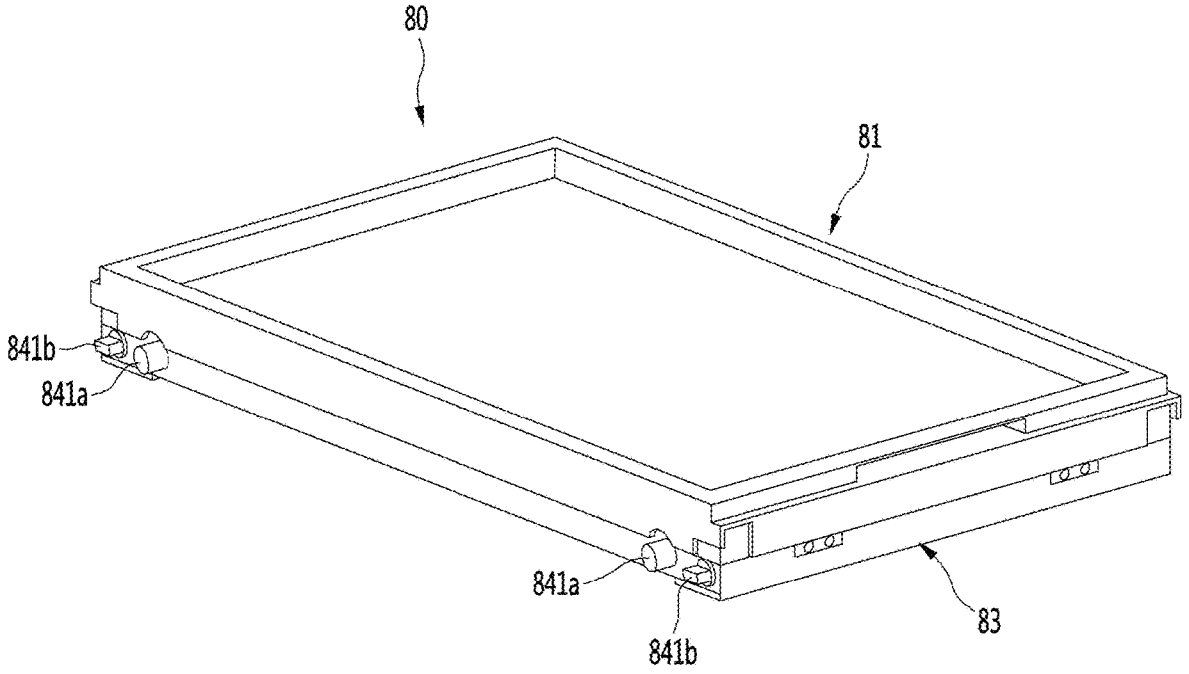
FIG. 22 is a front view of an elevation device according to the first embodiment.
Figure 23:
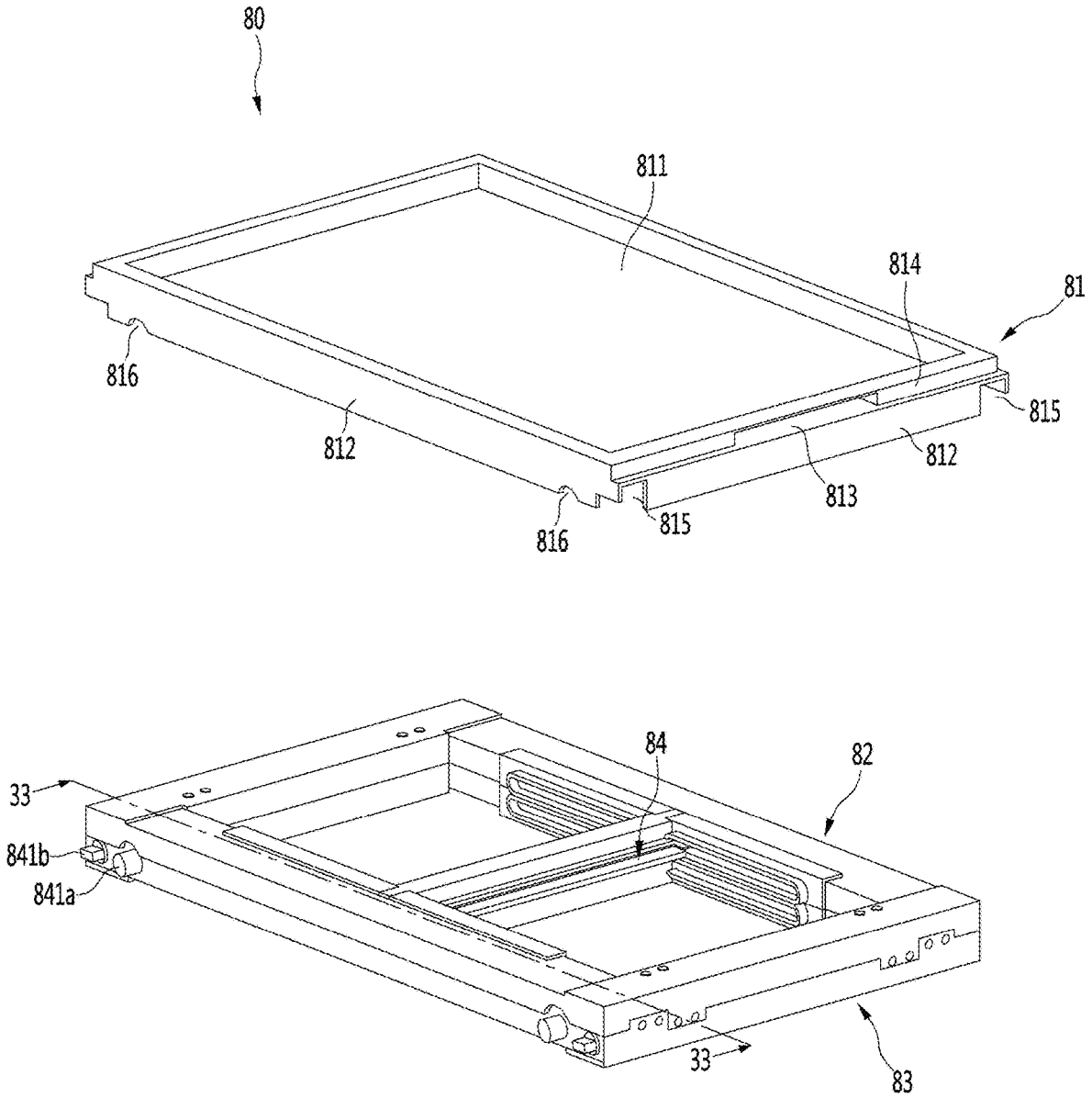
FIG. 23 is an exploded perspective view illustrating a state in which a support plate is separated from the elevation device.

FIG. 22 is a front view of an elevation device according to the first embodiment. Also, FIG. 23 is an exploded perspective view illustrating a state in which a support plate is separated from the elevation device.

As illustrated in the drawings, when the elevation device is viewed from an upper side, the elevation device may have a rectangular shape having a size corresponding to that of a front space of the drawer part 32 and have a predetermined thickness.

The elevation device 80 may be mounted on the bottom surface of the inner side of the drawer part 32 and may be detachably installed on the inside of the drawer part 32. That is, the coupling between the elevation device 80 and the connection assembly 70 may be released in the state in which the elevation device 80 is mounted on the drawer part 32. Thus, in the state in which the driving device 40 is mounted on the front panel door part 31, only the elevation device may be separated from the inside of the drawer part 32.

The elevation device 80 may include an upper frame 82 and a lower frame 83 as a whole and a lifting assembly 84 disposed between the upper frame 82 and the lower frame 83.

An outer appearance of the elevation device 80 may be defined by the upper frame 82 and the lower frame 83. Each of the upper frame 82 and the lower frame 83 may have a rectangular frame shape and also have a predetermined width and a predetermined thickness.

A lower end of the upper frame 82 and an upper end of the lower frame 83 may have shapes corresponding to each other. In a state in which the upper frame 82 is disposed at the lowermost position, the lower end of the upper frame 82 and the upper end of the lower frame 83 may be coupled or contact each other.

Also, the lifting assembly 84 may be disposed between the upper frame 82 and the lower frame 83. The lifting assembly 84 may be connected to the connection assembly 70. The lifting assembly 84 may be folded or unfolded according to the rotation of the lever 42 to allow the upper frame 82 to be elevated.

When the upper frame 82 is disposed at the lowermost position, the lifting assembly 84 may be accommodated between the upper frame 82 and the lower frame 83. When the support plate 81 is mounted, the upper frame 82 and the lower frame 83 as well as the lifting assembly 84 may not be exposed to the outside.

Here, the scissors protrusion 841*b* and the rod protrusion 841*a*, which transmit the rotation force, of the lifting assembly 84 may protrude forward through the upper frame 82 and the lower frame 83. When the elevation device 80 is mounted, the scissors protrusion 841*b* and the rod protrusion 841*a* may be coupled to the connection assembly 70.

The support plate 81 may be one component of the elevation device 80 and may be seated on the upper frame 82 to define the top surface of the elevation device 80. Also, the container 36 or food may be seated on the support plate 81. Thus, the upper frame 82 and the support plate 81 may be elevated together with the elevation device 80 to elevate the container 36 or food.

In details of the support plate 81, the support plate 81 may include a support surface 811 having a plate shape and an edge 812 disposed around the support surface 811.

The support surface 811 may have disposed at a position lower than that of the edge 812. The support surface 811 may have a size and shape corresponding to those of the bottom surface of the container 36. Thus, when the container 36 is seated on the support plate 81, the container 36 may be inserted into a space that is defined by the edge 812, and the bottom surface of the container 36 may be supported by the support surface 811. Thus, while the elevation device 80 is elevated, the container 36 may be maintained in a stably accommodated state.

The edge 812 may have a predetermined width, and an outer surface of the edge 812 may extend downward. The edge 812 may extend to contact a circumferential surface of the upper frame 82. Thus, in the state in which the support plate 81 is mounted, the circumferential surface of the upper frame 82 may be covered by the edge 812. Also, when viewed from an upper side, the upper frame 82 made of a metal material may not be exposed to the outside. That is, only the support plate 81 made of a plastic material may be exposed to the outside through the front space.

A handle part 813 may be disposed on an edge 812, which defines both left and right side surfaces of the support plate 81, of the edge 812. A stepped part 814 that is stepped inward may be disposed on each of both sides of the edge 812 on which the handle part 813 is disposed, and the handle part 813 may be recessed at a center of the stepped part 814. Thus, the user may lift the support plate 81 by putting his hand into the stepped part 814 and the handle part 813 in the state in which the elevation device 80 is accommodated in the drawer part 32 and also may detach the support plate 81 from the support plate 82.

A cutoff part 815 may be defined in an edge portion of the support plate 81 so that the support plate 81 is easily mounted, and a portion of the edge of the upper frame 82 may be exposed. Also, a groove 816 recessed to prevent the rod protrusion 841*a* from interfering may be further defined in the front surface of the support plate 81.

Hereinafter, structures of the upper frame, the lower frame 83, and the lifting assembly 84, which constitute the elevation device 80, will be described in more detail with reference to the accompanying drawings.

Figure 24:
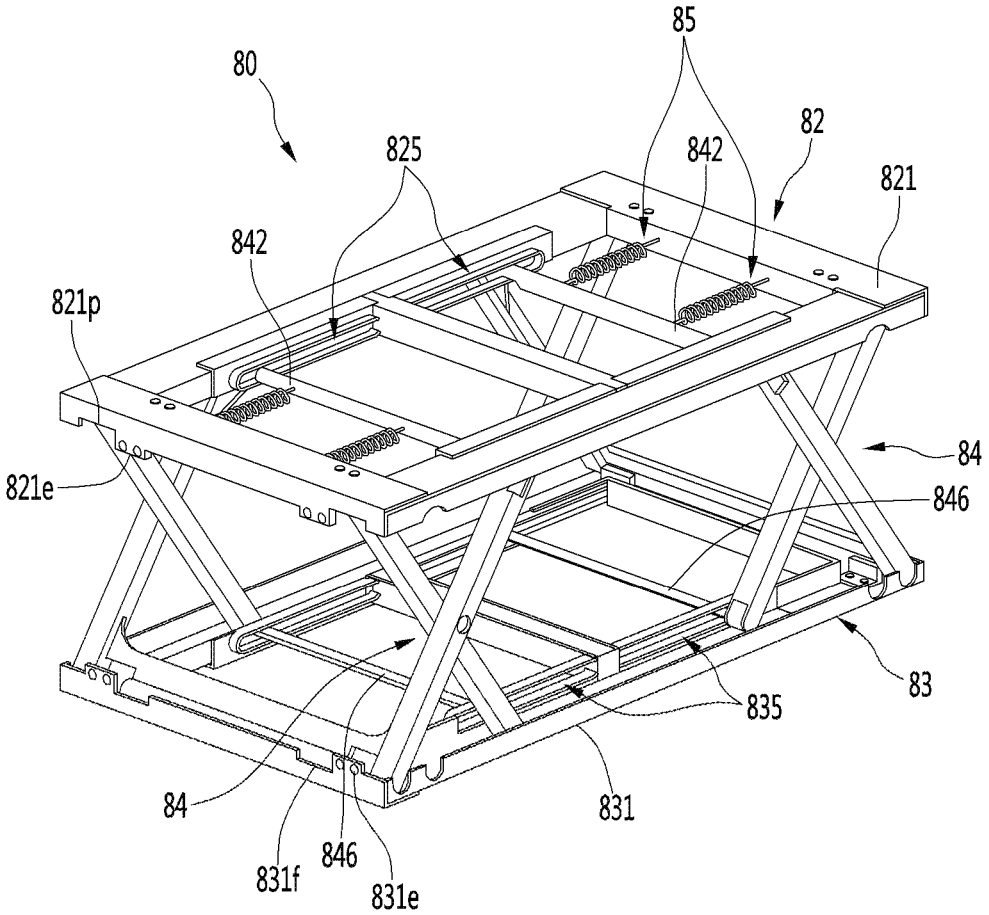
FIG. 24 is a perspective view of the elevation device.
Figure 25:
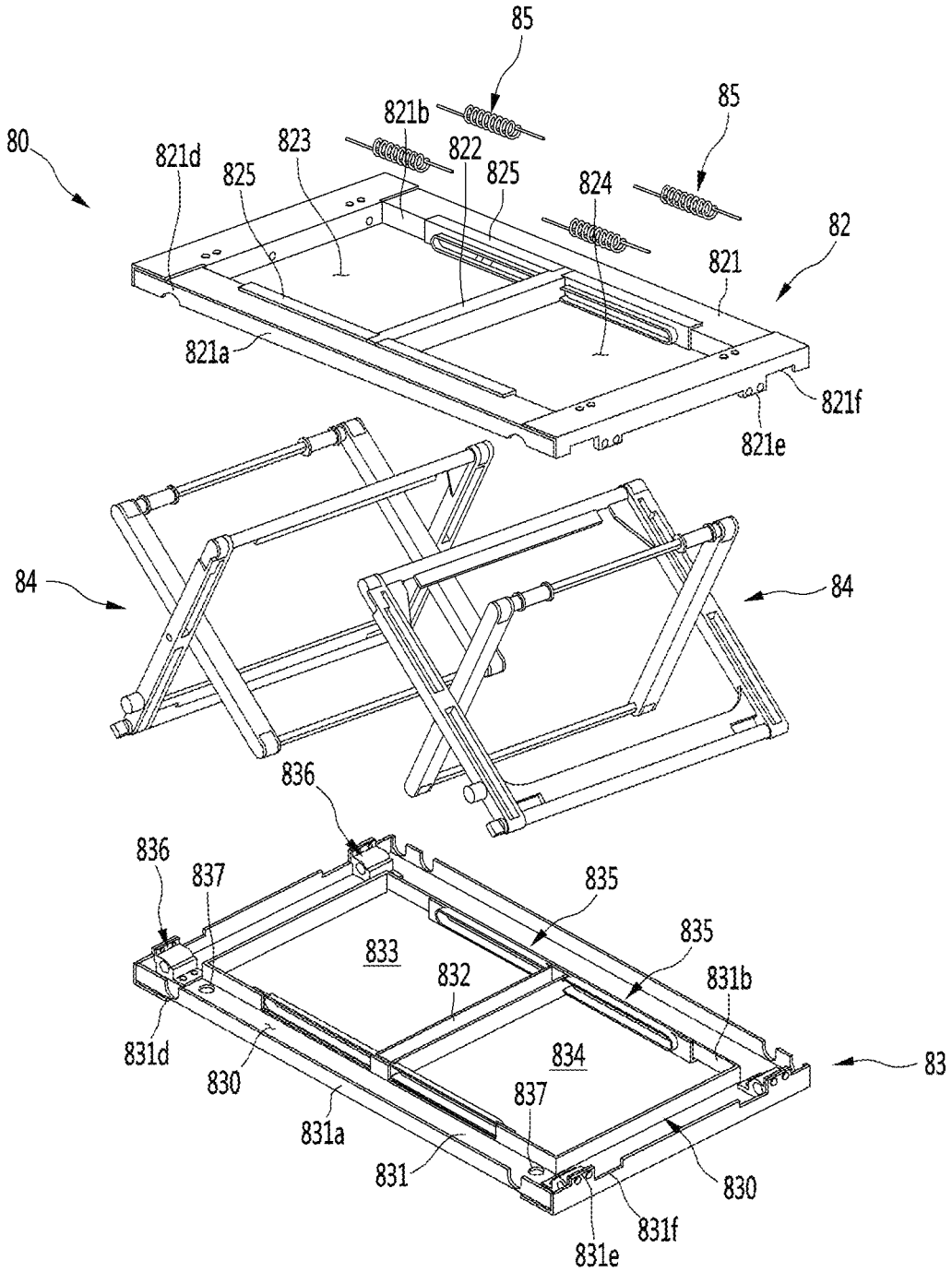
FIG. 25 is an exploded perspective view of the elevation device in a state in which a lifting assembly that is one component of the elevation device is unfolded.
Figure 26:
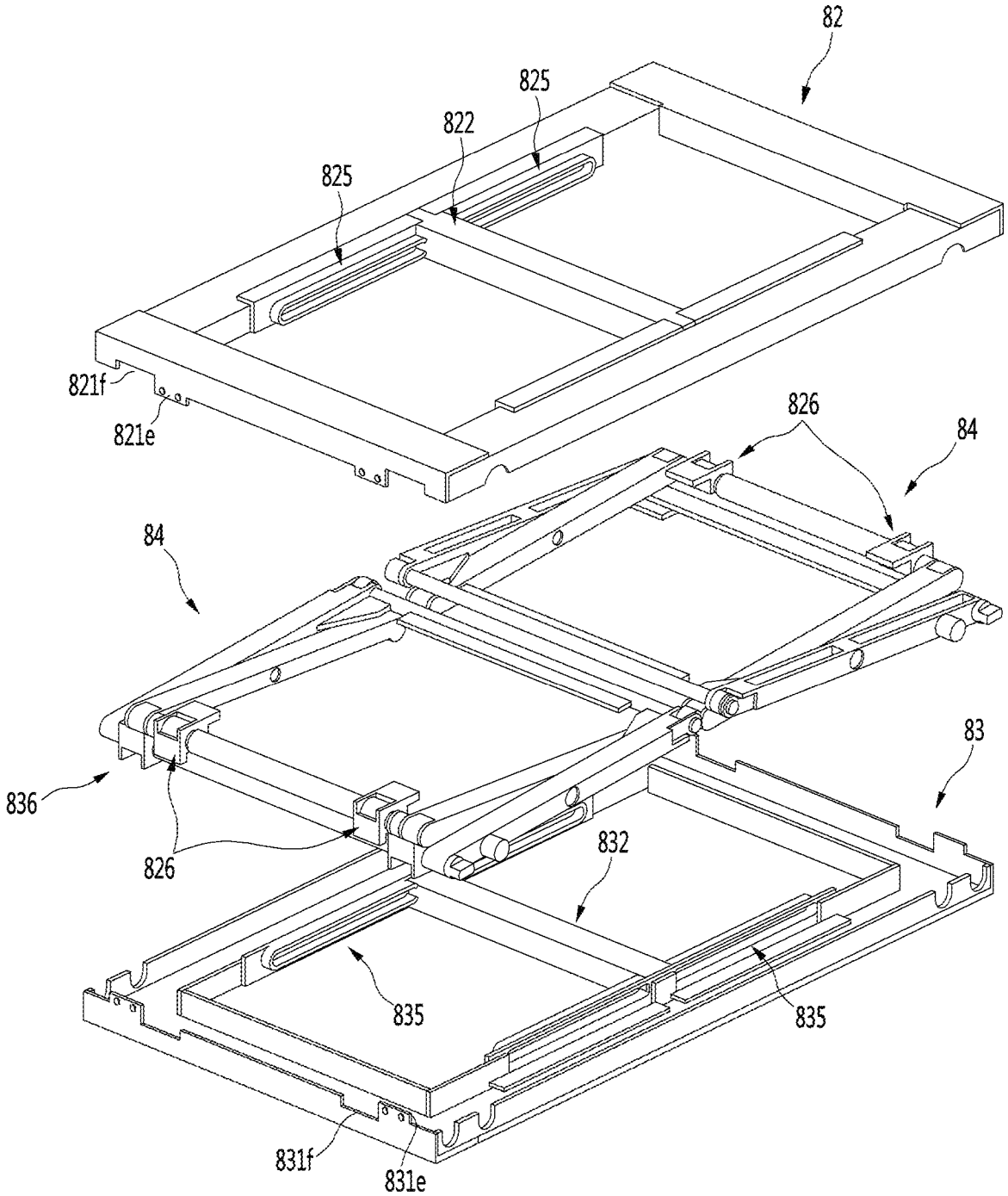
FIG. 26 is an exploded perspective view of the elevation device in a state in which the lifting assembly is folded.
Figure 27:
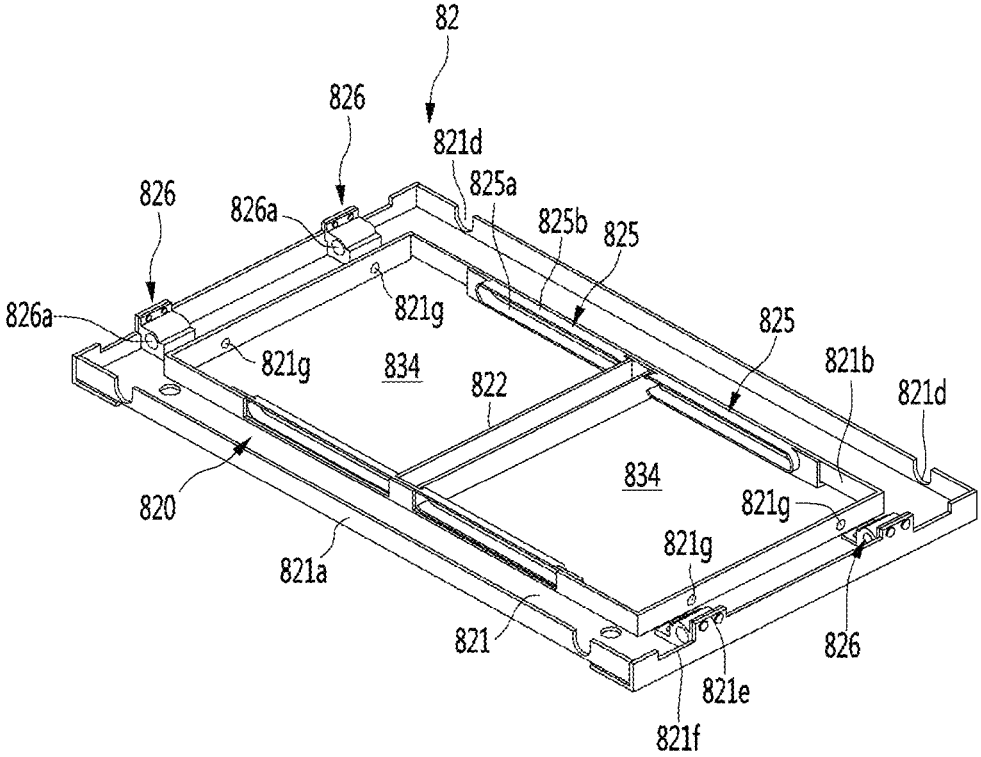
FIG. 27 is a perspective view of an upper frame that is one component of the elevation device.

FIG. 24 is a perspective view of the elevation device. Also, FIG. 25 is an exploded perspective view of the elevation device in a state in which the lifting assembly that is one component of the elevation device is unfolded. Also, FIG. 26 is an exploded perspective view of the elevation device in a state in which the lifting assembly is folded. Also, FIG. 27 is a perspective view of the upper frame that is one component of the elevation device.

As illustrated in the drawings, the upper frame 82 may have a square frame shape corresponding to the size of the inner front space S1 of the drawer part 32 and may be configured to mount the support plate 81 on the top surface thereof.

The upper frame 82 may substantially support the food or container 36 together with the support plate 81 so as to be elevated together. Also, the upper frame 82 may generally defines a frame part 821 which defines a circumferential shape of the upper frame 82 and a partition part 822 for partitioning the space inside the frame part 821 into left and right sides.

Since the frame part 821 and the partition part 822 define an outer frame and support the support plate 81, high strength may be required, and thus, the frame part 821 and the partition part 822 may be made of a metal and may have shape in which both ends are bent to increase the strength and prevent deformation.

In detail, each of the frame part 821 and the partition part 822 may be formed of a plate-shaped metal material, and both ends of each of the frame part 821 and the partition part 822 may be bent to provide a bent portion. Then, grooves, holes, or cut portions that are necessary for a connection relationship with other constituents may be formed to be coupled to each other. Particularly, the frame part 821 may be configured so that the constituents defining both left and right surfaces of the upper frame 82 are formed and then coupled to each other. Also, the partition part 822 may be coupled in a state in which the frame part 821 is assembled. Spaces 823 and 824 may be defined in both sides of the upper frame 82 with respect to the partition part 822.

Edges 821*a*, 821*b*, 831*a*, and 831*b* may be provided on all of the upper frame 82 and the lower frame 83. In the state in which the upper frame 82 is disposed at the lowermost position, lower ends of the edges 821*a* and 821*b* of the upper frame 82 and the edges 831*a* and 831*b* of the lower frame 83 may contact each other to define spaces. Also, the lifting assembly 84 may be accommodated in a space between the upper frame 82 and the lower frame 83.

Also, a slide guide 825 may be disposed on each of both sides of the inner side of the upper frame 82 to accommodate the end of the lifting assembly 84 and guide the movement of the lifting assembly 84. The slide guides 825 may be disposed on both sides of the partition part 822. Also, the scissors assemblies 84 having the same structure may be disposed on both sides with respect to the partition part 822.

The slide guide 825 may be separately molded by using a plastic material having excellent abrasion resistance and lubrication performance and mounted on the upper frame 82. Also, a long hole 825*a* through which the sliding shaft 842 of the lifting assembly passes may be defined in the slide guide 825, and the sliding shaft 842 may move along the slide guide 825. Also, a sliding surface 825*b* having a predetermined width may be further disposed along the circumference of the long hole 825*a*, and the sliding shaft 842 may be more stably supported by the sliding surface 825*b* so that the lifting assembly 84 is more smoothly folded or unfolded.

The frame part 821 may include vertically curved edges 821*a* and 821*b* along the circumference thereof. The edges 821*a* and 821*b* may be disposed on the inner side and the outer side of the frame part 821, respectively. Also, the slide guide 825 may be disposed on the edge 821*b* inside the frame part 821.

Also, an edge groove 821*d* may be defined in the outer edge 821*a* of the frame part 821. The edge groove 821*d* may be a groove in which the scissors protrusion 841*b* of the elevation device 80 is accommodated in the state in which the elevation device 80 completely descends and be defined in a position corresponding to the scissors protrusion 841*b* at the end of the edge 821*a*. When the upper frame 82 completely descends to contact the lower frame 83, the upper frame 82 may contact the edge groove and 821*d* defined in the lower frame 83 to provide a complete hole shape so that the scissors protrusion 841*b* passes therethrough.

The edge groove 821*c* may be defined in a position corresponding to the rod protrusion 841*a* according to the size or position of the rod protrusion 841*a*. The edge grooves 821*c* and 821*d* and the rod protrusion 841*a* and the scissors protrusion 841*b* may be disposed adjacent to the left and right ends of the elevation device 80 and may be exposed through the drawer opening 35.

Also, a coupling groove 821*f* and a coupling end 821*e* may be provided on both ends of the upper frame 82, which correspond to both surfaces of the drawer part 32. The coupling groove 821*f* and the coupling end 821*e* may be provided on the extending end of the edge 821*a*. Also, the coupling end 821*e* may be provided to protrude downward, and the coupling groove 821*f* may be defined to be recessed upward. The coupling groove 821*f* and the coupling end 821*e* may be disposed on both the upper frame 82 and the lower frame 83. When the upper frame 82 completely move downward, the upper frame 82 may be coupled to the coupling end 821*e* and the coupling groove 821*f*.

Also, a scissors fixing member 826 may be provided at each of both ends of the inner space of the frame part 821. The scissors fixing member 826 may fix the rotation shaft 847 of the lifting assembly 84, and a pair of scissors fixing members 826 may be provided at both ends.

The scissors fixing member 826 may be provided inside the accommodation space 830 of the frame part 821 corresponding to the coupling end 821*e*. That is, the coupling end 821*e* may have a size corresponding to one surface of the scissors fixing member 826 so that the scissors fixing member 826 is fixed and mounted. Thus, the coupling end 821*e* may provide a surface that is coupled to the scissors fixing member 826 by a separate coupling member such as a screw.

The scissors fixing member 826 may also be made of an engineering plastic material having abrasion resistance due to continuous friction with the rotation shaft 847. Also, the scissors fixing member 826 may have a through-hole 843*b* through which the rotation shaft 847 passes.

A plurality of scissors fixing members 826 may be provided on both ends of the frame part 821 so that both ends of the rotation shaft 847 are rotatably fixed. Thus, the rotation shaft 847 may be stably fixed to allow the lifting assembly 84 to be smoothly folded and unfolded.

The lower frame 83 may have the same structure as that of the upper frame 85 but only in the direction. The lower frame 83 may include a frame part 831 and a partition part 832 to define spaces 833 and 834 in which the scissors assemblies 84 are respectively installed.

Also, the slide guide 835 may be provided on the inner edge 831*b* of the lower frame 83. The slide guide 835 may have the same structure and shape as the slide guide 825 of the upper frame 82. Also, a second sliding shaft 846 of the lifting assembly 84 may pass through the slide guide 835 of the lower frame 83 to move along the slide guide 835.

Also, a first frame groove 831*c* and a second frame groove 831*d* may be defined in the outer edge 821*a* of the lower frame 83. The first frame groove 831*c* and the second frame groove 831*d* may be defined in positions corresponding to the frame groove 821*d* defined in the upper frame 82. In the state in which the upper frame 82 and the lower frame 83 contact each other, the scissors protrusion 841*b* and the rod protrusion 841*a* may pass through the upper frame 82 and the lower frame 83 to protrude outward.

The coupling end 831*e* and the coupling groove 831*f*, which match the end of the upper frame 82, may be provided on both side surfaces of the frame part 831 of the lower frame 83. The coupling end 831*e* and the coupling groove 831*f* of the lower frame 83 disposed on the lower frame 83 may be disposed at positions facing the coupling groove 821*f* the coupling end 821*e* and have shape corresponding to those of the coupling groove 821*f* the coupling end 821*e* so that the coupling end 831*e* and the coupling groove 831*f* are respectively coupled to the coupling groove 821*f* the coupling end 821*e*. That is, the coupling end 821*e* of the upper frame 82 and the coupling groove 831*f* of the lower frame 83 may be disposed at positions facing each other, and the coupling groove 821*f* of the upper frame 82 and the coupling end 831*e* of the lower frame 83 may be disposed at positions facing each other. Thus, when the upper frame 82 and the lower frame 83 are coupled to each other, a lower end of an outer surface of the upper frame 82 and an upper end of an outer surface of the lower frame 83 may be coupled to each other at the protruding and recessed portions thereof as if the lower frame 83 and the upper frame 82 are integrated with each other.

Also, since the coupling end 831*e* is disposed outside the coupling groove 831*f*, the lifting assembly 84 may also be disposed at the corresponding position. Thus, when the upper frame 82 and the lower frame 83 are coupled to each other, the scissors fixing member 826 of the upper frame 82 and the scissors fixing member 836 of the lower frame 83 may not interfere with each other.

As described above, the lower frame 83 and the upper frame 82 may have the same structure and shape except for the coupling groove 831*f* and the coupling end 831*e* and the disposed position of the scissors fixing member 836.

Also, the scissors fixing member 826 may be provided in an accommodation space 830 defined when the upper frame 82 and the lower frame 83 are coupled to each other. In detail, in a state in which the upper frame 82 completely moves downward, the outer edge 821*a* of the upper frame 82 and the outer edge 821*a* of the lower frame 83 may contact each other.

Thus, the upper frame 82 and the lower frame 83 may contact each other to define the accommodation space 830 therein. The lifting assembly 84 may be accommodated in the accommodation space 830 in a state of being completely folded. That is, in the state in which the elevation device 80 descends to the lowermost position, the rest of the constituents of the lifting assembly 84 except for the first sliding shaft 842 and the second sliding shaft 844 may be disposed in the space defined by the frame parts of the upper frame 82 and the lower frame 83. Also, the first sliding shaft 842 and the second sliding shaft 846 may also be disposed in the spaces 823, 824, 833, and 834 defined by the partition parts 822 and 832.

Thus, the additional space for accommodating the lifting assembly 84 in addition to the upper frame 82 and the lower frame 83 may not be required so that the loss of storage space inside the drawer part 32 is minimized.

Furthermore, since the support plate 81 also has a structure capable of accommodating the upper frame 82 and/or the lower frame 83, a space for arranging the upper frame 82 and the lower frame 83 may not be additionally required. Thus, a loss in space for disposing the elevation device 80 may be minimized to secure the storage capacity of the drawer part 32.

That is, even if the elevation device 80 having the complicated scissors type is disposed, a space loss equivalent to the thickness of the support plate 81 or a space occupied by the coupling between the upper frame 82 and the lower frame 83 may be generated to very effectively utilize the interior of the drawer part 32.

An elevation device fixing part 837 may be disposed on the bottom surface of the frame part 821 of the lower frame 83. The elevation device fixing part 837 may have an opened hole shape and have a protruding shape protruding from the bottom surface of the drawer part 32 when the elevation device 80 is mounted inside the drawer part 32 and may be combined in shape with an elevation device coupling part (not shown). That is, the elevation device 80 may be fixed to match the inside of the drawer part 32 by a simple operation that is seated inside the drawer part 32 and be maintained in the stable state even though the elevation device 80 operates. Also, the elevation device 80 may be easily lifted and separated from the drawer part 32 without any additional tool even if the elevation device 80 is not disposed in the drawer part 32.

The scissors assemblies 84 may be provided on both left and right sides of the lifting assembly 84. The scissors assemblies 84 may be connected to the connection assembly 70 and may be independently driven by the power transmitted through the shaft 41 and the lever 42 to lift the upper frame 82. Here, the scissors assemblies 84 on both sides may not cause any misalignment or deviation in one of the driving motors 64 and the structure of the driving device 40 including the shaft 41 and the screw assembly 50 so as to provide a structure capable of being elevated by the same height.

Thus, the pair of scissors assemblies 84 disposed on both sides may be exerted independently by the pair of the levers 42 operating at the same time even when supporting heavy loads, and thus, the pair of scissors assemblies 84 may be elevated at the same time. Here, the lifting assembly 84 may be configured to allow the upper frame 82, i.e., the support plate 81 to be elevated in the horizontal state.

Figure 28:
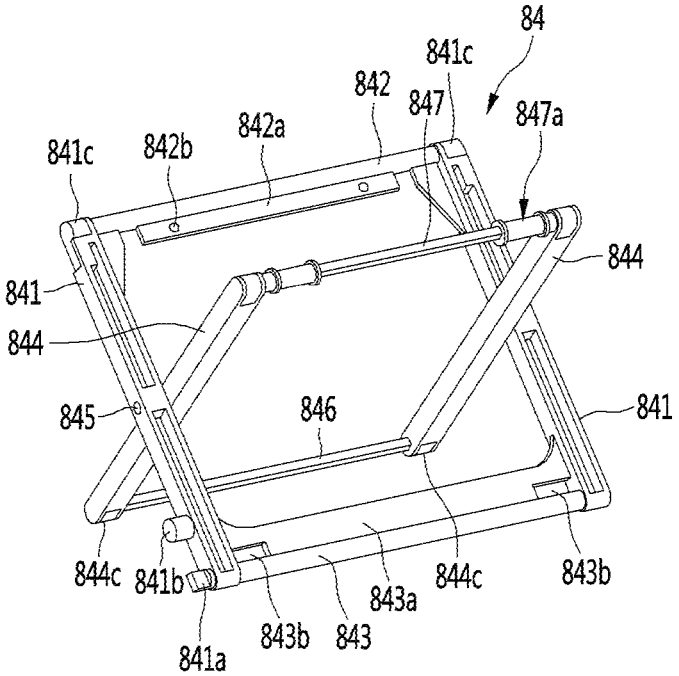
FIG. 28 is a perspective view of the lifting assembly.

FIG. 28 is a perspective view of the scissors assembly.

Referring to FIG. 28, the lifting assembly 84 may include a pair of first rods 841 arranged in parallel to each other, a first sliding shaft 842 connecting both ends of the first rod 841, and a first rotation shaft 843.

Each of the first rod 841, the first sliding shaft 842, and the first rotation shaft 843 may have a width that is enough to be accommodated inside the frame part 821. Also, the first rod 841 may be disposed in a region corresponding to that of the frame part 821, and the first rotation shaft 843 may also be disposed at an region corresponding to the frame part 821.

Also, the rod protrusion 841*a* and the scissors protrusion 841*b* may be disposed on one end of the first rod 841. Here, the rod protrusion 841*a* may be disposed on the same extension line as the first rotation shaft 843, and the first rotation shaft 843 may rotate when the rod protrusion 841*a* rotates.

The first rotation shaft 843 may further include a rotation enhancing part 843*a*. The rotation enhancing part 843*a* may be configured to connect a portion of the first rod 841 to the entire first rotation shaft 843. Thus, when the first rod 841 rotates, the first rotation shaft 843 may rotate together and also be enhanced to withstand the generated moment.

Also, a mounting hole 843*b* may be defined in each of both ends of the rotation enhancing part 843*a*, and the scissors fixing member 836 may be mounted to pass through the mounting hole 843*b*. Thus, the first rotation shaft 843 may be rotatably mounted on the scissors fixing member 836 of the lower frame 83.

The first sliding shaft 842 may connect the other end of the first rod 841 and may be disposed to pass through the slide guide 825. Thus, the first sliding shaft 842 may move along the slide guide 825 of the upper frame 82 when the first rod 841 rotates.

Also, a first roller 841*c* may be disposed on an upper end of the first rod 841 to which the first sliding shaft 842 is connected. The first roller 841*c* may contact an inner surface of the frame part 821. When the first sliding shaft 842 moves along the slide guide 825, the first roller 841*c* may contact the inner surface of the frame part 821 to rotate. Thus, the elevation device 80 may smoothly operate even though the upper frame 82 is pressed by a weight object.

The first sliding shaft 842 may further include an elastic member mounting part 842*a*. The elastic member mounting part 842*a* may be configured to fix a scissors elastic member 85 connecting the inner surface of the frame part 821, to which the first sliding shaft 842 and the second rod 844 are rotatably fixed. A mounting hole 842*b* may be formed in the elastic member mounting part 842*a* to fix one end of the scissors elastic member 85.

As illustrated in FIG. 23, since the frame part 821 and the first sliding shaft 842 are disposed at the farthest positions in a state in which the elevation device 80 is disposed at the lowest height, the scissors elastic member 85 may be in the maximumly tensioned state. Thus, when the upper frame 82 ascends, the restoring force of the scissors elastic member 85 may provide the additional force so that the elevation device 80 is elevated with less force.

As illustrated in FIG. 24, the first sliding shaft 842 may be disposed closest to the frame part 821 in a state in which the elevation device 80 is disposed at the maximum height, and thus, the scissors elastic member 85 may be in the minimally tensioned state or the non-tensioned state. Since the scissors elastic member 85 is tensioned to allow the upper frame 82 to descend when the elevation device 80 descends, the upper frame 82 may slowly descend by the elastic force of the scissors elastic member 85. Thus, even though the heavy food is accommodated, the elevation device 80 may be buffered to reduce impact noise and smoothly descend.

Also, a pair of second rods 844 may be provided to cross the first rod 841. The first rod 841 and the second rod 844 may be connected to each other by the scissors shaft 845 so that the first rod 841 and the second rod 844 rotate in the state of crossing each other. The second rod 844 may be disposed between both the first rods 841. That is, the scissors shaft 845 may sequentially pass through the first rod 841 and the second rod 844 from the outside of the first rod 841.

A second sliding shaft 842 connecting an upper end of the second rod 844 and a second rotation shaft 847 connecting a lower end of the second rod 844 may be provided on the second rod 844.

The second rod 844, the second sliding shaft 842, and the second rotation shaft 847 may also have shapes and arrangements that are enough to be accommodated in the frame part 821. In this state, both the second rotation shafts 847 connecting the upper ends of the second rods 844 may be provided.

The second rotation shaft 847 may be rotatably mounted on the scissors fixing member 826 of the upper frame 82. Here, the second rotation shaft 847 passing through the scissors fixing member 826 may further include a rotation bush 847*a*. The rotation bush 847*a* may contact the inner surface of the scissors fixing member 826 and may be made of a plastic material having excellent lubrication performance and abrasion resistance. Thus, the operation of the lifting assembly 84 may be smoothly performed.

The lower ends of the second rods 844 disposed on both sides may be connected by the second sliding shaft 842. The second sliding shaft 846 may be mounted to pass through the slide guide 835 provided in the lower frame 83 and may move along the slide guide 835 as the elevation device 80 is elevated.

Also, a second roller 844*c* may be disposed on an upper end of the second rod 844 to which the second sliding shaft 846 is connected. The second roller 844*c* may contact an inner surface of the frame part 831. When the first sliding shaft 842 moves along the slide guide 835, the first roller 841*c* may contact the inner surface of the frame part 831 to rotate. Thus, the elevation device 80 may smoothly operate even though the lower frame 83 is pressed by a weight object.

Figure 29:
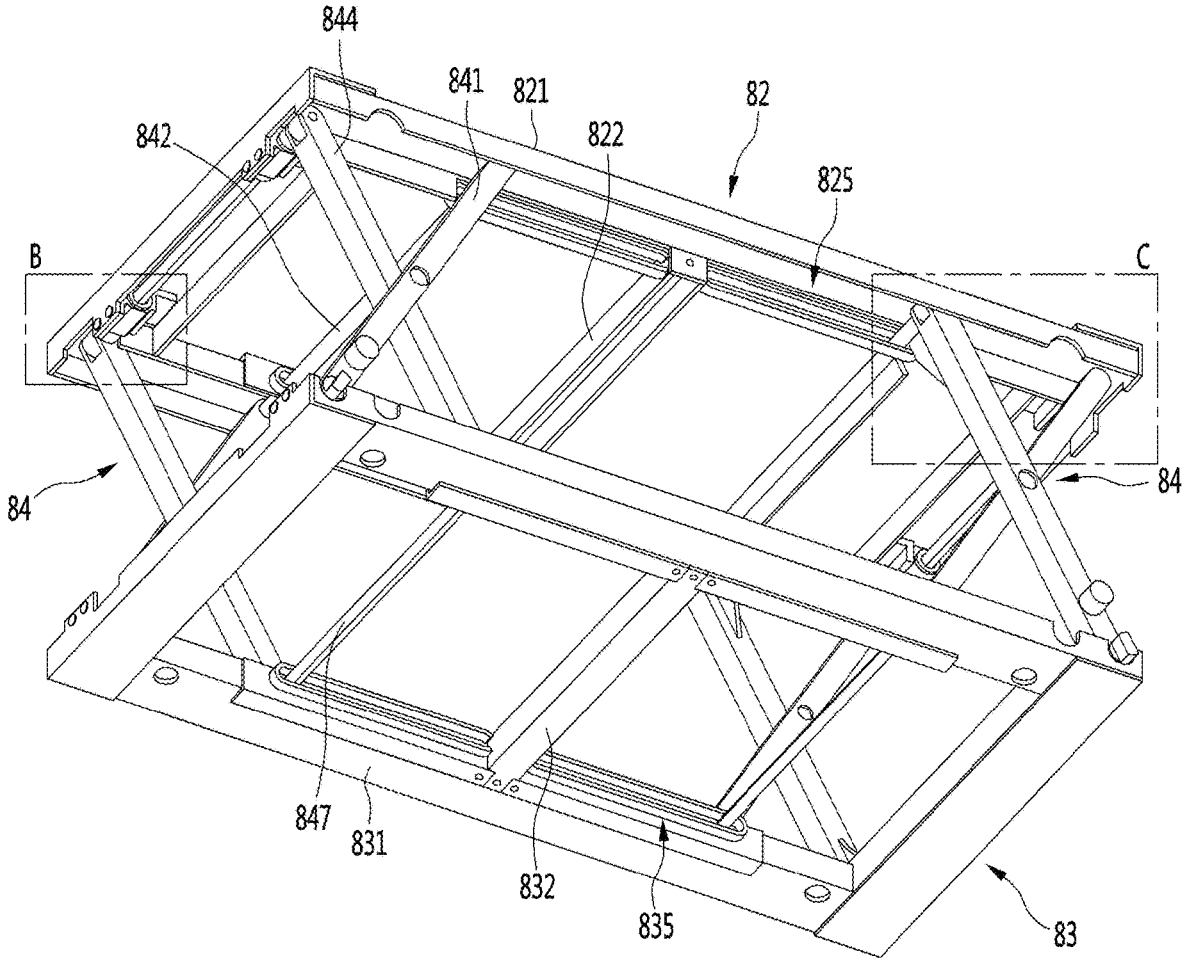
FIG. 29 is a perspective view illustrating a state in which the elevation device ascends when viewed from a lower side.
Figure 30:
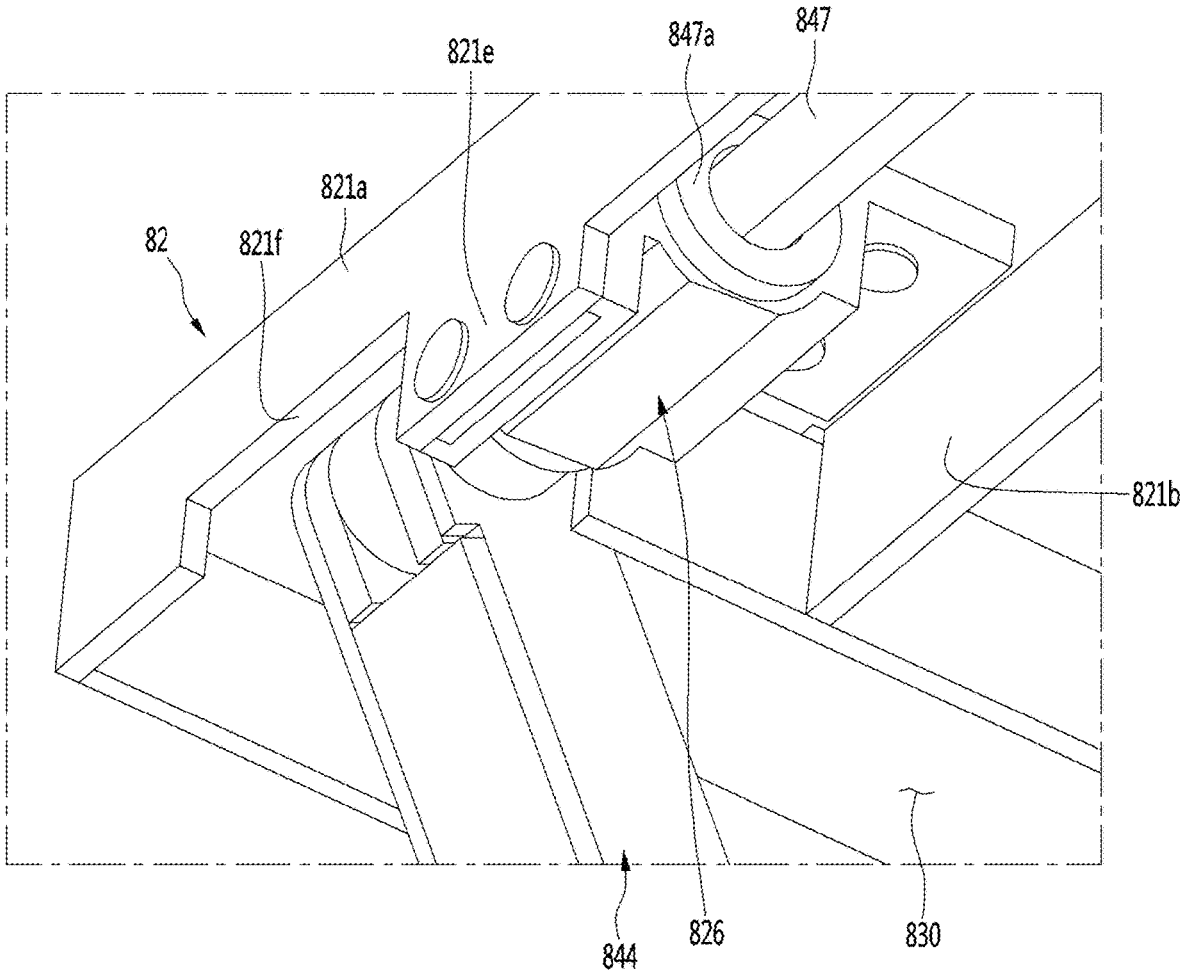
FIG. 30 is an enlarged view of a portion "B" of FIG. 29.
Figure 31:
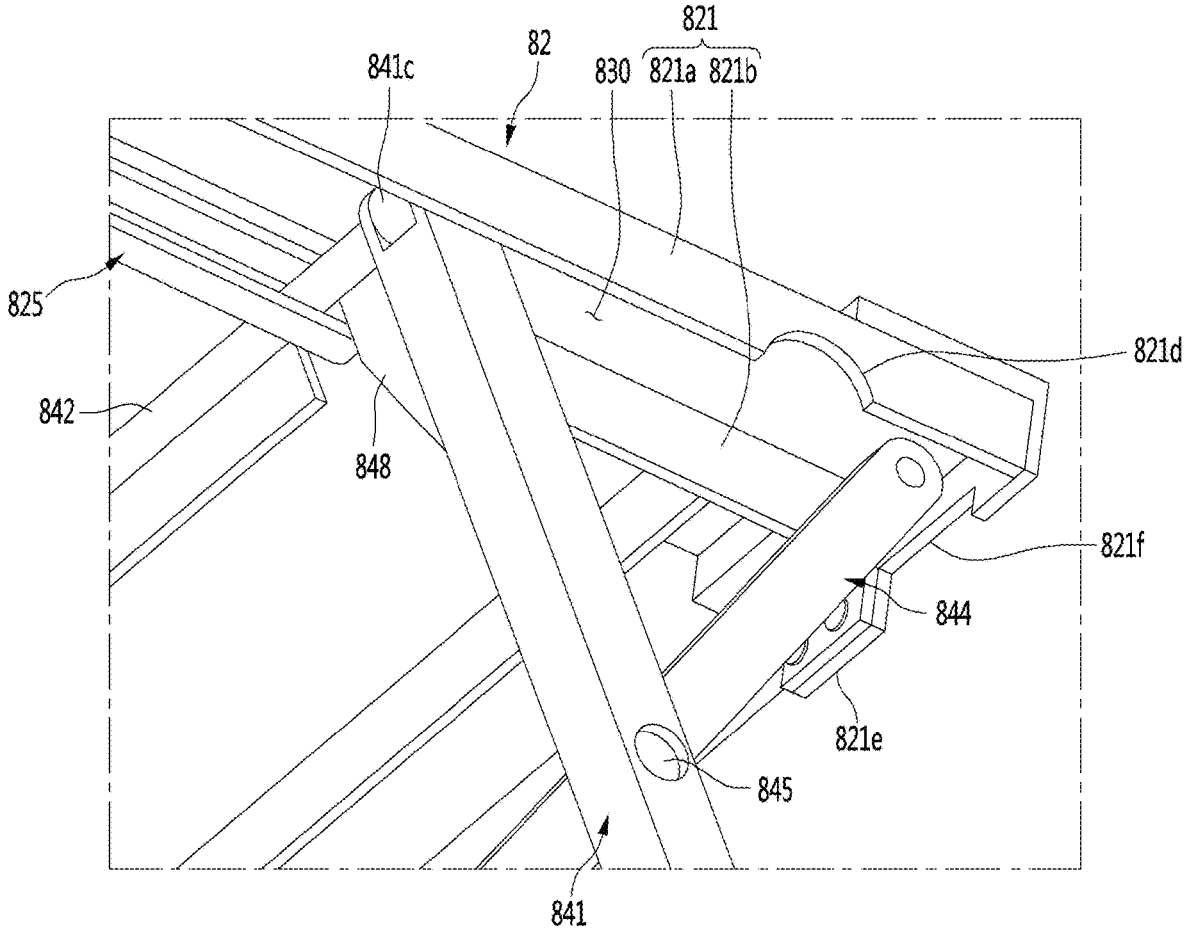
FIG. 31 is an enlarged view of a portion "C" of FIG. 29.
Figure 32:
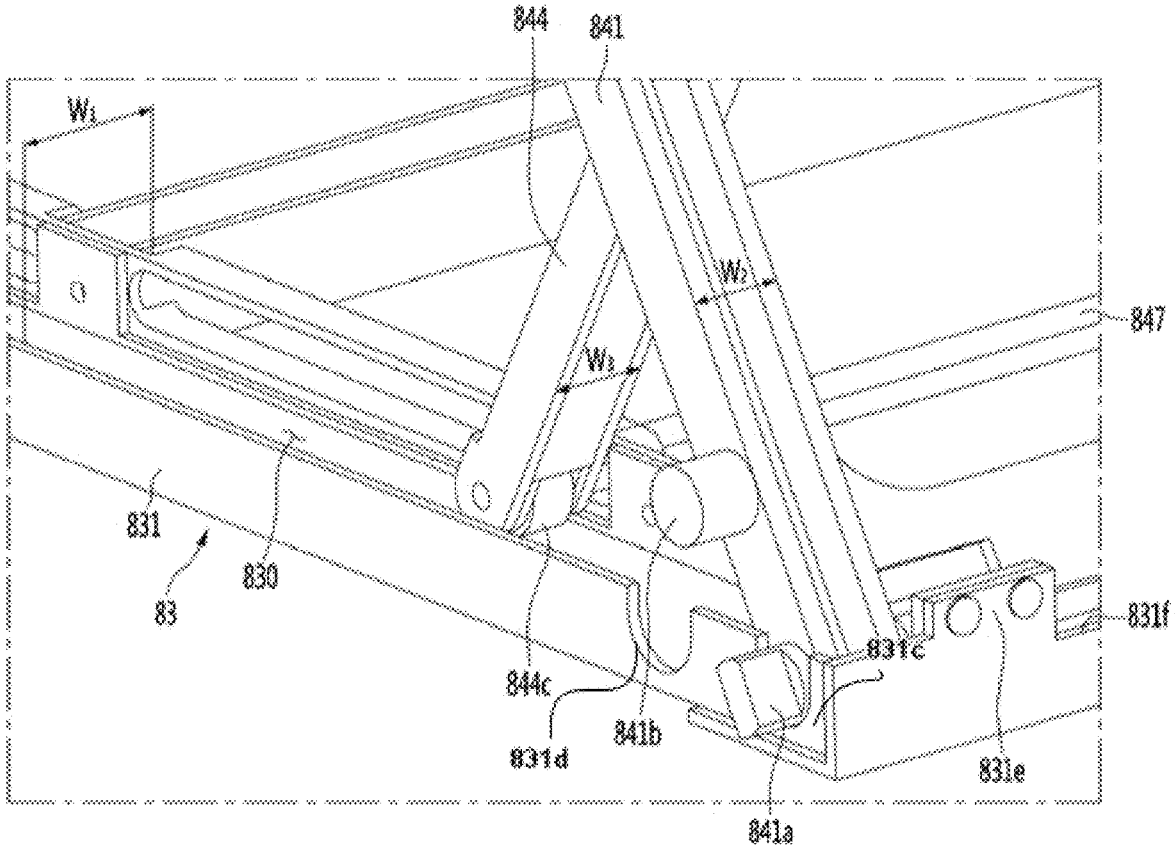
FIG. 32 is a partial perspective view of one side of a lower portion in the state in which the elevation device ascends.

FIG. 29 is a perspective view illustrating a state in which the elevation device ascends when viewed from a lower side. Also, FIG. 30 is an enlarged view of a portion "B" of FIG. 29. Also, FIG. 31 is an enlarged view of a portion "C" of FIG. 29. Also, FIG. 32 is a partial perspective view of one side of a lower portion in the state in which the elevation device ascends.

In details of the coupling structure of the lifting assembly 84, the upper frame 82, and the lower frame 83 with reference to the accompanying drawings, the lifting assembly 84 provided by coupling the first rod 841 to the second rod 844 may be disposed on both left and right sides between the upper frame 82 and the lower frame 83 and then be folded or unfolded at the same time to elevate the upper frame 82.

As illustrated in FIGS. 30 and 31, an upper end of the second rod 844 may be disposed on each of both left and right ends of the upper frame 82. Here, the upper end of the second rod 844 may be fixed and mounted in a state of being accommodated in the inner surface of the frame part 821.

Also, the second rotation shaft 847 connecting both sides of the upper end of the second rod 844 to each other may be mounted to pass through the pair of scissors fixing members 826 provided on the upper frame 82. Here, a rotation bush 847*a* may be provided between the scissors fixing member 826 and the upper frame 82 to allow the second rotation shaft 847 passing through the fixed fixing member 826 in the fixed state to rotate.

Also, the second sliding shaft 846 connecting both sides of the lower end of the first rod 841 to each other may pass through the slide guide 835 and move along the slide guide 835 when the first rod 841 rotates. Here, the first roller 841*c* on the upper end of the first rod 841 may contact the inner bottom surface of the upper frame 82, and when the first rod 841 rotates, the first roller 841*c* may be rolled in the state of contacting the inner surface of the upper frame 82.

A plate-shaped guide part 848 may be disposed on a portion at which the upper end of the first rod 841 is connected to the first sliding shaft 842. The movement of the first rod 841 in the left and right directions may be restricted by the guide part 848. That is, the first rod 841 may be spaced apart from the inner side surface of the bent inner surface of both side surfaces of the upper frame 82 by a width of the guide part 848. The guide part 848 may have a width corresponding to that of the second rod 844. Thus, when the first rod 841 and the second rod 844 are folded, the first rod 841 and the second rod 844 may be disposed in the inner space of the frame part 821 without interfering with each other.

As illustrated in FIG. 32, the lower end of the first rod 841 may be disposed on both sides of the lower frame 83 and be accommodated inside the frame part 831. Also, the first rotation shaft 843 connecting the lower end of the first rod 841 may be fixed to pass through the scissors fixing members 836 disposed on both side of the lower frame 83.

Here, since the first rod 841 is disposed outside the second rod 844, the scissors fixing member 836 disposed on the lower frame 83 may be disposed outside the scissors fixing member 826 disposed on the upper frame 82. Thus, when the upper frame 82 descends, the scissors fixing members 826 and 836 may not interfere with each other. Also, the coupling ends 821*e* and 831*e* may also be disposed inside and outside with respect to each other by the positions of the scissors fixing members 826 and 836 so as not to interfere with each other. Also, the coupling ends 821*e* and 831*e* and the coupling grooves 821*f* and 831*f* facing each other at the ends of the upper frame 82 and the lower frame 83 may have shapes corresponding to each other and may be coupled to each other when the upper frame 82 descends.

The second roller 844*c* may be provided on the lower end of the second rod 844 to maintain the contact state with the inner surface of the lower frame 834. Also, when the second sliding shaft 846 moves along the slide guide 835, the second roller 844*c* may be rolled along the inner surface of the lower frame 83 while being accommodated inside the frame part 831.

As described above, the lower end of the first rod 841 and the upper end of the second rod 844 may be fixed to the lower frame 83 and the upper frame 82 in a rotatable manner. Also, when the elevation device 80 operates, the first rod 841 and the second rod 844 may rotate. Here, the first roller 841*c* and the second roller 844*c* may rotate while contacting the upper frame 82 and the lower frame 83 so that the first and second sliding shafts 842 and 846 smoothly rotate.

The first rod 841 and the second rod 844 may be disposed inside the pair of the first rods 841. When the rod 804 completely descends, all of the first rod 841 and the second rod 844 may be accommodated in an accommodation space 830 defined by the frame parts 821 and 831.

Figure 33:
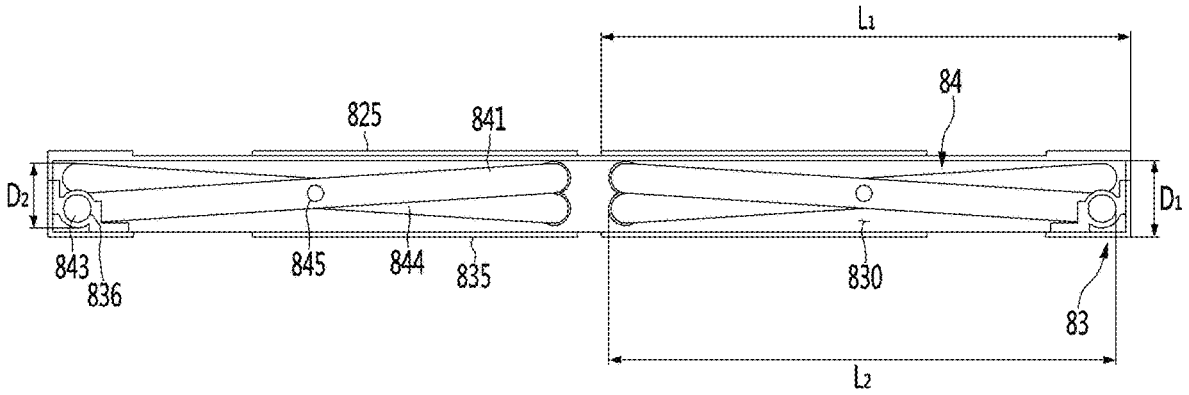
FIG. 33 is a cross-sectional view taken along line 33-33' of FIG. 23.

FIG. 33 is a cross-sectional view taken along line 33-33' of FIG. 23.

Referring to FIGS. 32 and 33, the first rod 841 may be disposed outside the second rod 844. Also, all of the ends of the first rod 841 and the second rod 844 may be accommodated inside the frame part 831 of the lower frame 83.

In detail, the first rod 841 and the second rod 844 may be disposed in parallel to each other, and the sum of a width W2 of the first rod 841 and a width W3 of the second rod 844 may correspond to or slightly less than a width of the accommodation space 830.

Thus, while the elevation device 80 operates to allow the first rod 841 and the second rod 844 to contact each other, the first rod 841 and the second rod 844 may not interfere with each other and also be completely accommodated in the frame part 831.

Also, a height of the space of each of the frame parts 821 and 831 between the upper frame 82 and the lower frame 83 in the state in which the upper frame 82 and the lower frame 83 are coupled to each other may be greater than the sum of thicknesses of the first rod 841 and the second rod 844 or a height in the state in which the first rod 841 and the second rod 844 are completely folded.

In addition, a length L2 of each of the first rod 841 and the second rod 844 may be equal to or less than a length L1 from an outer end to a central portion of each of the upper frame 82 and the lower frame 83 or a length from an outer end of each of the upper frame 82 and the lower frame 83 to each of the partition parts 822 and 832.

Due to this structure, in the state in which the upper frame 82 completely descends, the first rod 841 and the second rod 844 may be completely accommodated in the accommodation space 830 within the frame parts 821 and 831, which is defined by coupling the upper frame 82 to the lower frame 83. Here, the first rotation shaft 843 and the second rotation shaft 847 may be accommodated inside the frame parts 821 and 831, which define the left and right sides of the upper frame 82 and the lower frame 83.

Hereinafter, the selective coupling and power connection of the elevation device 80 and the connection assembly 70 will be described in more detail with reference to the drawings.

Figure 34:
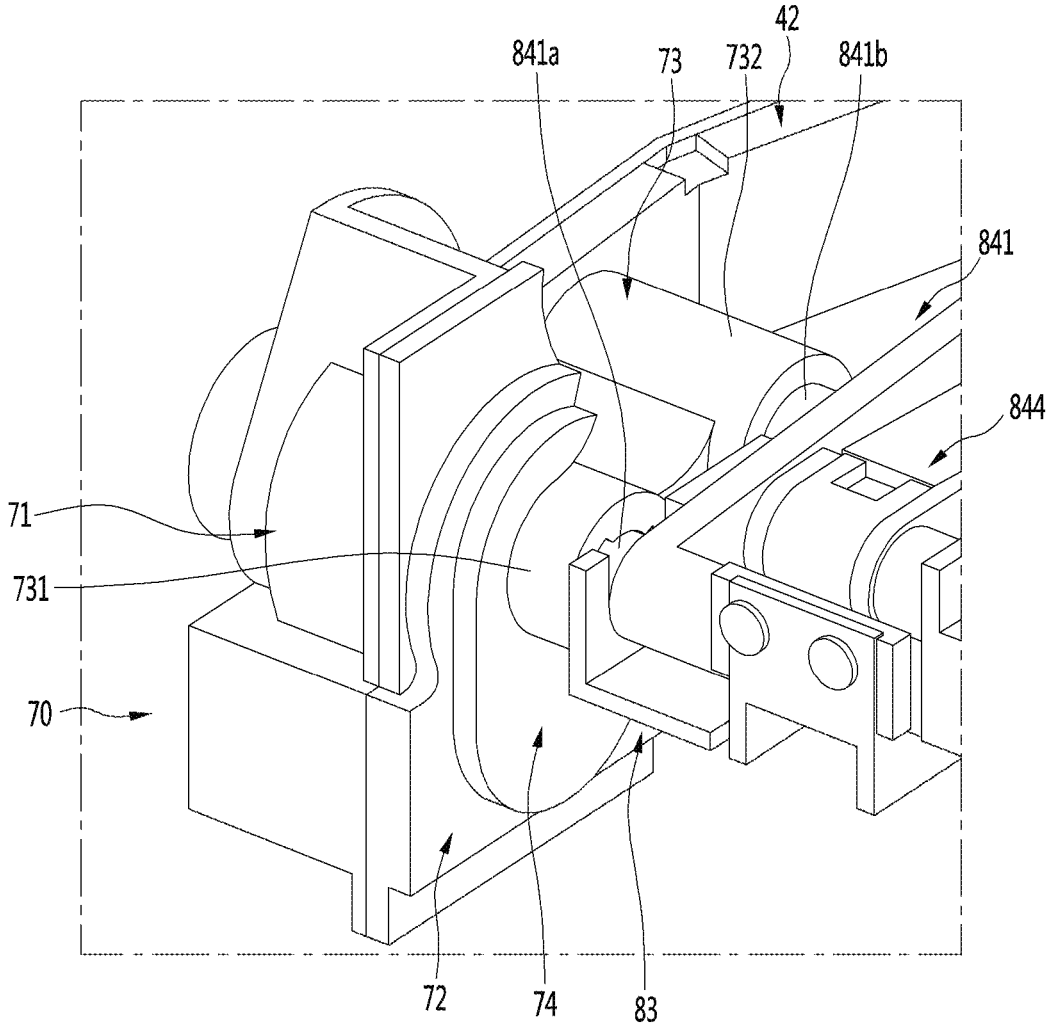
FIG. 34 is a perspective view illustrating a connection state between the connection assembly and the elevation device.
Figure 35:
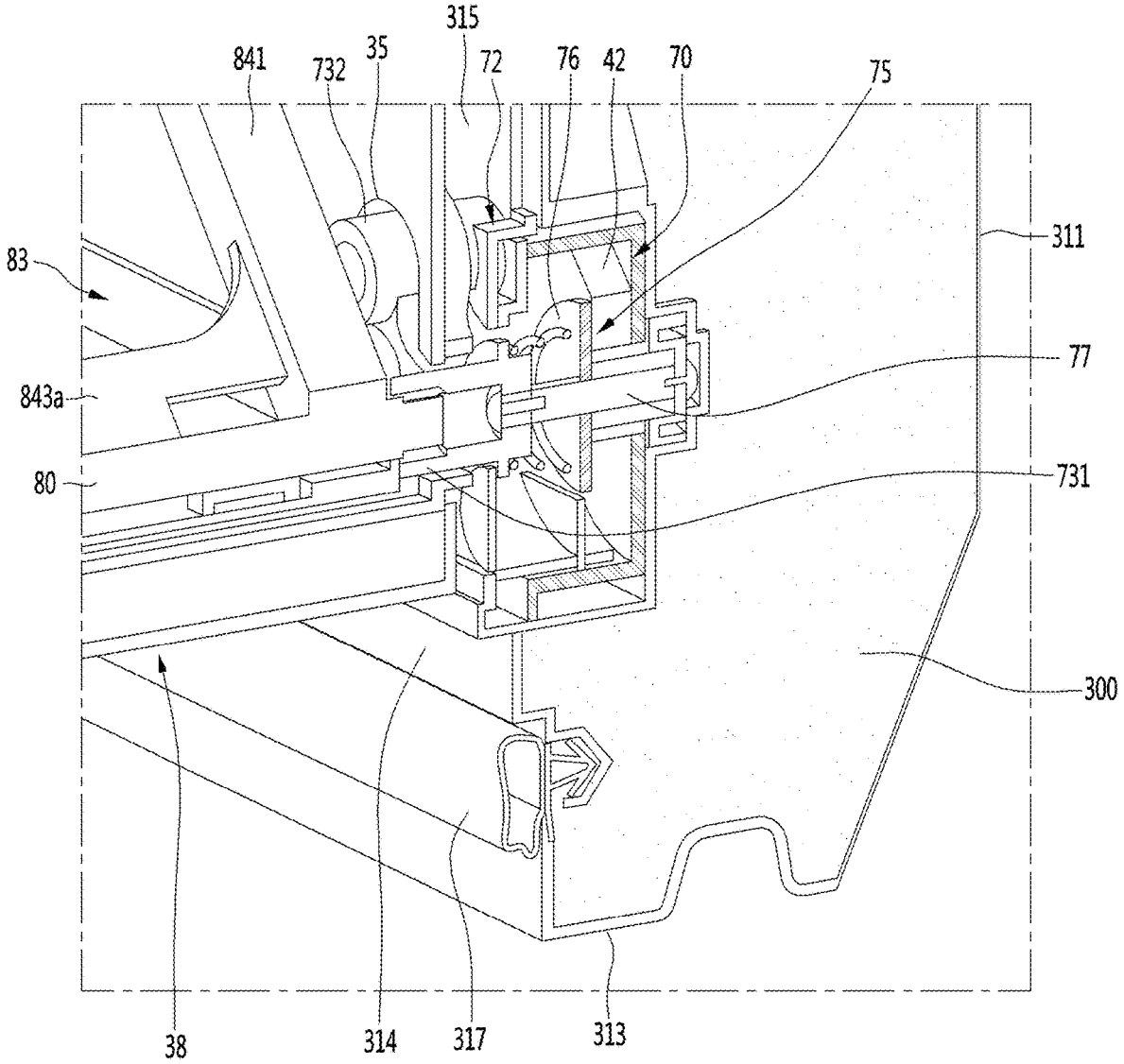
FIG. 35 is a cross-sectional view illustrating the connection state between the connection assembly and the elevation device.
Figure 36:
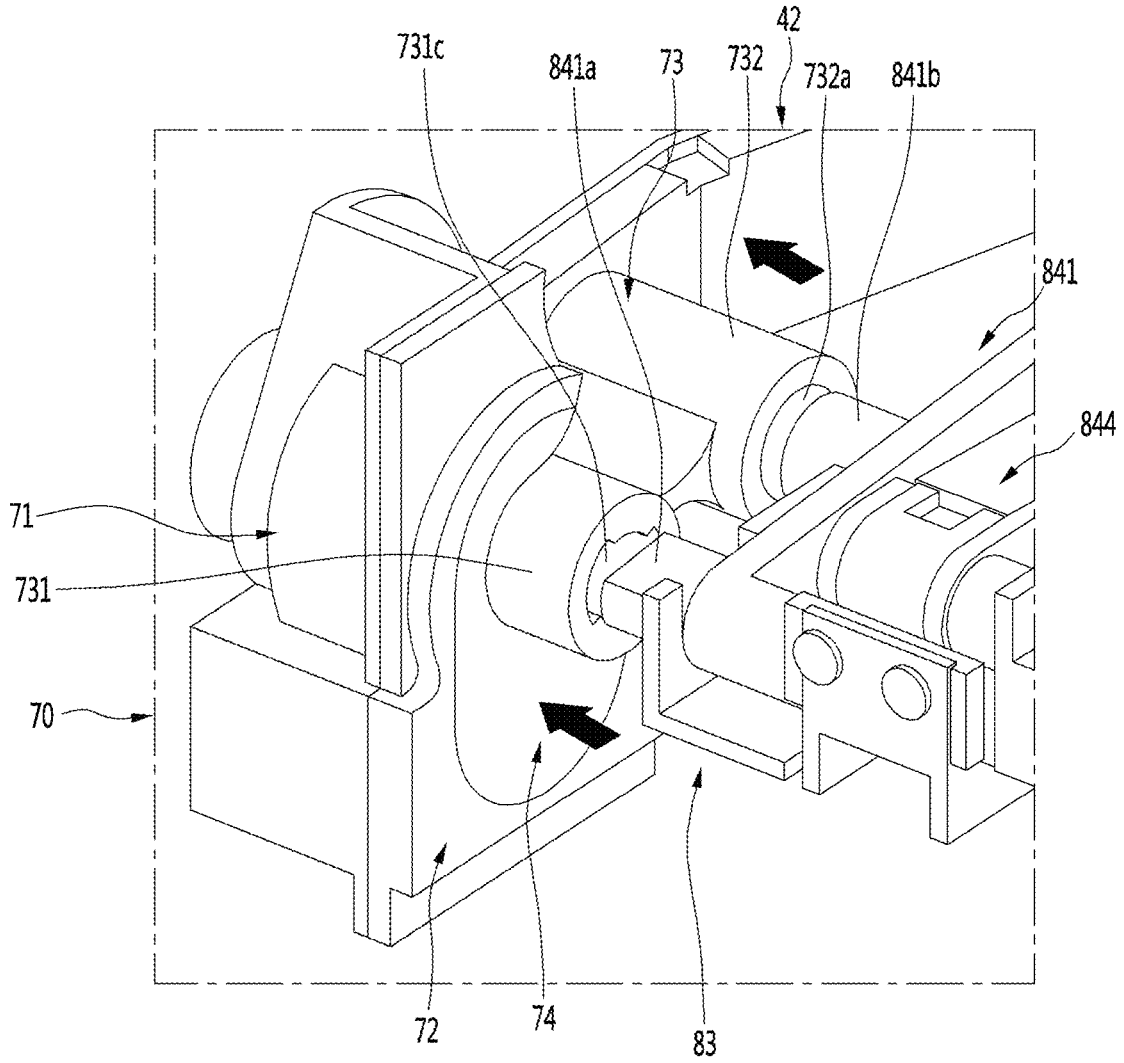
FIG. 36 is a perspective view illustrating a separation state of the connection assembly and the elevation device.

FIG. 34 is a perspective view illustrating a connection state between the connection assembly and the elevation device. Also, FIG. 35 is a cross-sectional view illustrating the connection state between the connection assembly and the elevation device. Also, FIG. 36 is a perspective view illustrating a separation state of the connection assembly and the elevation device.

As illustrated in the drawings, if the service of the driving device 40 or the elevating device 80 is necessary or if the use of the elevation device 80 is not desired, the driving device 40 and the elevation device 80 may be simply separated from and coupled to each other.

As illustrated in FIGS. 34 and 35, the front panel door part 31 and the drawer part 32 may be coupled to each other, and power transmission may be possible in the state in which the connection assembly 70 and the elevation device 80 are connected to each other. Here, the connection member 73 may be connected to the lever 42 and the elevation device 80, and the first connection part 731 may be connected to the fixing shaft 77 and the rod protrusion 841*a* of the elevation device 80. The lever protrusion 425 and the scissors protrusion 841*b* may be inserted into the second connection part 732.

In this state, when the lever 42 rotates by the operation of the driving device 40, the rod protrusion 841*a* of the elevation device 80 may rotate by the first connection part 731, and the lifting assembly 84 of the elevation device 80 may rotate.

Here, since the second connection part 732 is connected to the scissors protrusion 841*b* of the elevation device 80, greater force may be transmitted to the elevation device 80. In detail, the second connection part 732 may be disposed at a position away from the first connection part 731, and thus when the first connection part 731 rotates around the shaft, a moment similar to a leverage may be applied to the second connection part 732. Thus, a moment greater than the moment generated at the first connection part 731 may be applied together with the second connection part 732, and thus the elevation device 80 may rotate with larger force.

Furthermore, since the pair of scissors assemblies 84 are disposed on both sides of the lifting assembly 84, the power may be transmitted to the lifting assembly 84, thereby effectively elevating the elevation device 80 with less force.

The connection member 73 may have a single shaft structure that connects the lever 42 to the rod protrusion 841*a* of the elevation device 80 when the torque by the driving device 40 is sufficient. The lifting assembly 84 may also be configured so that the connection member 73 is connected to each of both sides of one of the scissors assemblies 84 to elevate the elevation device 80.

The user may push the push member 74 of the connection assembly 70 to push the connection member 73 in the state in which the service condition of the driving device or the elevating device 80 of the refrigerator 1 occurs. The coupling between the connection member 73 and the elevation device 80 may be released by allowing the connection member 73 to move forward.

In this state, the front panel door part 31 may be separated from the drawer part 32, and the entire driving part 40 provided in the front panel door part 31 may be completely separated from the drawer part 32 by a single operation.

The driving part 40 may be maintained in the state in which the front panel door part 31 is separated, and the front panel door part 31, which normally operates as necessary, may be replaced to be mounted. Here, the connection member 73 of the front panel door part 31 may be coupled to the rod protrusion 841*a* and the scissors protrusion 841*b* of the elevation device without separate assembly and disassembly.

The front panel door part 31 and the drawer part 32 may be rigidly coupled to each other by the door frame or other structure, and the front panel door part 31 and the drawer part 32 may be additionally separated from or coupled to each other when the front panel door part 31 and the drawer part 32 are separated from or coupled to each other.

Hereinafter, a state in which the door 30 of the refrigerator 1 is inserted and withdrawn and is elevated according to an embodiment will be described in more detail with reference to the accompanying drawings.

Figure 37:
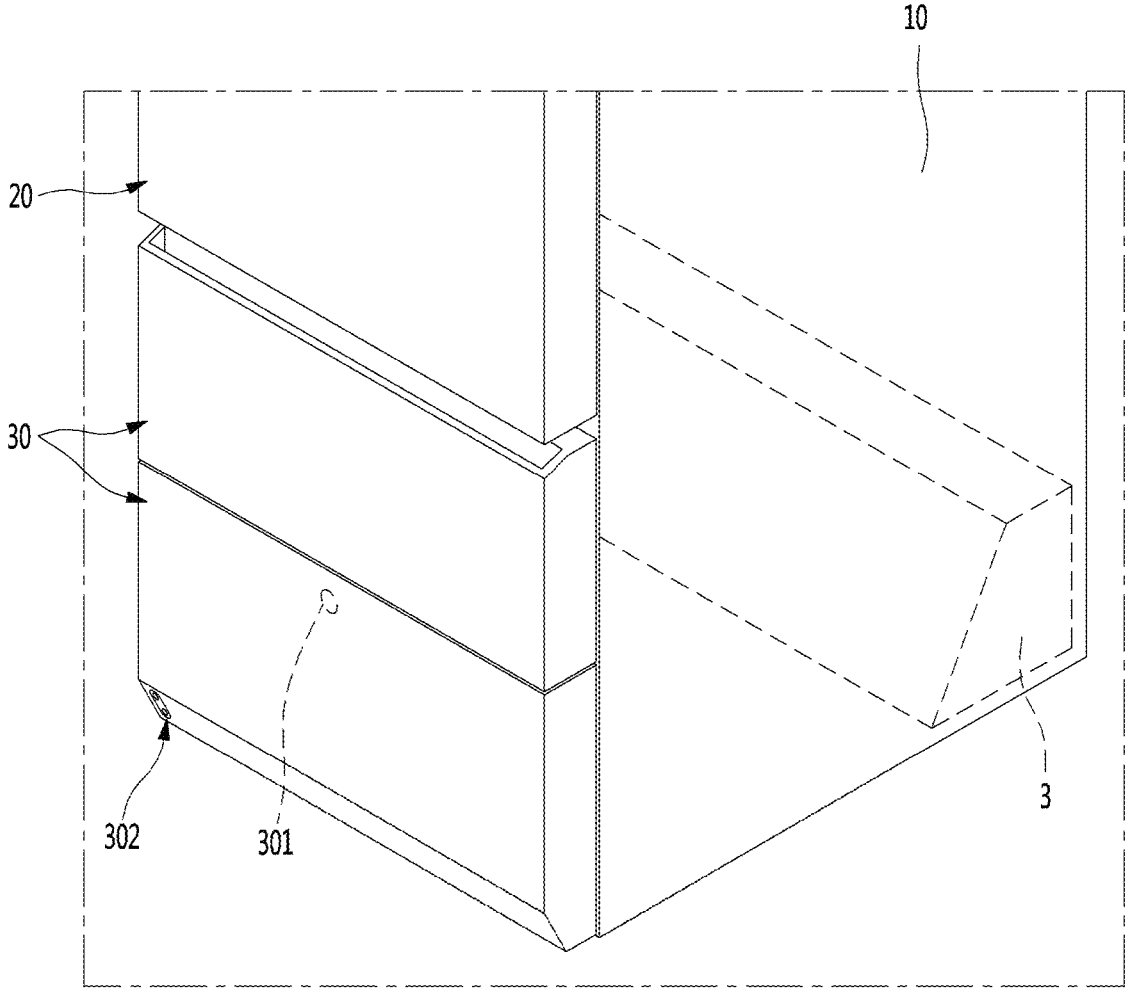
FIG. 37 is a perspective view illustrating a state in which the drawer door is closed.

FIG. 37 is a perspective view illustrating a state in which the drawer door is closed.

As illustrated in the drawing, in the state in which the food is stored, the refrigerator 1 may be maintained in a state in which all of the rotation door 20 and the door 30 are closed. In this state, the user may withdraw the door 30 to accommodate the food.

The door 30 may be provided in plurality in a vertical direction and be withdrawn to be opened by the user's manipulation. Here, the user's manipulation may be performed by touching the manipulation part 301 disposed on the front surface of the rotation door 20 or the door 30. Alternatively, an opening command may be inputted on the manipulation device 302 provided on the lower end of the door 30. Also, the manipulation part 301 and the manipulation device 302 may individually manipulate the insertion and withdrawal of the door 30 and the elevation of the elevation member frame space 830. Alternatively, the user may hold a handle of the door 30 to open the drawer door 30.

Hereinafter, although the lowermost door 30 of the doors 30, which are disposed in the vertical direction, is opened and elevated as an example, all of the upper and lower doors 30 may be inserted and withdrawn and elevated in the same manner.

Figure 38:
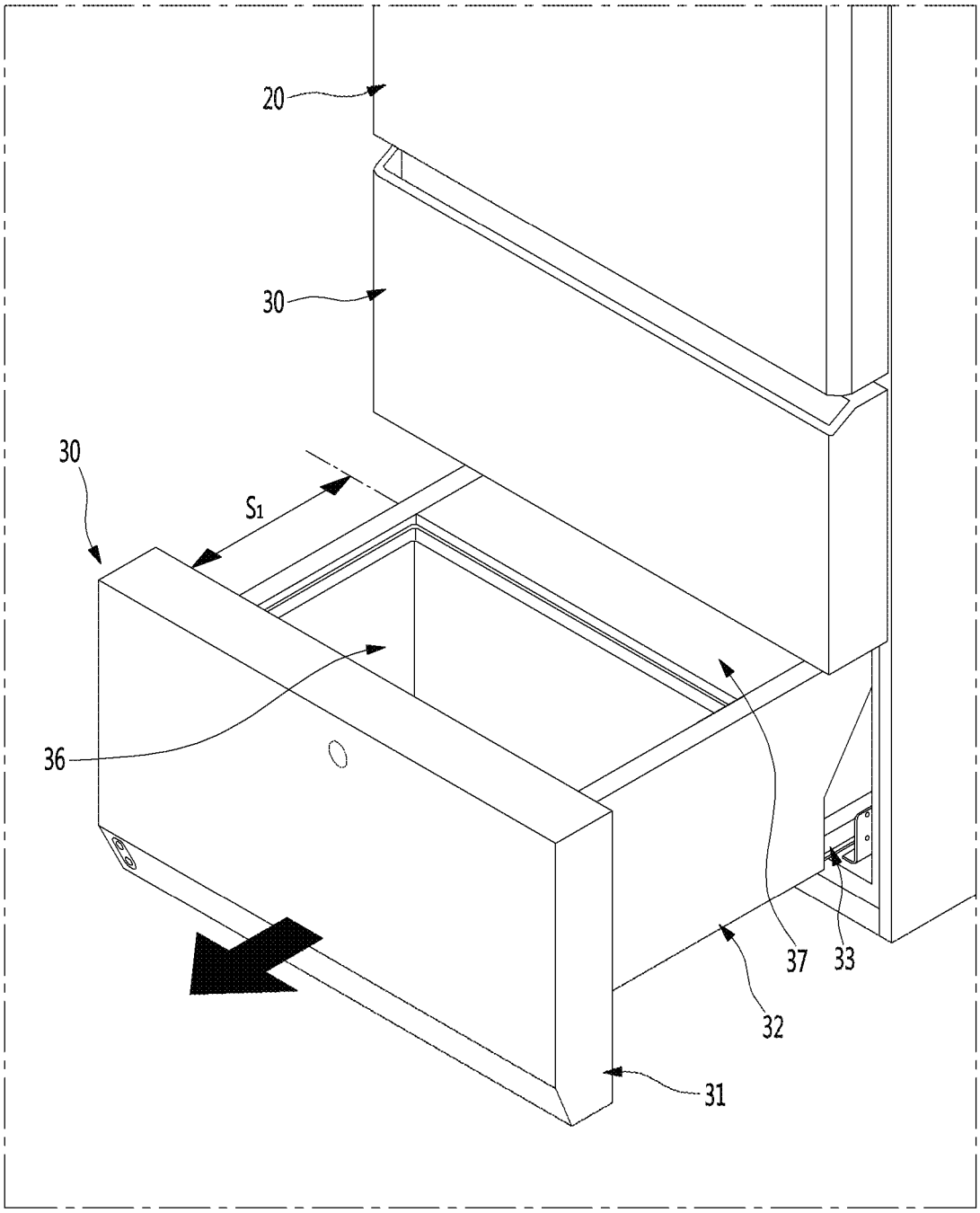
FIG. 38 is a perspective view illustrating a state in which the drawer door is completely opened.
Figure 39:
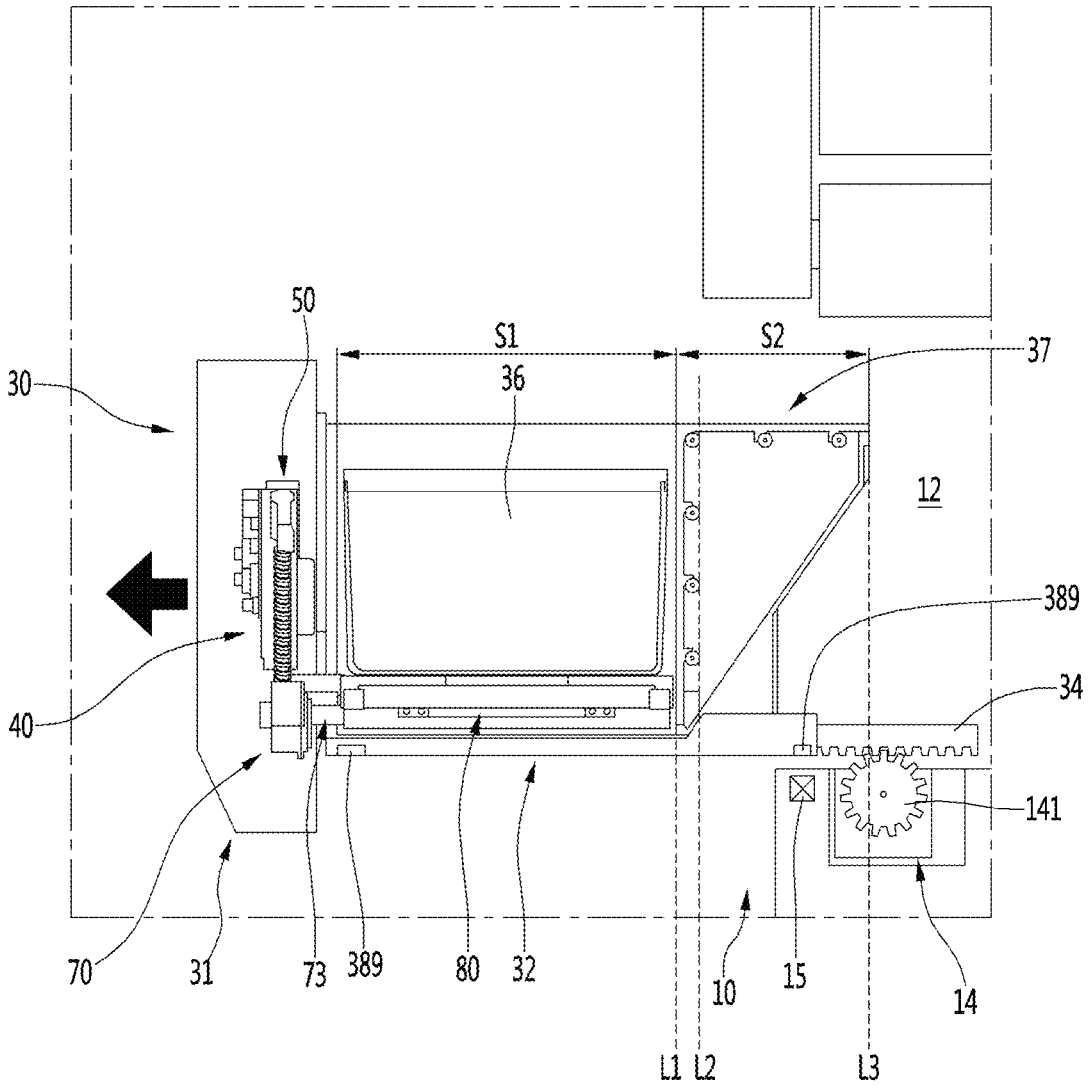
FIG. 39 is a cross-sectional view illustrating a state of the drawer door in a state in which the basket of the drawer door completely descends.

FIG. 38 is a perspective view illustrating a state in which the drawer door is completely opened. Also, FIG. 39 is a cross-sectional view illustrating a state of the drawer door in a state in which the basket of the drawer door completely descends.

As illustrated in the drawings, the user may manipulate the draw-out operation on the door 30 to withdraw the door 30 forward. The door 30 may be withdrawn while the draw-out rail 33 extends.

The door 30 may be configured to be inserted and withdrawn by the driving of the draw-out motor 14, not by a method of directly pulling the door 30 by the user. The draw-out rack 34 provided on the bottom surface of the door 30 may be coupled to the pinion gear 141 rotating when the draw-out motor 14 provided in the cabinet 10 is driven. Thus, the door 30 may be inserted and withdrawn according to the driving of the draw-out motor 14.

The draw-out distance of the door 30 may correspond to a distance at which the front space S1 within the doo 30 is completely exposed to the outside. Thus, in this state, when the elevation device 80 is elevated, the container or the food may not interfere with the doors 20 and 30 or the cabinet 10 disposed thereabove.

Here, draw-out distance of the door 30 may be determined by a draw-out detection device 15 disposed on the cabinet 10 and/or the door 30. The draw-out detection device 15 may be provided as a detection sensor that detects a magnet 389 to detect a state in which the door 30 is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the door 30 is closed and a position of the magnet 389 when the door 30 is completely withdrawn. Thus, the draw-out state of the door 30 may be determined by the draw-out detection device 15.

Also, as necessary, a switch may be provided at each of positions at which the door 30 is completely inserted and withdrawn detect the draw-out state of the door 30. In addition, the draw-out state of the door 30 may be detected by counting the rotation number of draw-out motor 14 or measuring a distance between the rear surface of the front panel door part 31 and the front end of the cabinet 10.

In the state in which the door 30 is completely withdrawn, the elevation motor 64 may be driven to elevate the elevation device 80. The elevation device 80 may be driven in an even situation in which the door 30 is sufficiently withdrawn to secure safe elevation of the food or container 36 seated on the elevation device 80.

That is, in the state in which the door 30 is withdrawn to completely expose the front space S1 to the outside, the elevation device 80 may ascend to prevent the container 36 or the stored food seated on the elevation device 80 from interfering with the doors 20 and 30 or the cabinet 10.

In details of the draw-out state of the door 30, the front space S1 has to be completely withdrawn to the outside of the lower storage space 12 in the state in which the door 30 is withdrawn for the elevation.

Particularly, the rear end L1 of the front space S1 has to be more withdrawn than the front end L2 of the cabinet 10 or the upper door 20. Also, the rear end L1 of the front space S1 is disposed at a further front side than the front end L2 of the cabinet 10 or the door 20 so at to prevent the elevation device 80 from interfering when the elevation device 80 is elevated.

Also, when the elevating device 80 is completely withdrawn to be driven, the entire drawer part 32 may not be completely withdrawn but withdrawn up to only a position for avoiding interference when the elevating device 80 is elevated as illustrated in FIG. 39. Here, at least a portion of the rear space S2 of the drawer part 32 may be disposed inside the lower storage space 12. That is, the rear end L3 of the drawer part 32 may be disposed at least inside the lower storage space 12.

Thus, even when the weight of the stored object is added to the weight of the door 30 itself including the driving device 40 and the elevation device 80, the deflection or damage of the draw-out rail 33 or the door 30 itself may not occur to secure the reliable draw-out operation.

The ascending of the elevation device 80 may start in a state in which the door 30 is completely withdrawn. Also, to secure the user's safety and prevent the food from being damaged, the ascending of the elevation device 80 may start after a set time elapses after the door 30 is completely withdrawn.

After the door 30 is completely withdrawn, the user may manipulate the manipulation part 301 to input the ascending of the elevation device 80. That is, the manipulation part 301 may be manipulated to withdraw the door 30, and the manipulation part 301 may be manipulated again to elevate the elevation device 80.

Also, in the state in which the door 30 is manually inserted and withdrawn, the manipulation part 301 may be manipulated to elevate the elevation device 80.

As illustrated in FIG. 39, the driving device 40 and the elevation device 80 may not operate until the door 30 is completely withdrawn, and the elevation device 80 may be maintained in the lowest state.

Figure 40:
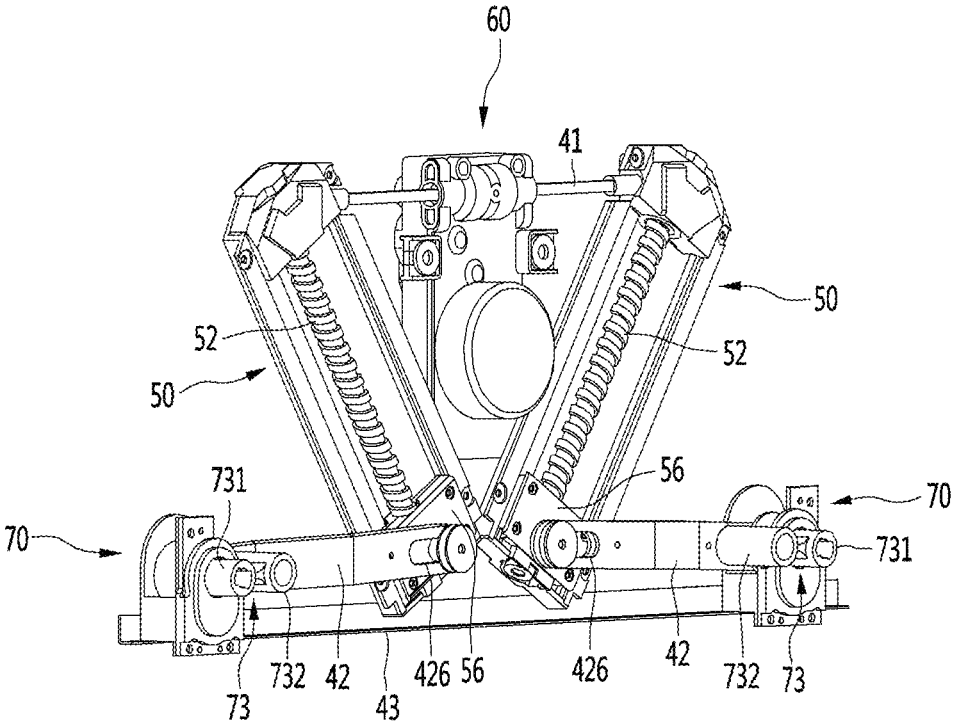
FIG. 40 is a perspective view illustrating a state of the driving device in the state in which the basket of the drawer door completely descends.

FIG. 40 is a perspective view illustrating a state of the driving device in the state in which the basket of the drawer door completely descends. Also, FIG. 41 is a perspective view illustrating a state of the driving device in the state in which the basket of the drawer door completely descends.

As illustrated in the drawings, when a signal for operating the driving device 40 is not input, the driving device 40 may not operate to maintain the elevation device 80 at the lowest state.

In this state, the driving device 40 may not operate, and the screw holder 56 may be disposed at the lowest position of the screw 52 as illustrated in FIG. 32. Also, the lever 42 may not also rotate, and the first connection part 731 and the second connection part 732 of the connecting member 73 may be disposed on the same height.

Figure 41:
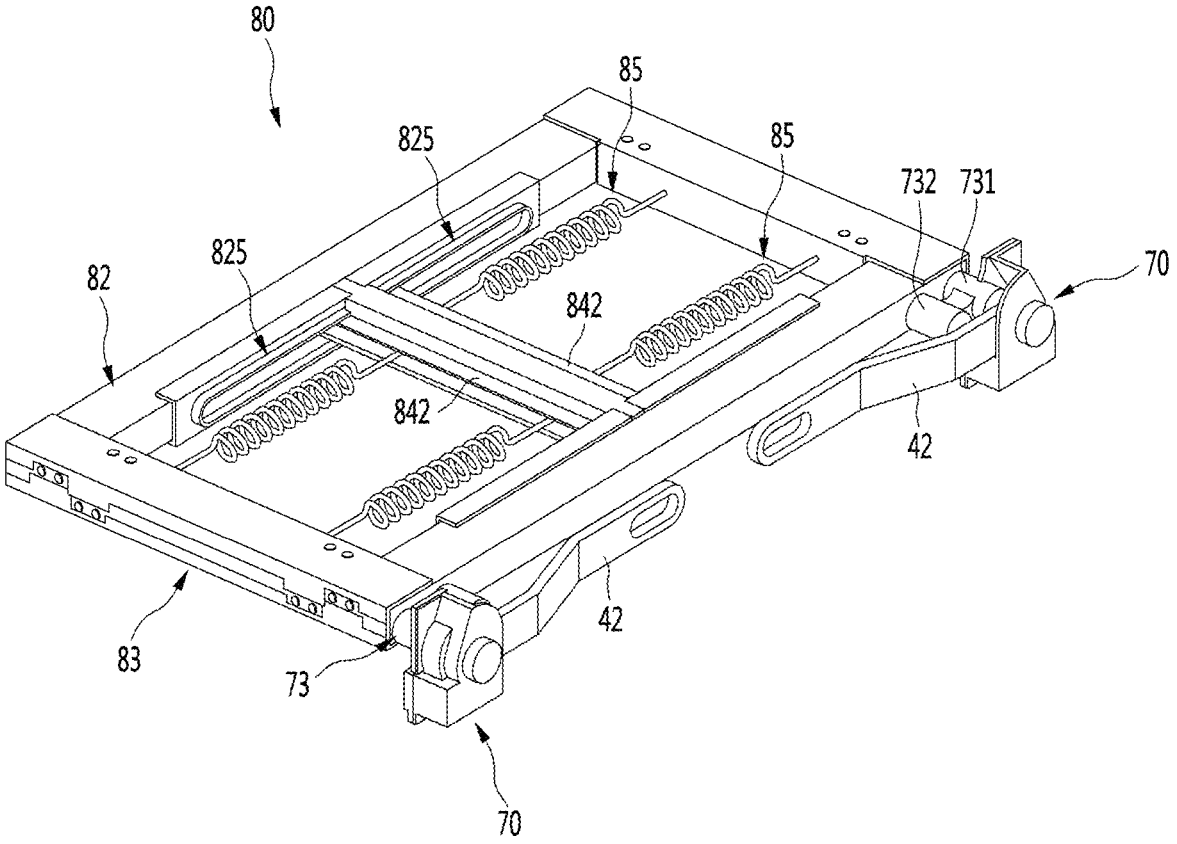
FIG. 41 is a perspective view illustrating a state of the elevation device in the state in which the basket of the drawer door completely descends.

The elevation device 80 may maintain the current state as long as the upper frame 82 is in the lowest state as shown in FIG. 41, and the driving device 40 may not operate.

In this state, the upper frame 82 and the lower frame 83 may contact each other, and the lifting assembly 84 may be accommodated in the upper frame 82 and the lower frame 83.

Here, no external force may be applied to the rod protrusion 841*a* and the scissors protrusion 841*b* of the elevation device 80 connected to the connection assembly 70 because the lever 42 does not operate.

The end of the frame part 821 and the sliding shaft 842 may be farthest away from each other, and the scissors elastic member 85 may be in the maximum tensioned state. Thus, the upper frame 82 may be elevated more effectively by the restoring force of the scissors elastic member 85 in addition to the power transmission by the driving device 40 when the driving device 40 is started to be driven.

A signal input for the elevation by the user may be waited while maintaining the above-described state, and the driving device 40 may operate when the user input the elevation manipulation.

Figure 42:
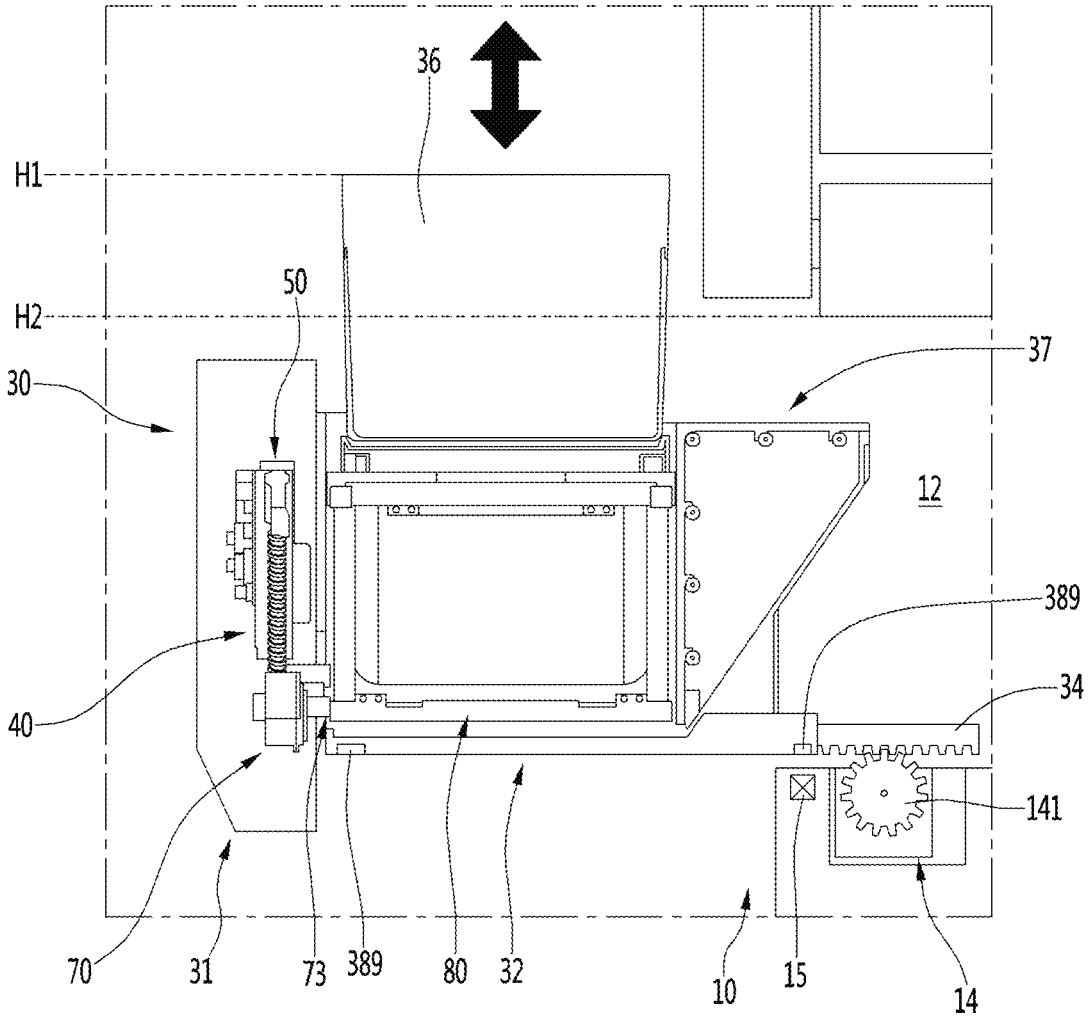
FIG. 42 is a cross-sectional view illustrating a state of the drawer door in a state in which the basket of the drawer door completely ascends.

FIG. 42 is a cross-sectional view illustrating a state of the drawer door in a state in which the basket of the drawer door completely ascends.

As illustrated in FIG. 39, in the state in which the door 30 is withdrawn, when the operation signal of the driving device is inputted, the driving device 40 may operate, and the state as illustrated in FIG. 42 may be obtained by elevating the elevation device 80.

The driving device 40 may be connected to the elevation device 80 by the connection assembly 70 so that the power is transmitted to the elevation device 80. The power may be transmitted to the elevation device 80 by the connection assembly 70 together with the operation of the driving device 40, and the elevation device 80 may start to ascend.

The elevation device 80 may continuously ascend and then be stopped when ascend to a sufficient height to facilitate access to the food or container 36 seated on the elevation device 80 as illustrated in FIG. 34. In this state, the user may easily lift the food or container 36 without overtaxing the waist.

When the elevation completion signal of the elevation device 80 is inputted, the driving of the driving motor 64 may be stopped. For this, a height detection device 16 capable of detecting the position of the elevation device 80 may be provided. The height detection device 16 may be provided on the front panel door part 31 and may be disposed at a position corresponding to the maximum height of the elevation device 80 and at a position corresponding to the lowest height of the elevation device 80.

The height detection device 16 may be provided as a detection sensor that detects a magnet 389. The height detection device 16 may detect the magnet 389 disposed on the elevation device 80 to determine whether the ascending of the elevation device 80 is completed. Also, the height detection device 16 may be provided as a switch structure to turn on the switch when the elevation device 80 maximally ascends. Also, the height detection device 16 may be provided on the elevation rail 44 or the screw 52 to detect the maximally ascending position of the elevation device 80.

Also, whether the elevation device 80 maximally ascends may be determined according to a variation in load applied to the elevation motor 64.

The driving of the elevation motor 64 is stopped in the state in which the elevation device 80 maximally ascends. In this state, although the elevation device 80 is disposed inside the drawer part 32, the food or container 36 seated on the elevation device 80 may be disposed at a position higher than the opened top surface of the drawer part 32. Thus, the user may easily access the food or container 36. Particularly, it is not necessary to allow the waist excessively for lifting the container 36, so that it is possible to perform safer and more convenient operation.

In details of the maximally ascending state of the elevation device 80, the elevation device 80 may be elevated by driving the driving device 40 and be disposed at least at a lower position than the upper end of the drawer part 32.

In the elevation device 80, when viewed with respect to the container 36 in the state in which the container 36 is seated, the upper end H1 of the container 36 may ascend to a position higher than the upper end H2 of the lower storage space 12. Here, the height of the container 36 may reach a height suitable for the user to reach the container 36 without stretching his/her waist.

That is, the driving device 40 may have a structure in which the container 36 ascends from the inside of the drawer part 32. However, when the container 36 is mounted on the elevation device 80, the container 36 may be disposed at an accessible height.

After the user's food storing operation is completed, the user may allow the elevation device 80 to descend by manipulating the manipulation part 301. The descending of the elevation device 80 may be performed by reverse rotation of the elevation motor 64 and may be gradually performed through the reverse procedure with respect to the above-described procedure.

Also, when the descending of the elevation device 80 is completed, i.e., in the state of FIG. 39, the completion of the descending of the elevation device 80 may be performed by the height detection device 16. The height detection device 16 may be further provided at a position that detects the magnet disposed on the elevation device 80 when the elevation device 80 is disposed at the lowermost descending position. Thus, when the completion of the descending of the elevation device 80 is detected, the driving of the driving device 40 is stopped.

Also, after the driving of the elevation motor 64 is stopped, the door 30 may be inserted. Here, the door 30 may be closed by the user's manipulation or by the driving of the draw-out motor 14. When the door 30 is completely closed, a state of FIG. 29 may become.

Hereinafter, a state in which the elevation device 80 is elevated by the operation of the driving device will be described.

Figure 43:
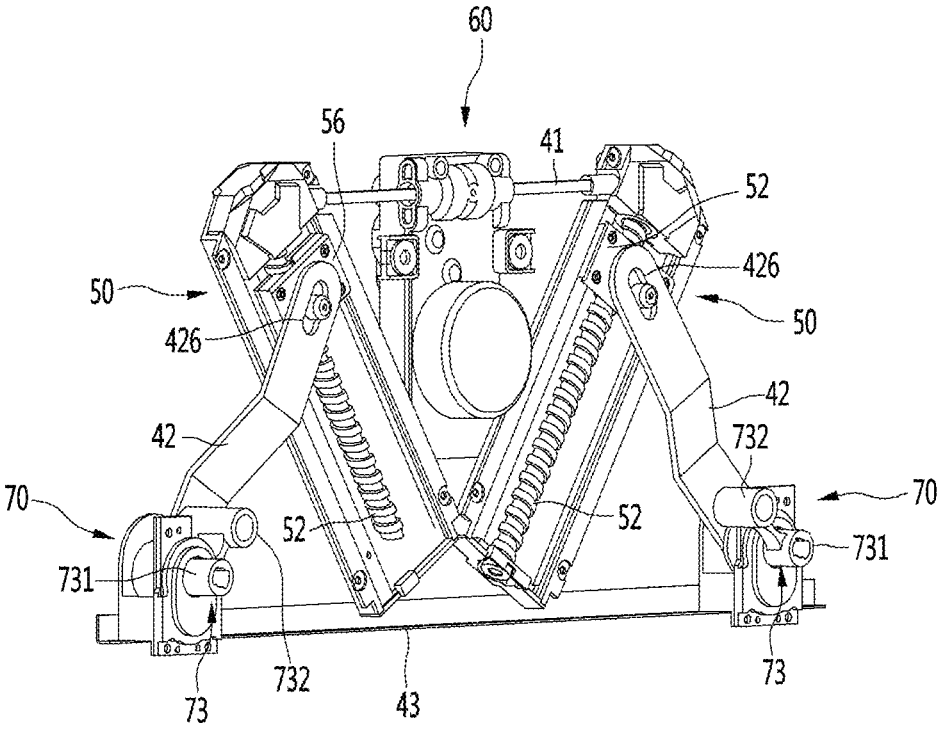
FIG. 43 is a perspective view illustrating a state of the driving device in the state in which the basket of the drawer door completely ascends.
Figure 44:
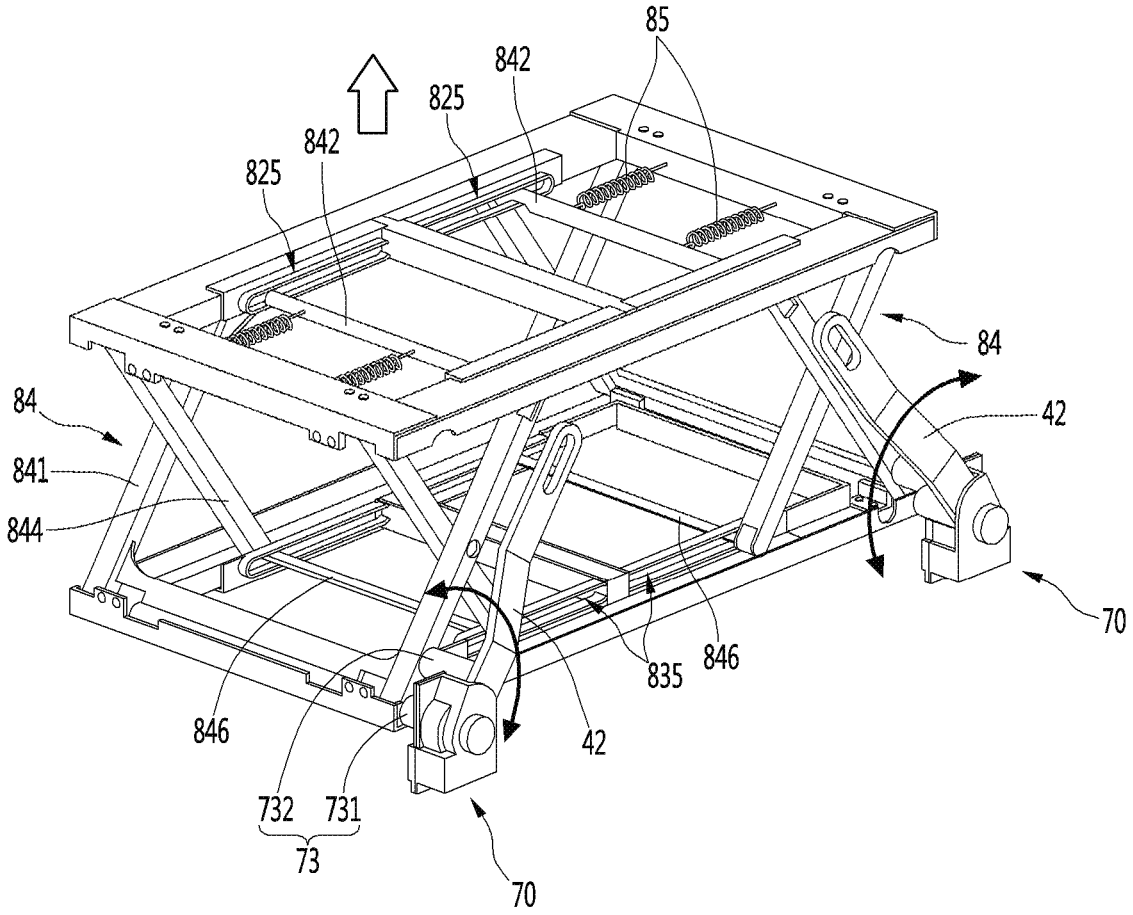
FIG. 44 is a perspective view illustrating a state of the elevation device in the state in which the basket of the drawer door completely ascends.

FIG. 43 is a perspective view illustrating a state of the driving device in the state in which the basket of the drawer door completely ascends. Also, FIG. 44 is a perspective view illustrating a state of the elevation device in the state in which the basket of the drawer door completely ascends.

As illustrated in the drawings, when the driving motor 64 rotates in the normal or reverse direction by the ascending/descending signal of the elevation device 80, the operation of the driving device 40 may start.

In details of the ascending operation of the elevation device 80, the shaft 41 may rotate by the operation of the driving motor 64. The shaft gear 412 on both sides of the shaft 41 and the screw gear 53 may rotate in the state of being engaged with each other by the rotation of the shaft 41, the screw 52 may rotate.

Here, both the shaft gears 412 may be connected to both ends of the shaft 41 to rotate. Thus, the same rotation force may be transmitted to the both the screw assemblies 50. Also, in the screw assembly 50 having the same structure, the screw 52 may rotate at the same rotational speed, and the screw holder 56 may ascend by the same height at the same time.

As the screw holder 56 ascends, the lever 42 connected to the screw holder 56 may also rotate. The lever 42 may continuously rotate in the state of being axially coupled to the connection assembly 70, and the connection member 73 connected to the lever 42 may also rotate together with the rotation of the lever 42.

The connection member 73 may be connected to the lever protrusion 425 at a position apart from the rotation shaft of the lever 42 as well as the rotation shaft of the lever 42 by the lever protrusion 425. Thus, the elevation device 80 connected to the connection member 73 and the connecting member 73 may rotate with a larger moment.

The rod protrusion 841*a* of the elevation device 80 and the scissors protrusion 841*b* may be coupled to the first connection part 731 and the second connection part 732 of the connection member 73. The rotational force may be transmitted to the first rod 841 of the lifting assembly 84 by rotation of the lifting assembly 84 so that the lifting assembly 84 is more effectively unfolded.

As the lifting assembly 84 is unfolded, the sliding shaft 842 may move toward the frame part 821 at a position adjacent to the side of the partition part 822, and the first rod 841 and the second rod 844 may rotate in the direction in which an angle gradually increases.

The sliding shaft 842 may be connected to the frame part 821 at the facing position by the scissors elastic member 85 and the restoring force of the scissors elastic member 85 may allow the sliding shaft 842 to move toward the frame part 821. Thus, it is possible to assist the elevation of the elevating device 80.

As a result, the lifting assembly 84 may be unfolded so that the upper frame 82 may ascend, and the container 36 or the food placed on the support plate 81 may ascend and finally the elevation device 80 may ascend to its maximum height as illustrated in FIG. 44.

In this state, when the driving device 40 is stopped, and the user allows the elevating device 80 to move downward after storing the food, the driving motor 64 may rotate in the reverse direction and operate in the reverse order, and thus, the elevation device 80 may descend and then be in the state as illustrated in FIG. 39.

In addition to the foregoing embodiment, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

Figure 45:
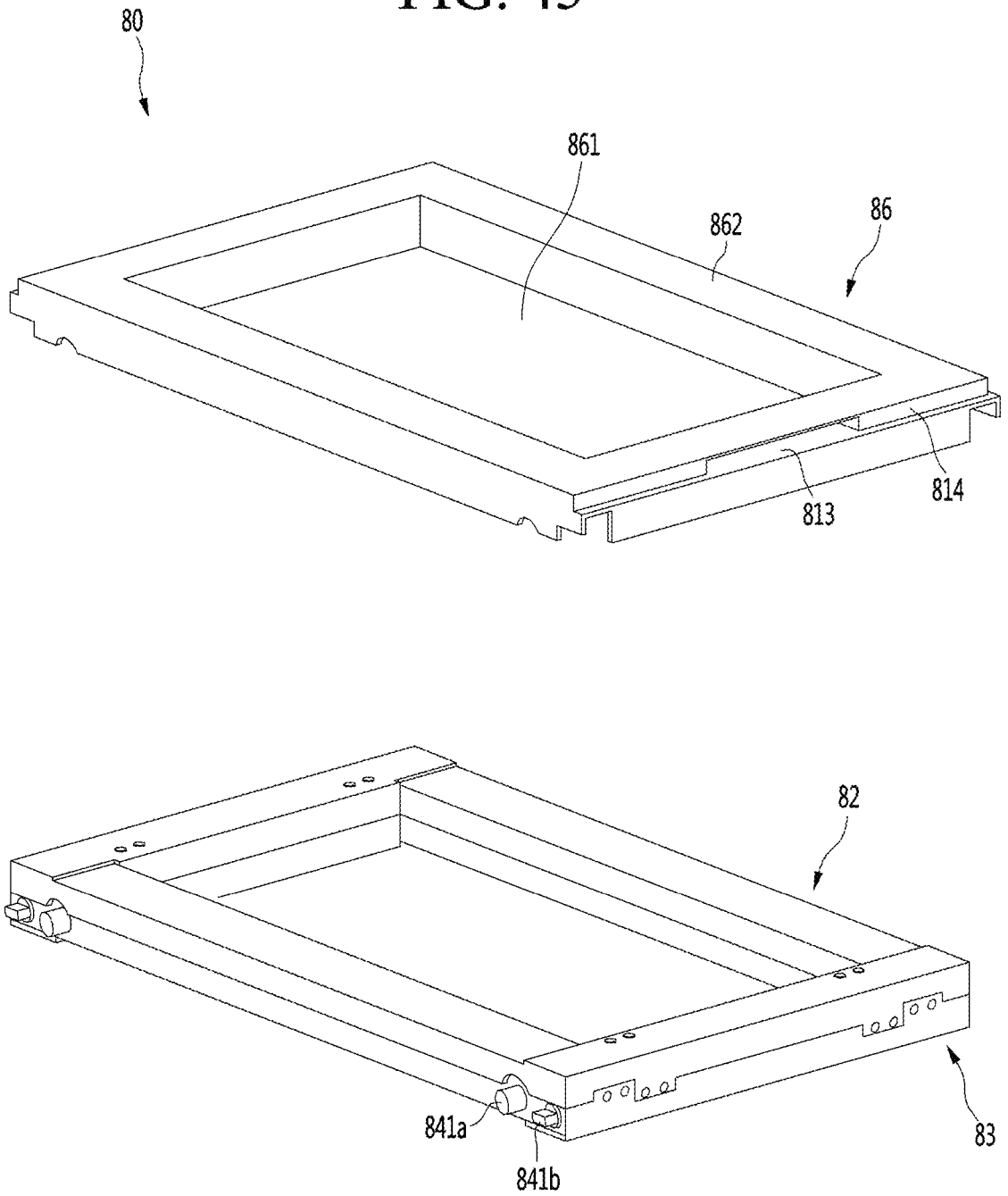
FIG. 45 is an exploded perspective view illustrating a coupling structure of an elevation device and a support plate according to a second embodiment.
Figure 46:
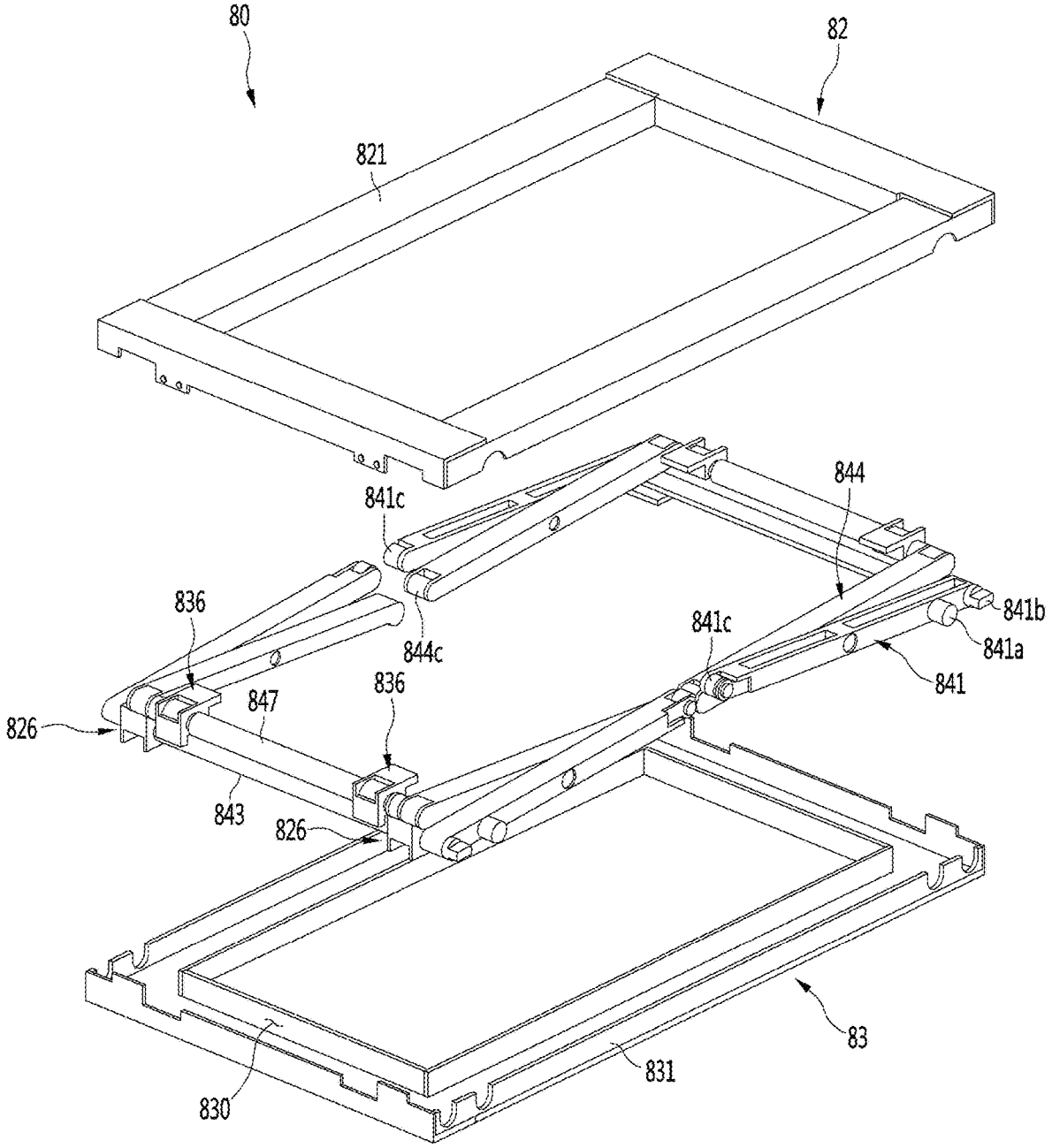
FIG. 46 is an exploded perspective view of the elevation device.
Figure 47:
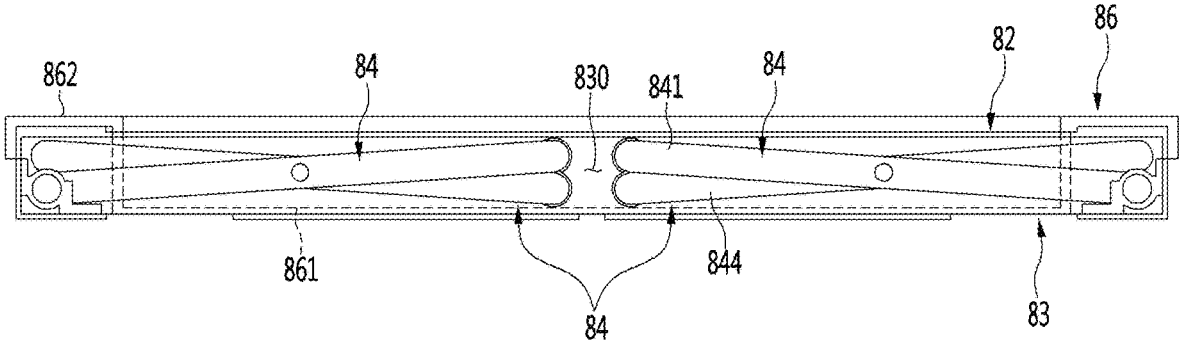
FIG. 47 is a view illustrating an arrangement of a support plate in a state in which the elevation device descends at the lowest position.

FIG. 45 is an exploded perspective view illustrating a coupling structure of an elevation device and a support plate according to a second embodiment. Also, FIG. 46 is an exploded perspective view of the elevation device. Also, FIG. 47 is a view illustrating an arrangement of a support plate in a state in which the elevation device descends at the lowest position.

As illustrated in the drawings, an elevation device 80 according to a second embodiment may include an upper frame 82, a lower frame 83, and a pair of scissors assemblies 84. Also, the elevation device 80 may include a support plate 86 seated on the upper frame 82.

A coupling structure of the upper frame 82, the lower frame 83, and the lifting assembly 84 may be the same as that according to the first embodiment, and the lower frame 83 may be fixed to the inside of the drawer part 32, and the upper frame 82 may be elevated according to the operation of the lifting assembly 84.

The scissors assemblies 84 having the same structure may be disposed on both left and right sides, respectively. Also, one of the scissors assemblies 84 may include a pair of first rods 841 and a pair of second rods 844, and the first rod 841 and the second rod 844 may be axially coupled to each other to rotate.

Also, the ends of the first rods 841 disposed on both sides may be connected by a first rotation shaft 843, and the ends of the second rods 844 disposed on both sides may be connected by a second rotation shaft 847. Also, the first rotation shaft 843 and the second rotation shaft 847 may be configured to pass through the scissors fixing members 826 and 836 mounted on the lower frame 83 and the upper frame 82, respectively. Thus, each of the first rod 841 and the second rod 844 may be rotatably disposed about one end of each of the upper frame 82 and the lower frame 83.

Also, a first roller 841*c* and a second roller 844*c* may be provided at the other end of the first rod 841 and the second rod 844, respectively. The first roller 841*c* and the second roller 844*c* may contact the inner surface of the upper frame 82 and the inner surface of the lower frame 83. When the lifting assembly 84 operates, the first roller 841*c* and the second roller 844*c* may be rolled along the inner surfaces of the upper frame 82 and the lower frame 83, respectively.

The first rod 841 and the second rod 844 and the first rotation shaft 843 and the second rotation shaft 847 may be accommodated in inner spaces of the frame parts 821 and 831 in which the upper frame 82 and the lower frame 83 are disposed. Thus, when the upper frame 82 completely descends, the lower end of the upper frame 82 and the upper end of the lower frame 83 may contact each other to define a space so that the lifting assembly 84 is accommodated in the frame spaces 830 of the frame parts 821 and 831.

Thus, when the upper frame 82 and the lower frame 83 are coupled to each other, the lifting assembly 84 may be accommodated inside the frame parts 821 and 831 and may not be exposed to the outside. Thus, only the scissors protrusion 841*b* and the rod protrusion 841*a* to be coupled may be exposed to the outside.

Also, in the state in which the upper frame 82 moves to the lowermost position so that the upper frame 82 and the lower frame 83 are coupled to each other, as illustrated in FIG. 45, the upper and lower ends of the upper frame 82 and the lower frame 83 may contact each other, and the accommodation space 830 may be defined.

The support plate 86 may be seated on the upper frame 82. Here, the support surface 861 of the support plate 86 may have a shape corresponding to the inside of the frame space 830 and be inserted into the accommodation space 830.

Also, an edge 862 of the support plate 86 may have a width corresponding to that of the upper surface of the frame part 821 of the upper frame 82. Thus, the edge 862 of the support plate 86 may be seated on the upper frame 82 so as to surround a circumference of the upper frame 82 from an upper side. As illustrated in FIG. 47, the support surface 811 may extend to the inner bottom of the frame space 830, i.e., the bottom surface of the lower frame 83. Thus, only the space in which the upper frame 82 and the lower frame 83 are disposed may be lost, and the remaining space may be used as a storage space as a whole even when the elevation device 80 is mounted.

As described above, when compared with the above-described elevation device 80, the elevation device 80 according to the second embodiment may have a structure which the slide guides 825 and 835 and the partition parts 822 and 832 are not provided, and also, the first sliding shaft 842 and the second sliding shaft 846 are omitted in the lifting assembly 84.

Also, the unexplained reference numerals may have the same configuration as the above-described embodiment.

Figure 48:
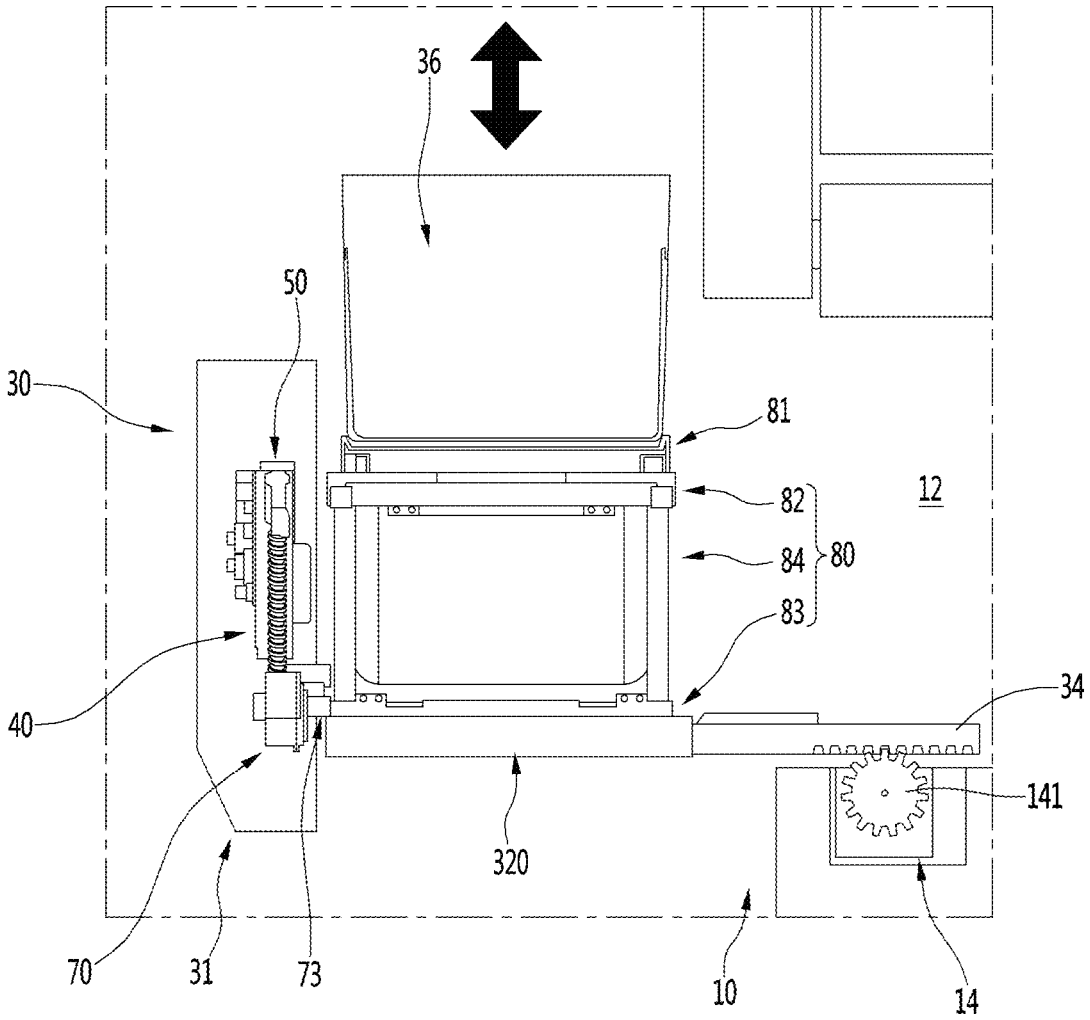
FIG. 48 is a view illustrating an operation of an elevation device of a refrigerator according to a third embodiment.

FIG. 48 is a view illustrating an operation of an elevation device of a refrigerator according to a third embodiment.

As illustrated in the drawing, a refrigerator 1 according to a third embodiment may include a front panel door part 31 in which the driving device 40 is provided and an elevation device support part 320 extending backward from the front panel door part 31 to support the elevation device 80.

The elevation device support part 320 may have at least one surface capable of supporting the bottom surface of the elevation device 80. Also, the elevation device support part 320 may be connected to the rear surface of the front panel door part 31 and have a plate shape or a frame shape extending backward so as to support the elevation device 80 from the lower side. Here, the elevation device 80 may be configured to be exposed to the outside when the door 30 is withdrawn while being fixed to the top surface of the elevation device support part 320.

Alternatively, the elevation device support part 320 may not have a simple plate-like structure but have a structure that covers the circumference of the elevation device 80 so that the elevation device 80 is not exposed.

Also, the elevation device support part 320 may further include a draw-out rail and a draw-out rack 34. The door 30 may be inserted and withdrawn by a draw-out motor 14 and a pinion gear 141 provided in the cabinet 10.

The elevation device 80 may be fixedly mounted on the elevation device support part 320 and may be inserted and withdrawn when the door 30 is inserted and withdrawn. The elevation device 80 may have the same structure as that of the elevation device according to the foregoing embodiment. The elevation device 80 may be connected to the connection assembly 70 so as to be elevated according to the operation of the driving device 40. Also, a support plate 81 may be provided on the top surface of the upper frame 82, and the container 36 may be mounted on the support plate 81 to be elevated.

That is, according to the third embodiment, unlike the drawer part 32 according to the forgoing embodiment, an elevation device support part 320 supporting the elevation device 80 may be provided.

Figure 49:
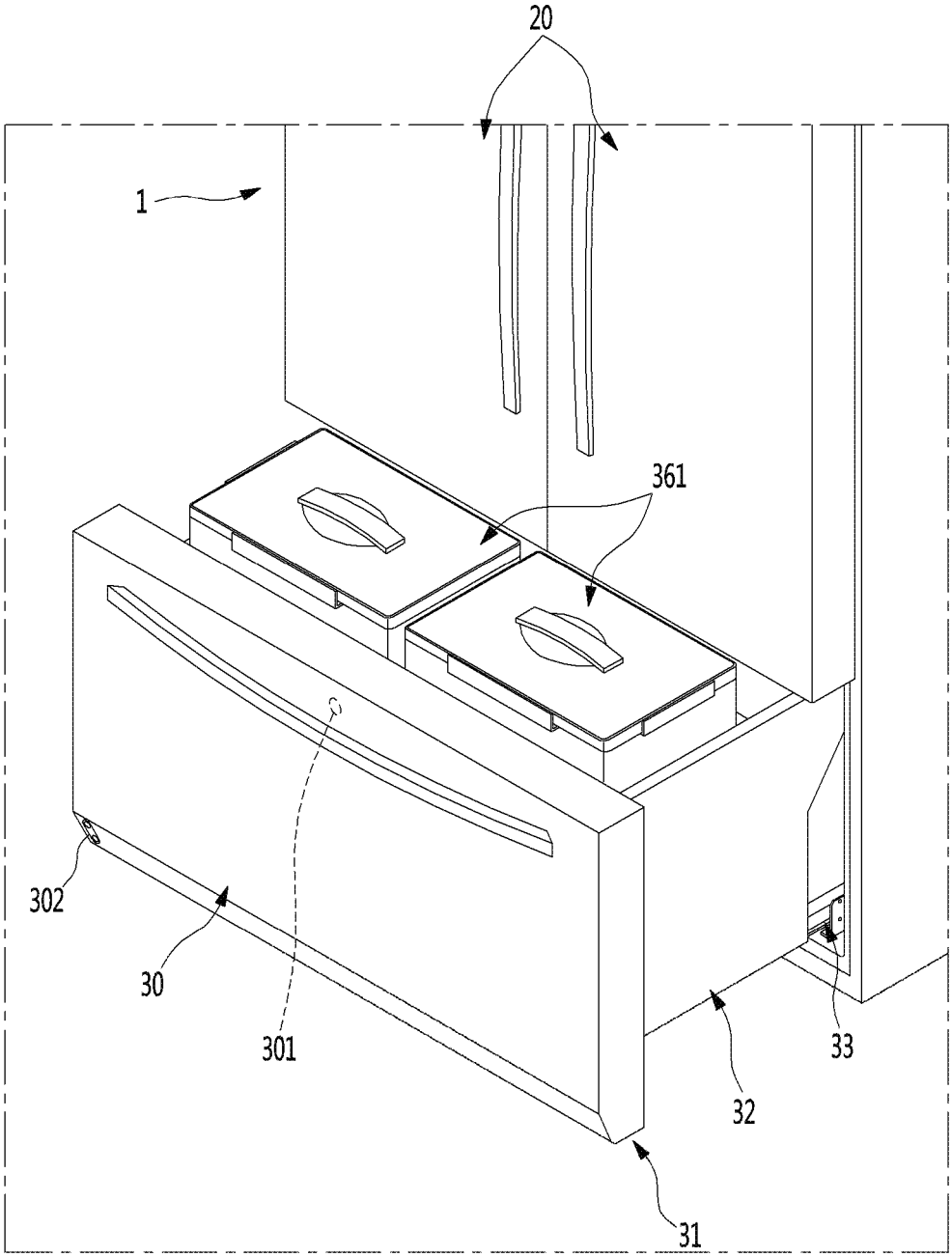
FIG. 49 is a perspective view of a refrigerator according to a fourth embodiment.

FIG. 49 is a perspective view of a refrigerator according to a fourth embodiment.

As illustrated in the drawing, a refrigerator 1 according to a fourth embodiment may include a cabinet 10 having a storage space that is vertically partitioned and a door 2 opening and closing the storage space.

The door 2 may include a rotation door 20 which is provided in an upper portion of a front surface of the cabinet 10 to open and close an upper storage space and a door 30 disposed in a lower portion of the front surface of the cabinet 10 to open and close a lower storage space. The door 30 may be inserted and withdrawn forward and backward in the above embodiment, and the container and the food inside the drawer part 32 may be vertically elevated by the operation of the driving device 40 and the elevation device 80 inside the door 30.

The elevation device 80 may be provided in the region of the front space of the inside of the drawer part 32. Thus, the elevation device 80 may elevate the food in the region of the front space among the entire region of the drawer part 32.

A manipulation part 301 or a manipulation device 302 may be provided at one side of the front panel door part 31, and the driving part 40 may be installed inside the front panel door part 31. Also, the pulling-out operation of the drawer door 30 and/or the elevation of the elevation device 80 may be carried out by the manipulation of the manipulation part 301 or the manipulation device 302.

The drawer part 32 may be provided with the elevation device 80. The elevation device 80 may be elevated by a connection assembly that connects the driving device to the elevation device. Since the constituent of the drawer door 30 and constituent of the driving device 40 and the elevation device 80 are the same as those according to the foregoing embodiment, their detailed descriptions will be omitted.

A plurality of containers 361 may be provided in the elevation device 80. The container 361 may be a sealed container such as a kimchi passage, and a plurality of the containers 361 may be seated on the elevation device 80. The container 361 may be elevated together with the elevation device 80 when the elevation device 35 is elevated. Thus, in the state in which the container 361 ascends, at least a portion of the drawer part 32 may protrude, and thus, the user may easily lift the container 361.

The elevation device 80 may interfere with the rotation door 20 in the rotation door 20 is opened even though the drawer door 30 is withdrawn. Thus, the elevation device 80 may ascend in a state in which the rotation door 20 is closed. For this, a door switch for detecting the opening/closing of the rotation door 20 may be further provided.

Figure 50:
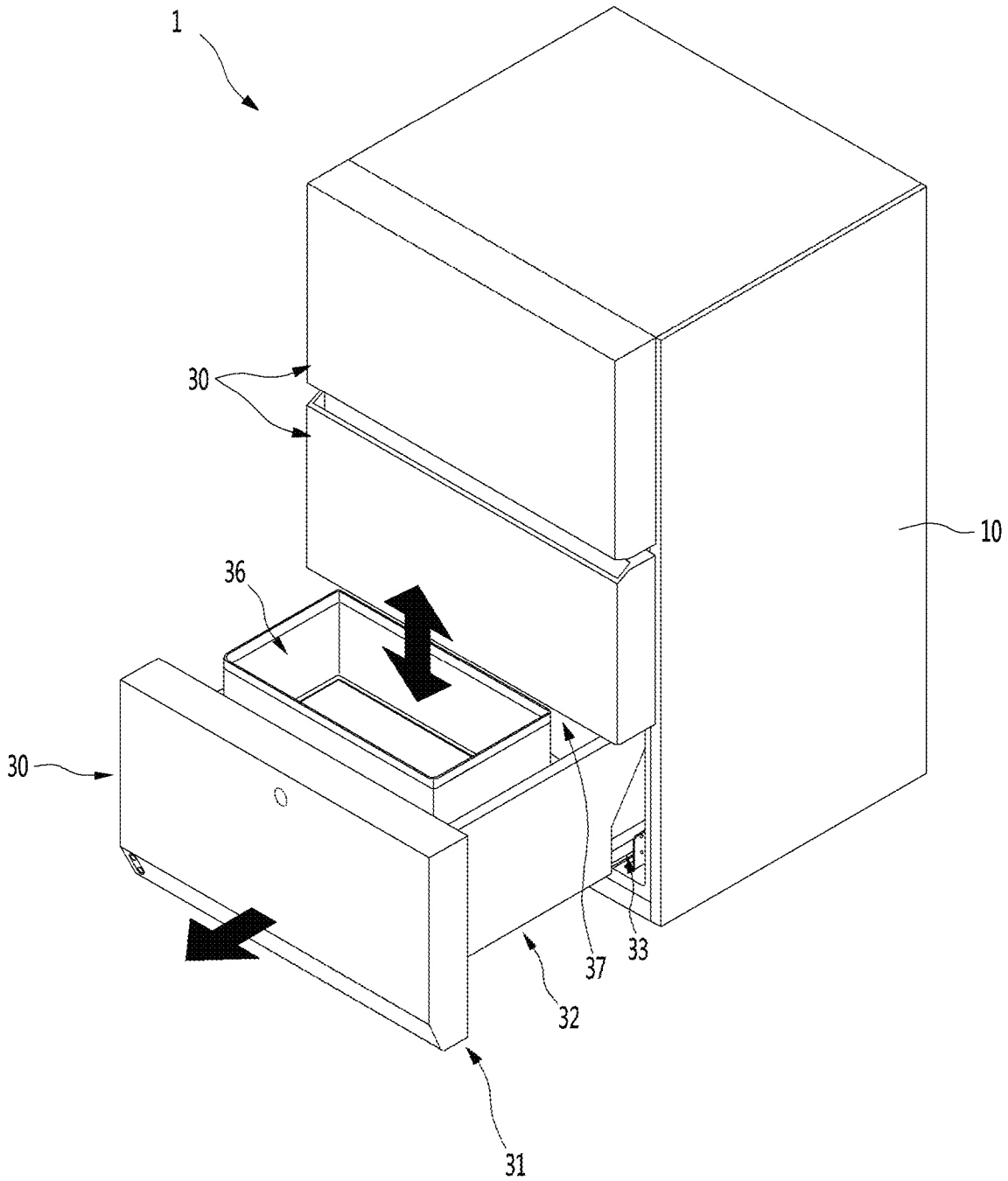
FIG. 50 is a perspective view of a refrigerator according to a fifth embodiment.

FIG. 50 is a perspective view of a refrigerator according to a fifth embodiment.

As illustrated in the drawings, a refrigerator 1 according to a fifth embodiment includes a cabinet 10 defining a storage space therein and a door 2 opening and closing an opened front surface of the cabinet 10, which define an outer appearance of the refrigerator 1.

The door 2 may include a drawer door 30 that defines an entire outer appearance of the refrigerator 1 in a state in which the door 2 is closed and is withdrawn forward and backward. A plurality of the drawer doors 30 may be continuously arranged in the vertical direction. Also, the drawer doors 30 may be independently withdrawn by the user's manipulation. The drawer door 30 may be provided with the driving device 40 and the elevation device 80.

The driving part 40 may be installed in the front panel door part 31, and the elevation part 80 may be provided inside the drawer part 32. Also, the driving device 40 and the elevation device 80 may be connected to each other by the connection assembly 70 when the front panel door part 31 and the drawer part 32 are coupled to each other. Also, the elevation device 80 may be disposed in the front space S1 of the total storage space of the drawer part 32.

The insertion and withdrawal of the drawer door 30 and the elevation of the elevation device 80 may be individually performed. After the drawer door 30 is withdrawn, the elevation device 80 may ascend. Then, after the elevation device 80 descends, the insertion of the drawer door 30 may be continuously performed.

Also, when the plurality of drawer doors 30 are vertically arranged, the elevation device 80 inside the drawer door 30, which is relatively downwardly disposed, may be prevented from ascending in a state where the drawer door 30 is relatively drawn upward. Thus, the drawer door 30 may be prevented from interfering with the drawer door 30 in which the food and container are withdrawn upward.

Also, although the elevation device 80 ascends in the state in which the drawer door 30 that is disposed at the uppermost side is withdrawn in FIG. 38, all of the drawer doors 30 disposed at the upper side may also be elevated by the elevation device 80 that is provided inside.

If a height of each of the drawer doors 30 disposed at the upper side is sufficiently high, only the drawer door 30 disposed at the lowermost position or the elevation device 35 of the of drawer doors 30 disposed relatively downward may be elevated.

Figure 51:
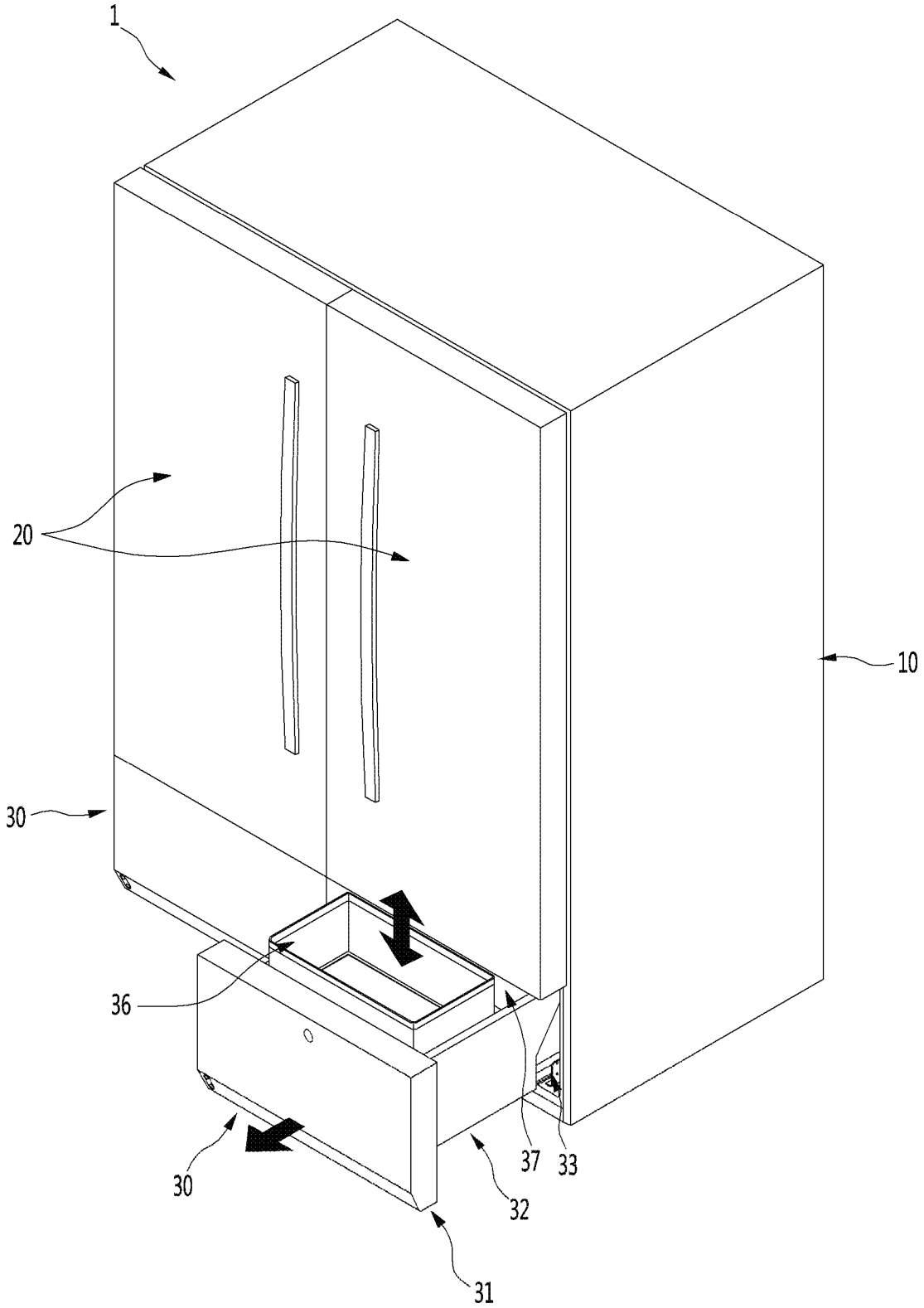
FIG. 51 is a perspective view of a refrigerator according to a sixth embodiment.

FIG. 51 is a perspective view of a refrigerator according to a sixth embodiment.

As illustrated in the drawings, a refrigerator 1 according to a sixth embodiment includes a cabinet 10 defining a storage space therein and a door 2 opening and closing an opened front surface of the cabinet 10, which define an outer appearance of the refrigerator 1.

The inside of the cabinet 10 may be divided into an upper space and a lower space. If necessary, the upper and lower storage spaces may be divided again into left and right spaces.

The door 2 may include a rotation door 20 which is provided in an upper portion of the cabinet 10 to open and close the upper storage space and a drawer door 2 disposed in a lower portion of the cabinet 10 to open and close the lower storage space.

Also, the lower space of the cabinet may be divided into left and right spaces. The drawer door 30 may be provided in a pair so that the pair of drawer doors 30 respectively open and close the lower spaces. A pair of the drawer doors 30 may be arranged on both sides of the right and left sides of the drawer door 30. The drawer door 30 may include the driving device 40 and an elevation device 80.

The driving part 40 may be installed in the front panel door part 31, and the elevation part 80 may be provided inside the drawer part 32. Also, the driving device 40 and the elevation device 80 may be connected to each other by the connection assembly 70 when the front panel door part 31 and the drawer part 32 are coupled to each other. Also, the elevation device 80 may be disposed in the front space S1 of the total storage space of the drawer part 32.

The drawer door 30 may have the same structure as the drawer door according to the foregoing embodiment. Thus, the drawer door 30 may be inserted and withdrawn by user's manipulation. In the drawer door 30 is withdrawn, the elevation device 80 may ascend so that a user more easily accesses a food or container within the drawer door 30.

The refrigerator and the elevation device for the refrigerator according to the embodiment may have the following effects.

The refrigerator according to the embodiment, the portion of the storage space within the drawer door may be elevated in the state in which the drawer door is withdrawn. Thus, when the food is accommodated in the drawer door disposed at the lower side, the user may not excessively turn its back to improve the convenience in use.

Particularly, in order to lift the heavy-weight food or the container containing the food, the user has to lift the food or container with a lot of power. However, the elevation within the drawer door may ascend up to a convenient position by driving the driving device to prevent the user from being injured and significantly improve the convenience in use.

Also, the driving device constituted by the electric devices for providing the power may be provided inside the door part, and the elevation device for the elevation may be provided inside the drawer part so that the driving device and the elevation device are not exposed to the outside to improve the outer appearance.

Particularly, the driving device constituted by the electric devices may be disposed inside the door part, and it may be possible to prevent the user from accessing the door to prevent the occurrence of the safety accident.

Also, the driving device may be provided in the door to block the noise and reduce noise during the use.

Also, the driving part that occupies a large portion of the entire constituents may be disposed in the door part to minimize the storage capacity loss of the drawer part.

Also, the elevation device may also have the structure that is compactly folded and accommodated in the frame in the state of descending to maximally secure the capacity of the accommodation part in which the food is accommodated. Also, the support plate may be configured to be inserted into the opened central portion of the frame. Thus, all the rest portions except for the circumferential portion of the frame may be substantially provided in the space for accommodating the food to maximize the storage capacity of the accommodation part.

Also, the scissors assembly constituting the elevation device may have the structure in which the rod itself rotates by receiving the power of the driving device. Thus, the power may be used for the rotation of the rod without a loss so that the scissors assembly efficiently operates and also is stably elevated even though the heavy food is accommodated therein.

Also, the connection member for transmitting the power for elevating the elevation device may be transmitted from the first connection part and the second connection part to the rotation shaft and also from one side away from the rotation shaft to the rotation shaft. Thus, the force applied at the point away from the rotation shaft may be applied as greater force by the moment. Thus, there is an advantage that when the elevation device is elevated, the greater force is provided to realize the more easy and effective elevation operation.

Also, the elevation device may be provided at a portion of the front portion of the drawer part. Thus, the elevation device may be elevated without interfering with the upper door or cabinet at the time of the elevation without being withdrawn to the extent that the drawer part is completely exposed to the outside. Also, it may be possible to prevent the deflection and durability limitation caused by excessive withdrawal of the heavy drawer door and also to prevent the loss of the cold air caused by excessive withdrawal of the drawer.

In addition, since the entire drawer is not elected but a portion of the drawer is elevated, the entire elevation structure may be compact, and the lightweight structure may be used to minimize the loss of the storage capacity and maintain the simple structure.

Also, the elevation device may be constituted by the pair of scissors assemblies disposed on both left and right sides, and the pair of scissors may operate at the same time by the driving device to perform the elevation operation in the state in which the food supported by the elevation device is stable without being eccentric or tilted to one side.

Also, the slide guide for guiding the slidable movement of the rod when the elevation deice operates may be provided on the frame, and the roller rolled along the inside of the frame may be provided on the end of the rod. Thus, the scissors assembly may very smoothly operate.

Also, the scissors assembly may operate in the state of being accommodated in the accommodation part, and the top surface of the lifting assembly may be covered by the support plate to fundamentally prevent the lifting assembly from being exposed, thereby improving the outer appearance and securing the user's safety.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a storage space;

a drawer door including:

a drawer part with an accommodation space for configured to insert into and withdraw from the storage space in a front-rear direction, and a front panel door coupled to a front portion of the drawer part and configured to open and close at least a portion of the storage space;

an elevation device provided in the drawer part and configured to elevate an object stored in the accommodating space relative to a bottom surface of the drawer part; and a driving device located in the front panel door and configured to supply driving force to move the elevation device, wherein the elevation device comprises a plurality of rods disposed in the accommodation space, the plurality of rods comprising a first rod and a second rod rotatably coupled to and cross each other in a left-right direction, wherein the first rod is one of a pair of first rods that are spaced apart from each other in the front-rear direction and parallel to each other, wherein the second rod is one of a pair of second rods that are spaced apart from each other in the front-rear direction and parallel to each other, wherein the elevation device further comprises:

a first rotation shaft disposed between the pair of the first rods in the front-rear direction and rotatably connected to one end of the first rods at a fixed position in the drawer part, and a first sliding shaft disposed between the pair of the first rods in the front-rear direction, connected to the other end of the first rods and slidably moving in the left-right direction based on rotating of the first rotation shaft, and wherein the driving device comprises:

a motor assembly disposed in the front panel door to generate a driving force to drive the elevation device, and a fixing shaft disposed at a position corresponding to the first rotation shaft in the front panel door in the front-rear direction and rotatably connected to the motor assembly and the first rotation shaft.

2. The refrigerator according to claim 1, wherein the first rod further has a rod protrusion extends in the front-rear direction so as to protrude from the one end of the first rod toward the front panel door.

3. The refrigerator according to claim 2, further comprising a connection assembly comprising a first connection part that is rotatably coupled to the fixing shaft and the rod protrusion so that the first rotation shaft is rotated and the first rod is rotated about the first rotation shaft.

4. The refrigerator according to claim 3, wherein the first connection part comprises:

a first hollow part in one end of the first connection part into which the fixing shaft is inserted; and a second hollow part in the other end of the first connection part into which the rod protrusion is inserted.

5. The refrigerator according to claim 3, wherein the rod protrusion is disposed on a same extension line with the first rotation shaft.

6. The refrigerator according to claim 5, wherein the elevating device further comprises:

a lower frame configured to be fixed to a bottom of the accommodation space of the drawer part, and an upper frame disposed vertically above the lower frame and configured to support a container for storing the object, wherein:

the plurality of the rods is disposed between the upper frame and the lower frame, the one end of the first rod is connected to the first rotation shaft, the first rotation shaft is rotatably fixed to a portion of the lower frame, and the other end of the first rod and the first sliding shaft are slidably coupled to the upper frame.

7. The refrigerator according to claim 6, wherein the upper frame and the lower frame respectively comprise:

an upper frame part and a lower frame part extending in the left-right direction; and an upper edge wall part protruding to form an inner space along an edge of the upper frame part; and a lower edge wall part protruding to form an inner space along an edge of the lower frame part, wherein the one end and the other end of the first rod and the one end and the other end of the second rod are disposed in the inner space defined by the upper edge wall part and the lower edge wall part respectively.

8. The refrigerator according to claim 7, wherein the first rod further comprises a scissors protrusion that is disposed on the one end of the first rod and protrudes toward the front panel door at a position spaced apart from the rod protrusion.

9. The refrigerator according to claim 8, wherein the connection assembly further comprising a second connection part spaced apart from the first connection part and coupled to the scissors protrusion.

10. The refrigerator according to claim 8, wherein the lower edge wall part comprises a first lower edge groove formed on an outer edge, and wherein the rod protrusion is configured to pass through the first lower edge groove.

11. The refrigerator according to claim 10, wherein the lower edge wall part further comprises a second lower edge groove formed on the outer edge at a position corresponding to the scissors protrusion, wherein the second lower edge groove is configured to be spaced apart from the first lower edge groove based on the first rod and the second rod being folded, and wherein the scissors protrusion is configured to pass through the second lower edge groove.

12. The refrigerator according to claim 11, wherein the upper edge wall part comprises an upper edge groove formed at a position corresponding to the second lower edge groove.

13. The refrigerator according to claim 7, wherein a height between the upper frame and the lower frame in a state in which the upper frame and the lower frame are coupled to each other is greater than a sum of thickness of the first rod and the second rod or a height in a state in which the first rod and the second rod are folded.

14. The refrigerator according to claim 7, wherein the upper frame part and the lower frame part have a portion extending in the front-rear direction respectively, and wherein the upper edge wall part and the lower edge wall part further protrude along each edge of the upper and lower frame parts in the front-rear direction.

15. The refrigerator according to claim 14, wherein the elevation device further comprises a lower scissors fixing member disposed inside the inner space formed by the lower edge wall part in the front-rear direction, wherein the lower scissors fixing member is fixed to a portion of the lower edge wall part, and wherein the first rotation shaft passes through the lower scissors fixing member to be rotatably mounted in the lower frame.

16. The refrigerator according to claim 15, wherein a rotation enhancing part is formed to connect between the first rod and the first rotation shaft, and wherein the rotation enhancing part comprises a mounting hole formed in each of both end portions thereof.

17. The refrigerator according to claim 16, wherein the lower scissors fixing member passes through the mounting hole so that the first rotation shaft and the rotation enhancing part rotate in the lower frame.

18. The refrigerator according to claim 15, wherein the elevation device further comprises an upper scissors fixing member disposed inside the inner space formed by the upper edge wall part in the front-rear direction, wherein the upper scissors fixing member is fixed to a portion of the upper edge wall part, and wherein the upper scissors fixing member is located at a position not to interfere with the lower scissors fixing member in a state which the plurality of the rods are folded.

19. The refrigerator according to claim 15, wherein the lower edge wall part comprises a coupling end protruding upward from a top portion of the lower edge wall part, wherein the lower scissors fixing member is coupled to the coupling end, and wherein a coupling groove recessed from the top portion of the lower edge wall part is disposed a rear position of the coupling end in the front-rear direction.

20. A refrigerator comprising:

a cabinet that defines a storage space;

a drawer door comprising (i) a drawer part with an accommodation space configured to insert into and withdraw from the storage space in a front-rear direction, and (ii) a front panel door coupled to a front portion of the drawer part and configured to open and close at least a portion of the storage space;

an elevation device provided in the drawer part and configured to elevate an object stored in the drawer part relative to a bottom surface of the drawer part; and a driving device located in the front panel door and configured to supply driving force to move the elevation device, wherein the elevation device comprises a rotation shaft disposed in a fixed position in the accommodation space of the drawer part in the front-rear direction, and wherein the driving device comprises:

a motor assembly disposed in the front panel door to generate a driving force to drive the elevation device, a fixing shaft disposed at a position corresponding to the rotation shaft in the front panel door in the front-rear direction and rotatably connected to the motor assembly and the rotation shaft, and a connection member that is rotatably connected to the fixing shaft and the rotation shaft to transmit the driving force to the rotation shaft through the fixing shaft by a rotation force.

21. The refrigerator according to claim 20, wherein the elevation device comprises a plurality of rods disposed in the accommodation space in a left-right direction, the plurality of rods comprising a pair of first rods and a pair of second rods, wherein each of the pair of first rods and the pair of second rods are arranged in parallel and rotatably coupled to and cross each other, and wherein the rotation shaft is disposed between the pair of the first rods in the front-rear direction and is connected to one end of the first rod at the fixed position in the drawer part such that the rotation shaft rotates with the pair of the first rods based on the fixing shaft rotating.

22. The refrigerator according to claim 21, wherein one of the pair of first rods adjacent to the front panel door comprises a rod protrusion that protrudes toward the front panel door in a same extension line with the rotation shaft, and wherein the connection member is coupled the fixing shaft to the rod protrusion.

23. The refrigerator according to claim 22, wherein the drawer part comprises a drawer opening on a front side surface, and wherein the rod protrusion is exposed through the drawer opening to be coupled to the connection member.

* * * * *